US005189622A

United States Patent [19]

Hayakawa et al.

[11] Patent Number: 5,189,622

[45] Date of Patent: Feb. 23, 1993

[54] EMBROIDERY DATA PREPARING APPARATUS

[75] Inventors: Atsuya Hayakawa; Kyoji Komuro; Hideaki Shimizu, all of Nagoya, Japan

[73] Assignee: Brother Kogyo Kabushiki Kaisha, Nagoya, Japan

[21] Appl. No.: 598,191

[22] Filed: Oct. 15, 1990

[30] Foreign Application Priority Data

Oct. 21, 1989 [JP] Japan ..... 1-274745

[51] Int. Cl.[5] ..... G06F 15/46; D05B 21/00

[52] U.S. Cl. ..... 364/470; 112/121.12; 112/454

[58] Field of Search ..... 364/470, 188, 189, 191–193; 112/121.11, 121.12, 121.13, 266.1, 453–458, 103

[56] References Cited

U.S. PATENT DOCUMENTS

| | | | |
|---|---|---|---|
| 4,413,574 | 11/1983 | Hirota et al. | 112/121.12 |
| 4,674,420 | 6/1987 | Mizuno et al. | 364/470 |
| 4,849,902 | 7/1989 | Yokoe et al. | 364/470 |
| 4,991,524 | 2/1991 | Ozaki | 364/470 |

*Primary Examiner*—Joseph Ruggiero
*Attorney, Agent, or Firm*—Oliff & Berridge

[57] ABSTRACT

An apparatus for preparing stitch position-related data utilized by an embroidery sewing machine for embroidering a predetermined area, including a dividing device specifying a plurality of base positions on an outline of the area which define a polygon approximating the area, and dividing the area and polygon into sub-areas and sub-polygons, respectively, each of the sub-areas being approximated by a corresponding one of the sub-polygons, a data producing device producing the stitch position-related data based on the sub-areas, a checking device judging, if the dividing device produces a triangle-like sub-area approximated by a triangle, whether or not the triangle-like sub-area is an appropriate sub-area to be utilized by the data producing device for producing the stitch position-related data, and a modifying device modifying, if a negative, judgment is made by the checking device, the triangle-like sub-area to a quadrangle-like sub-area approximated by a quadrangle, by determining a special position on the outline of the area, the quadrangle being defined by the special position and the three base positions defining the triangle approximating the triangle-like sub-area, the data producing device utilizing the quadrangle-like sub-area in place of the triangle-like sub-area for producing the stitch position-related data.

20 Claims, 44 Drawing Sheets

FIG. 3

| RAM | 76 |
|---|---|
| OUTLINE DATA AREA | 76a |
| DIVIDED OUTLINE DATA AREA | 76b |
| STITCH POSITION DATA AREA | 76c |
| BLOCK DATA AREA | 76d |
| BEFORE-DIVISION STACK AREA | 76e |
| AFTER-DIVISION STACK AREA | 76f |
| MAXIMUM AND MINIMUM DATA AREA | 76g |
| DIVISION LINE DATA AREA | 76h |
| AID LINE DATA AREA | 76i |
| VERTICES STACK AREA | 76j |
| SPECIAL DATA AREA | 76k |

FIG. 13

| OUTLINE DATA | DIVIDED OUTLINE DATA | BLOCK DATA |
|---|---|---|
| 1 | 1 | 1<br>2<br>.<br>.<br>$N_1$ |
| | 2 | 1<br>2<br>.<br>.<br>$N_2$ |
| | .<br>.<br>. | .<br>.<br>. |
| | $M_1$ | 1<br>2<br>.<br>.<br>$N_{M1}$ |
| 2 | .<br>.<br>. | .<br>.<br>. |
| .<br>.<br>. | .<br>.<br>. | .<br>.<br>. |
| L | .<br>.<br>. | .<br>.<br>. |
| | $M_L$ | 1<br>2<br>.<br>.<br>$N_{ML}$ |

FIG. 26

| NUMBER n OF FIRST AID LINES | VERTICES | DIVISION BASE POSITION CANDIDATES |
|---|---|---|
| 0 | $P_{MIN}$ | $P_{MIN}$ |
| 1 | $P_1$ | $D_1$ |
| ⋮ | ⋮ | ⋮ |
| n-1 | $P_{n-1}$ | $D_{n-1}$ |
| n | $P_n$ | $D_n$ |
| n+1 | $P_{n+1}$ | $D_{n+1}$ |
| ⋮ | ⋮ | ⋮ |
| N | $P_{MAX}$ | $P_{MAX}$ |

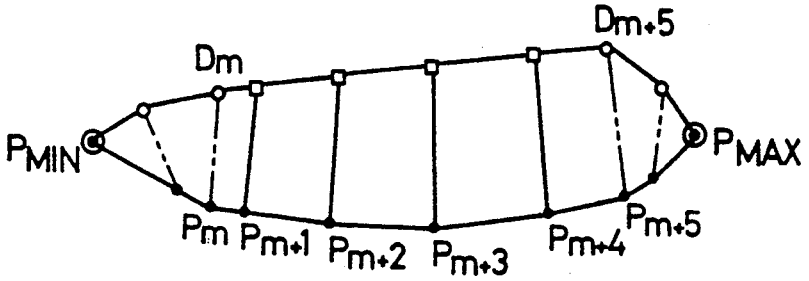
FIG. 27
FIG. 28
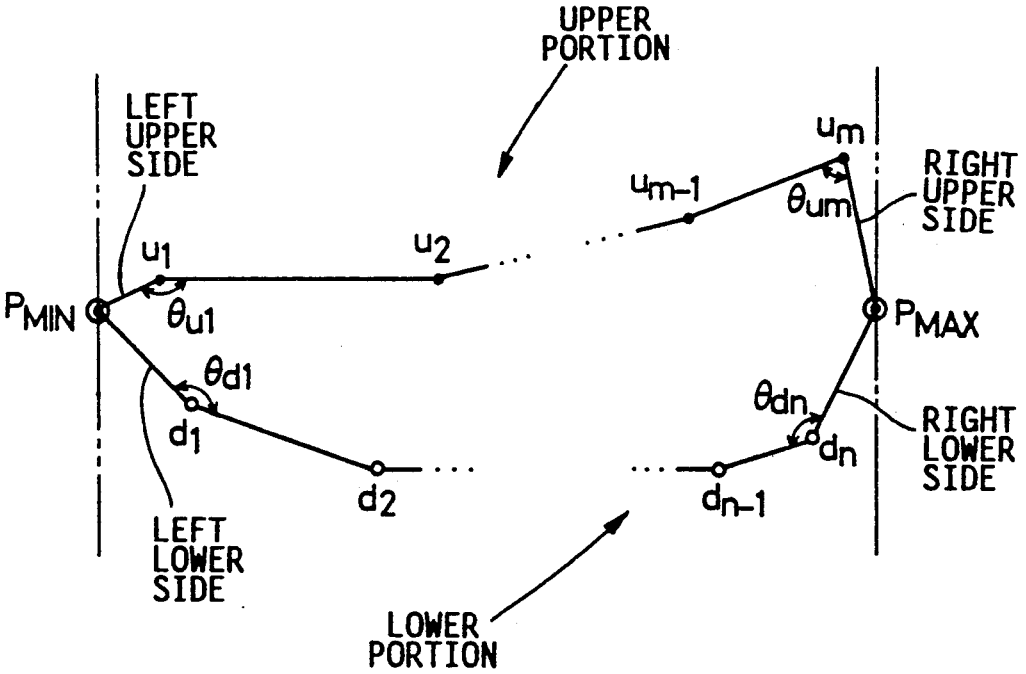

$\theta_{u1}=\theta_{d1}$ $\theta_{u1}=\theta_{d1}$ $\theta_{u1}=\theta_{d1}$ $\theta_{u1} > \theta_{d1}$ $\theta_{u1} > \theta_{d1}$ $\theta_{u1} > \theta_{d1}$ $\theta_{u1} < \theta_{d1}$ $\theta_{u1} < \theta_{d1}$ $\theta_{u1} < \theta_{d1}$ $\theta_{um} = \theta_{dn}$ $\theta_{um} = \theta_{dn}$ $\theta_{um} = \theta_{dn}$ $\theta_{um} > \theta_{dn}$ $\theta_{um} > \theta_{dn}$ $\theta_{um} > \theta_{dn}$ $\theta_{um} < \theta_{dn}$ $\theta_{um} < \theta_{dn}$ $\theta_{um} < \theta_{dn}$

EMBROIDERY DATA PREPARING APPARATUS

BACKGROUND OF THE INVENTION

1. Field Of The Invention

The present invention generally relates to an apparatus for preparing stitch position-related data utilized by an embroidery sewing machine, and particularly to such an apparatus which automatically prepares stitch position-related data utilized by an embroidery sewing machine to embroider a predetermined area by forming stitches at respective stitch positions and filling the area with the formed stitches.

2. Related Art Statement

One of the Applicants has filed a U.S. patent application, the serial number of which has not been known to us, in which he proposes an apparatus for automatically preparing stitch position-related data utilized by an embroidery sewing machine. The proposed apparatus includes (a) dividing means for specifying a plurality of base positions on an outline of an area to be embroidered, based on outline data representative of the outline, the outline data including a plurality of sets of position data each of which is representative of a corresponding one of a plurality of specific positions predetermined on the outline, the base positions defining a polygon approximating the area, the dividing means defining a plurality of straight division lines each of which passes corresponding two of the base positions and which do not intersect each other inside the outline, the division lines dividing the area and the polygon into a plurality of sub-areas and a plurality of sub-polygons, respectively, each of the sub-areas being approximated by a corresponding one of the sub-polygons, and (b) data producing means for producing the stitch position-related data based on the sub-areas. The dividing means may divide a polygon as the area into a plurality of sub-polygons as the sub-areas, the specific positions consisting of vertices of the polygon, the base positions including the vertices. Areas, A, B and C, shown in FIGS. 36, 37 and 38, respectively, each are a polygon. In the case where the outline of an area is approximated by a function such as a spline function, the outline data may consist of sets of position data representative of points defined by the function.

An example of the dividing means includes means for determining the most distant, or approximately the most distant, two positions of the specific positions on the outline of the area, as a minimum and a maximum position of the area, and judging means for judging whether or not all straight segments obtained by connecting each of the distant two positions on the outline and each of the other specific positions on the outline are contained inside the outline, the dividing means dividing the area into divided areas as the sub-areas so that the judging means provides an affirmative judgment with respect to each of the divided areas. By this dividing means, the area A of FIG. 36 is divided into divided areas $A_1$–$A_7$ as the sub-areas of the area, the area B of FIG. 37 into divided areas $B_1$ and $B_2$, and the area C of FIG. 38 into divided areas $C_1$–$C_4$. The division of a predetermined area into divided areas by this dividing means, is effected for the purpose of reducing the direction of a straight line approximating each of the divided areas (hereinafter, referred to as the longitudinal direction of the divided area for the reason indicated later), to be generally parallel to the direction of a curved line or polygonal line approximating the same divided area which direction is taken at respective positions or portions on the curved or polygonal line (hereinafter referred to as the central-line direction of the divided area).

A second example of the dividing means includes means for determining the most distant, or approximately the most distant, two positions of the specific positions on the outline of said area, as a maximum and a minimum position of the area, means for determining a direction of a straight line passing the maximum and minimum positions as a longitudinal direction of the area, the outline consisting of a pair of portions which are opposed to each other with respect to the maximum and minimum positions, means for comparing a number of the specific positions on one of the opposed portions of the outline, with a number of the specific positions on the other portion thereof, and determines as a first portion of the outline one of the opposed portions which includes the smaller number of specific positions, and defining a plurality of straight first aid lines which are perpendicular to the longitudinal direction and each of which passes a corresponding one of the specific positions on the first portion of the outline and intersects the second portion of the outline, the first aid lines dividing the area and the outline into a plurality of first blocks and a plurality of first segments, respectively, each of the first blocks being enveloped by corresponding two of the first aid lines which are opposed to each other and corresponding two of the first segments which are opposed to each other, and means for modifying the each first block by selecting, as a division base position, one of the specific positions on the second portion of the outline which one position cooperates with the specific position associated with each of the opposed two first aid lines of the each first block to define, in place of the each first aid line, a corresponding one of the division lines which passes the associated specific position on the first portion of the outline and the division base position on the second portion of the outline, the base positions consisting of the specific positions, the sub-areas consisting of the each modified first block, the sub-areas including two triangle-like sub-areas to which the minimum and maximum positions belong, respectively. The first blocks except for the two triangle-like sub-areas or blocks are quadrangle-like sub-areas or blocks each approximated by a quadrangle. The modified first blocks are arranged in a row in the area. This dividing means may be operated on one or more of the divided areas produced by the above indicated first example of the dividing means. By this dividing means, the divided areas $B_1$ and $B_2$ of FIG. 37 are divided into blocks 1–4 (indicated at numbers enclosed by circles) and 5–8, respectively.

The central-line direction of a divided area produced from an area, or of an area, is more desirable as an embroidering direction in which direction to form stitches in the divided area, or blocks produced from the divided area or from the area, than the longitudinal direction thereof. By the way, the data producing means of the proposed apparatus provides stitch data for embroidering the divided area, or the blocks, by alternately and successively connecting with thread between stitch positions provided on one of the two portions of the divided area, or two segments of each of the blocks, which are opposed to each other in the direction perpendicular to the longitudinal direction of the divided block, or of the divided area, or the area, from which the blocks are produced, and stitch positions provided on the other portion, or other segment of the each block. However, the longitudinal direction of an area may sufficiently coincide with the central-line direction thereof, especially at opposite end portions thereof where the minimum and maximum positions thereof are located.

Generally, it is required that the sub-areas produced from an area have no triangle-like sub-area approximated by a triangle defined by three base positions specified on an outline of the area. However, when the polygon A of FIG. 36 is divided by the above indicated first type dividing means, the triangle divided area $A_3$ is produced at an intermediate portion thereof. In addition, when a rectangle shown in FIG. 39 is divided by the second type dividing means, a pair of triangle blocks are produced at opposite end portions thereof where the minimum and maximum positions thereof are located. Furthermore, the polygon B of FIG. 37 includes two triangle blocks numbered four and five which are situated at two of four end portions of the divided areas $B_1$, $B_2$ as sub-areas but are not situated at end portions of the polygon B as an area.

In the case where a triangle-like sub-area is produced at an intermediate portion of an area, there arises a problem that a plurality of stitch positions are provided locally at a single base position on the sub-area as indicated at the divided area $A_3$ in FIG. 40, and this problem leads to rendering the density of the stitches formed in the sub-area unequal to the density of the stitches formed in the other sub-areas. In addition, in the case where a triangle-like sub-area is produced at end portions of an area, there arises a problem that the embroidering direction of the stitches formed in the the sub-area may excessively be deflected, as indicated at arrows in the first and third blocks of FIG. 39, from the central-line direction of the area as taken at the sub-area which direction is more desirable as the embroidering direction for the sub-area.

In the above background, it is considered to provide modifying means for modifying the triangle-like sub-area to a quadrangle-like sub-area which is approximated by a quadrangle. For example, the modifying means modifies the first and third triangle-like blocks (triangles) of the rectangle D of FIG. 39, to a quadrangle that is the rectangle D itself, as shown in FIG. 41. When the data producing means provides stitch positions on the upper and lower sides of the rectangle D of FIG. 41 and the embroidery sewing machine embroiders the rectangle D by connecting with thread between the stitch positions, the embroidering direction of the stitches formed in the rectangle D coincides with the central-line direction thereof.

A first example of the modifying means modifies a triangle-like sub-area actually produced by the dividing means, to a quadrangle-like sub-area. In this case, the modifying means may judge, each time an area is divided into two sub-areas, whether or not each of the two sub-areas is a triangle-like sub-area, and if an affirmative judgment is provided, modify the triangle-like sub-area to a quadrangle-like sub-area. Alternatively, the modifying means may judge, after an area is completely divided into a plurality of sub-areas, whether or not each of the sub-areas is a triangle-like sub-area, and if an affirmative judgment is provided, modify the triangle-like sub-area to a quadrangle-like sub-area.

In the case where an area is divided into blocks by the above indicated second type dividing means, two triangle-like sub-areas inevitably are produced at the two particular portions to which the minimum and maximum positions thereof belong, respectively, irrespective of the shape or profile of the area. A second example of the modifying means is operated on the particular portions of the area for modifying each of the two triangle-like sub-areas to a quadrangle-like sub-area. Furthermore, it is possible to operate the dividing means to divide the area so that the particular portions be divided into quadrangle-like sub-areas. In this case, no triangle-like sub-area is produced as an actual sub-area.

As is apparent from the foregoing, it is possible to divide an area into sub-areas such that the sub-areas include no triangle-like sub-area. However, there are cases where it is not appropriate to provide no triangle-like sub-area, namely, where if stitches are formed in an area including no triangle-like sub-area, the embroidering direction of the stitches formed does not sufficiently coincide with the central-line direction of the area. FIG. 42 shows an area as an example of such cases. The area of FIG. 42 includes a triangle-like sub-area which is symmetrical with respect to the central-line direction of the area and simultaneously protrudes outward. Hereinafter, areas analogous to the area of FIG. 42 are referred to as the rhombus-type areas. If a rhombus-type area is divided into sub-areas such that no triangle-like sub-area is provided at a particular portion thereof, then there arises a problem that, at the particular portion of the area, stitches are formed in an inappropriate direction that does not sufficiently coincide with the central-line direction of the area, as indicated at arrows in FIG. 42.

SUMMARY OF THE INVENTION

It is therefore an object of the present invention to provide a stitch position-related data preparing apparatus which includes checking means for judging whether or not a triangle-like sub-area resulting from dividing an area is an appropriate sub-area to be utilized for producing the stitch position-related data.

The above object has been achieved by the present invention. According to one aspect of the present invention, there is provided an apparatus for preparing stitch position-related data utilized by an embroidery sewing machine for embroidering a predetermined area by forming stitches at respective stitch positions and thereby filling the area with the formed stitches, comprising (a) dividing means for specifying a plurality of base positions on an outline of the area based on outline data representative of the outline, the outline data including a plurality of sets of position data each of which is representative of a corresponding one of a plurality of specific positions predetermined on the outline, the base positions defining a polygon approximating the area, the dividing means defining a plurality of straight division lines each of which passes corresponding two of the base positions and which do not intersect each other inside the outline, the division lines dividing the area and the polygon into a plurality of sub-areas and a plurality of sub-polygons, respectively, each of the sub-areas being approximated by a corresponding one of the sub-polygons, (b) data producing means for producing the stitch position-related data based on the sub-areas, (c) checking means for, if the dividing means produces as one of the sub-areas a triangle-like sub-area which is approximated by a triangle as the corresponding one sub-polygon therefor, judging whether or not the triangle-like sub-area is an appropriate sub-area to be utilized by the data producing means for producing the stitch position-related data, and (d) modifying means for, if a negative judgment is made by the checking means, modifying the triangle-like sub-area to a quadrangle-like sub-area which is approximated by a quadrangle, by determining a special position on the outline of the area, the quadrangle being defined by the special position and the three base positions defining the triangle approximating the triangle-like sub-area, the data producing means utilizing the quadrangle-like sub-area in place of the triangle-like sub-area for producing the stitch position-related data.

In the apparatus constructed as described above, the checking means judges whether or not a triangle-like sub-area provided by dividing an area is an appropriate sub-area to be used for producing the stitch position-related data, and the modifying means modifies only the triangle-like sub-area for which a negative judgment is made by the checking means, to a quadrangle-like sub-area. The embroidering direction of the stitches to be formed in the quadrangle-like sub-area will more suitably coincide with the central-line direction of the area at the zone of the triangle-like or quadrangle-like sub-area than that for the triangle-like sub-area. This leads to producing in the area an embroidery of higher quality.

According to a preferred embodiment of the present invention, the dividing means divides a polygon as the area into a plurality of sub-polygons as the sub-areas, the specific positions consisting of vertices of the polygon, the base positions including the vertices.

According to another embodiment of the present invention, the data producing means produces, as the stitch position-related data, a plurality of sets of block data each representative of a corresponding one of the sub-areas which may, or may not, include the quadrangle-like sub-area, the each set of block data comprising sets of position data representative of the base positions defining the sub-polygon approximating the corresponding one sub-area, such that the sets of position data may, or may not, include a set of position data representative of the special position. If the sets of block data area are produced, then it is possible to automatically determine stitch positions to be provided for each of the blocks, based on a corresponding one of the sets of block data.

According to yet another embodiment of the present invention, the data producing means produces, based on each of the sub-areas, stitch position data representative of stitch positions which the embroidery sewing machine alternately connects with thread for forming the stitches and filling the each sub-area with the formed stitches, the stitch position data serving as the stitch position-related data.

According to a further embodiment of the present invention, the dividing means comprises determining means for determining the most distant, or approximately the most distant, two positions of the specific positions on the outline of the area, as a minimum and a maximum position of said area, and judging means for judging whether or not all straight segments obtained by connecting each of the distant two positions on the outline and each of the other specific positions on the outline are contained inside the outline, the dividing means dividing the area into divided areas as the sub-areas by the division lines so that the judging means provides an affirmative judgment with respect to each of the divided areas.

According to a preferred feature of the present invention, the checking means comprises first judging means for judging whether or not the dividing means provides a triangle-like sub-area as one of the sub-areas such that the triangle-like sub-area has a sub-area adjacent thereto, the triangle-like sub-area and the adjacent sub-area having a common segment belonging to one of the division lines, the checking means providing the negative judgment and the modifying means modifying the triangle-like sub-area to the quadrangle-like sub-area by determining the special position on an outline of the adjacent sub-area if the first judging means provides an affirmative judgment, the checking means providing an affirmative judgment and the data producing means utilizing the triangle-like sub-area for producing the stitch position-related data if the first judging means provides a negative judgment. In this case, the first judging means of the checking means may judge whether or not the dividing means provides the triangle-like sub-area such that the adjacent sub-area is a sub-area other than a triangle-like sub-area. In addition, in this case, the modifying means may comprise second judging means for, if the affirmative judgment is provided by the first judging means, judging whether or not each of the two segments of an outline of the triangle-like sub-area other than the common segment belongs to one of the division lines, the modifying means determining, if only one of the two segments belongs to one of the division lines, the one segment as a special segment, and specifying the special position on a segment of the outline of the adjacent sub-area which segment is adjacent to the special segment of the triangle-like sub-area, the data producing means handling the special segment as a stitch-free segment on which the data producing means provides no stitch position. If one of the above indicated two segments belongs to one of the division lines, it means that the triangle-like sub-area is situated at an intermediate portion of the area. If neither of the above indicated two segments belongs to the division lines, it means that the triangle-like sub-area is situated at an end portion of the area to which the minimum or maximum position belongs.

According to another feature of the present invention, if the dividing means produces as one of the sub-areas a quadrangle-like sub-area which is approximated by a quadrangle as the corresponding one sub-polygon therefor, the data producing means utilizes the quadrangle-like sub-area for producing the stitch position-related data.

According to yet another feature of the present invention, the dividing means comprises means for determining the most distant, or approximately the most distant, two positions of the specific positions on the outline of the area, as a maximum and a minimum position of the area, means for determining a direction of a straight line passing the maximum and minimum positions as a longitudinal direction of the area, the outline consisting of a pair of portions which are opposed to each other with respect to the maximum and minimum positions, means for comparing a number of the specific positions on one of the opposed portions of the outline, with a number of the specific positions on the other portion thereof, and determines as a first portion of the outline one of the opposed portions which includes the smaller number of specific positions, and defining a plurality of straight first aid lines which are perpendicular to the longitudinal direction and each of which passes a corresponding one of the specific positions on the first portion of the outline and intersects the second portion of the outline, the first aid lines dividing the area and the outline into a plurality of first blocks and a plurality of first segments, respectively, each of the first blocks being enveloped by corresponding two of the first aid lines which are opposed to each other and corresponding two of the first segments which are opposed to each other, and means for modifying the each first block by selecting, as a division base position, one of the specific positions on the second portion of the outline which one position cooperates with the specific position associated with each of the opposed two first aid lines of the each first block to define, in place of the each first aid line, a corresponding one of the division lines which passes the associated specific position on the first portion of the outline and the division base position on the second portion of the outline, the sub-areas consisting of the each modified first block, the sub-areas including two triangle-like sub-areas to which the minimum and maximum positions belong, respectively. An area to be divided by this dividing means may be one of the above described divided areas.

In a preferred form of the above indicated apparatus of the present invention, the dividing means comprises means for defining a plurality of straight second aid lines which are perpendicular to the longitudinal direction and each of which passes a corresponding one of the specific positions on the second portion of the outline and intersects the first portion of the outline, the second aid lines cooperating with the first aid lines to divide the area and the outline into a plurality of second blocks and a plurality of second segments, respectively, each of the second blocks being enveloped by corresponding two of the first and second aid lines which are opposed to each other and corresponding two of the second segments which are opposed to each other, means for determining a first vector starting at one of opposite ends of one of the opposed two segments of each of the second blocks and ending at the other end of the one segment, a second vector starting at one of opposite ends of the other segment which end is opposed to the one end of the one segment and ending at the other end of the other segment which end is opposed to the other end of the one segment, and a third vector which starts at a position on one of the opposed two aid lines of the each second block, extends in a direction of a vector obtained by addition of the first and second vectors, and ends at a position on the other aid line, the end position on each of the first and second aid lines at which the third vector determined for one of the two second blocks adjacent to the each aid line ends serving simultaneously as the start position on the each aid line at which the third vector determined for the other block starts, the minimum position serving as either the start ends or the end ends for both the first and second vectors for the second block to which the minimum position belongs and simultaneously as either the start position or the end position for the second block to which the minimum position belongs, while the maximum position serving as either the end ends or the start ends for both the first and second vectors for the second block to which the maximum position belongs and simultaneously as either the end position or the start position for the second block to which the maximum position belongs, means for determining with respect to each of the first aid lines a fourth vector by addition of the third vectors determined for the two blocks adjacent to the each first aid line, and means for defining a straight reference line which passes the specific position associated with the each first aid line and is perpendicular to the fourth vector. In this case, the dividing means may comprise means for determining an intersection of the each first aid line and the second portion of the outline, and determining two of the specific positions on the second portion which positions are adjacent to the intersection and located on both sides of the intersection, respectively, as a preceding and a following specific position for the associated specific position, and means for comparing a first angle contained by the reference line and a first straight line defined by the preceding specific position and the associated specific position, with a second angle contained by the reference line and a second straight line defined by the following specific position and the associated specific position, the dividing means determining as the division base position one of the preceding and following specific positions which provides the smaller one of the first and second angles, the each modified first block being defined by the outline and the division lines determined with respect to the opposed two aid lines of the each first block.

According to a further feature of the present invention, the checking means comprises third judging means for judging whether or not the each triangle-like sub-area is the appropriate sub-area, based on at least one parameter with respect to the polygon approximating the area. That is, the third judging means judges based on the at least one parameter whether the each triangle-like sub-area is a rhombus-type or a rectangle-type, and provides a negative judgment if the triangle-like sub-area is of the rectangle-type. The area may be the above indicated divided area, and the polygon approximating the area may be the sub-polygon approximating the divided area. The third judging means may be operated directly for a triangle-like sub-area as one of the divided areas.

In a preferred form of the above indicated apparatus, the at least one parameter comprise a first angle contained by one of the two segments and a segment adjacent to the one segment on one of the first and second portions of the outline, a second angle contained by the other of the two segments and a segment adjacent to the other segment on the other of the first and second portions of the outline, a first distance between the corresponding one of the minimum and maximum positions and a base position adjacent thereto which cooperates with the minimum or maximum position to define the one segment on the one portion of the outline as measured in the longitudinal direction, and a second distance between the minimum or maximum position and a base position adjacent thereto which cooperates with the minimum or maximum position to define the other segment on the other portion of the outline as measured in the longitudinal direction, the checking means providing an affirmative judgment if the first angle is equal to the second angle, the checking means providing the negative judgment if the first angle is equal to the second angle and the first distance is greater than the second distance, so that the modifying means determines the other segment as the special segment and specifies the special position on the other segment, the checking means providing the affirmative judgment if the first angle is equal to the second angle and the first distance is smaller than the second distance, so that the modifying means determines the one segment as the special segment and specifies the special position on the one, segment, the checking means providing the negative judgment if the first angle is greater than the second angle and the first distance is greater than the second distance, so that the modifying means determines the other segment as the special segment and specifies the special position on the other segment, the checking means providing the affirmative judgment if the first angle is greater than the second angle and the first distance is not greater than the second distance, the checking means providing the negative judgment if the first angle is smaller than the second angle and the first distance is smaller than the second distance, so that the modifying means determines the one segment as the special segment and specifies the special position on the one segment, the checking means providing the affirmative judgment if the first angle is smaller than the second angle and the first distance is not smaller than the second distance.

In another form of the above indicated apparatus, the dividing means comprises fourth judging means for judging whether or not all straight segments obtained by connecting each of the distant two positions on the outline and each of the other specific positions on the outline are contained inside the outline, the dividing means dividing the area into divided areas as the sub-areas by a plurality of first division lines as the division lines so that the third judging means provides an affirmative, judgment with respect to each of the divided areas, the dividing means providing the each modified first block from each of the divided areas by using a plurality of second division lines as the division lines such that the each divided area includes two triangle-like modified first blocks to which the minimum and maximum positions thereof belong, respectively, the checking means comprising fifth judging means for, with respect to each of the two triangle-like modified first blocks to which the minimum and maximum positions belong, judging whether or not each of the two segments of an outline of the each triangle-like modified first block which segments commonly have a corresponding one of the minimum and maximum positions, belongs to one of the first division lines, the checking means providing the negative judgment if only one of the two segments belongs to one of the first division lines, so that the modifying means modifies the triangle-like modified first block to a quadrangle-like block by determining the one segment as a special segment and specifying the special position on a segment of the outline of a modified first block adjacent to the triangle-like modified first block which segment is adjacent to the special segment, the data producing means handling the special segment as a stitch-free segment on which the data producing means provides no stitch position, the third judging means judging whether or not the each triangle-like modified first block is the appropriate sub-area, if both of the two segments of the each triangle-like block do not belong to the first division lines. In the case where the apparatus does not have the fifth judging means, if an end portion of a divided area to which the minimum or maximum position thereof belongs is of the rhombus-type and situated at an intermediate portion of an area to which the divided area belongs, as indicated at the third and fourth blocks of an are shown in FIG. 44, then the third judging means provides an affirmative judgment, permitting the end portion to be divided into a triangle-like sub-area, which is utilized by the data producing means for producing the stitch position-related data. If stitches are formed according to the thus produced stitch position-related data, then the stitches are divided or bordered by a first division line separating the divided area from another divided area adjacent to the divided area, which division line is, for example, a straight segment, 4–9, shown in FIG. 44. However, this problem is solved by incorporating the fifth judging means into the apparatus. If the area F of FIG. 44 is divided by this apparatus, the third and fourth blocks of the area are provided as quadrangle-like blocks, as shown in FIG. 45, preventing stitches from being bordered by the first division line between the third and fourth blocks.

Alternatively, the checking means may be adapted to determine a difference between a direction of a vector determined with respect to an end portion of an area or a divided area to which the minimum or maximum position thereof belongs, and the central-line direction of the area or the divided area at the zone of the end portion thereof, and provide a negative judgment if the difference is greater than a predetermined value. The vector may be obtained by adding a first vector starting at the minimum or maximum position and ending at one of two base positions adjacent to the minimum or maximum position, and a second vector starting at the minimum or maximum position and ending at the other of the two base positions adjacent to the minimum or maximum position.

According to another aspect of the present invention, there is provided an apparatus for preparing stitch position-related data utilized by an embroidery sewing machine for embroidering a predetermined area by forming stitches at respective stitch positions and thereby filling the area with the formed stitches, comprising dividing means for specifying a plurality of base positions on an outline of the area based on outline data representative of the outline, the outline data including a plurality of sets of position data each of which is representative of a corresponding one of a plurality of specific positions predetermined on the outline, the base positions defining a polygon approximating the area, the dividing means defining a plurality of straight division lines each of which passes corresponding two of the base positions and which do not intersect each other inside the outline, the division lines dividing the area and the polygon into a plurality of first sub-areas and a plurality of first sub-polygons, respectively, each of the first sub-areas being approximated by a corresponding one of the first sub-polygons, the dividing means dividing said area such that the first sub-areas include at least one triangle-like sub-area each of which is approximated by a triangle as the corresponding one first sub-polygon therefor, data producing means for producing the stitch position-related data based on the first sub-areas, checking means for, before the dividing means dividing the area into the first sub-areas, judging whether or not each of the at least one triangle-like sub-area is an appropriate sub-area to be utilized by the data producing means for producing the stitch position-related data, and the dividing means dividing the area into a plurality of second sub-areas by, with respect to the each of at least one triangle-like sub-area for which a negative judgment is made by the checking means, replacing the each triangle-like sub-area with a quadrangle-like sub-area which is approximated by a quadrangle, by determining a special position on the outline of the area, the quadrangle being defined by the special position and the three base positions defining the triangle approximating the each triangle-like sub-area, the data producing means producing the stitch position-related data based on the second sub-areas including the quadrangle-like sub-area.

In the case where, before an area is actually divided by the dividing means, it is known because of a specific dividing manner that at least one triangle-like sub-area is produced at a particular portion of the area, it is possible to judge whether or not one or each of the at least one triangle-like sub-area is an appropriate sub-area to be used for producing the stitch position-related data, before the actual division, and actually divide the area so as not to include the inappropriate triangle-like sub-area or areas by replacing it or them by one or more quadrangle-like sub-areas.

According to yet another aspect of the present invention, there is provided an apparatus for preparing stitch position-related data utilized by an embroidery sewing machine for embroidering a predetermined area by forming stitches at respective stitch positions and thereby filling the area with the formed stitches, comprising dividing means for specifying a plurality of base positions on an outline of the area based on outline data representative of the outline, the outline data including a plurality of sets of position data each of which is representative of a corresponding one of a plurality of specific positions predetermined on the outline, the base positions defining a polygon approximating the area, the dividing means defining a plurality of straight division lines each of which passes corresponding two of the base positions and which do not intersect each other inside the outline, the division lines dividing the area and the polygon into a plurality of sub-areas and a plurality of sub-polygons, respectively, each of the sub-areas being approximated by a corresponding one of the sub-polygons, the dividing means dividing the area such that the sub-areas include at least one triangle-like sub-area each of which is approximated by a triangle as the corresponding one sub-polygon therefor, data producing means for producing the stitch position-related data based on the sub-areas, checking means for judging whether or not each of the at least one triangle-like sub-area is an appropriate sub-area to be utilized by the data producing means for producing the stitch position-related data, and modifying means for, with respect to the each of at least one triangle-like sub-area for which a negative judgment is made by the checking means, modifying the each triangle-like sub-area to a quadrangle-like sub-area which is approximated by a quadrangle, by determining a special position on the outline of the area, the quadrangle being defined by the special position and the three base positions defining the triangle approximating the each triangle-like sub-area, the data producing means utilizing the quadrangle-like sub-area for producing the stitch position-related data.

In a preferred embodiment of the above indicated apparatus, the checking means judges whether or not the each of at least one triangle-like sub-area is the appropriate sub-area, before the dividing means divides the area into the sub-areas.

In a preferred embodiment of the above indicated apparatus, the checking means judges whether or not the each of at least one triangle-like sub-area is the appropriate sub-area, after the dividing means divides the area into the sub-areas.

BRIEF DESCRIPTION OF THE DRAWINGS

The above and optional objects, features and advantages of the present invention will be better understood by reading the following detailed description of the presently preferred embodiment of the invention when considered in conjunction with the accompanying drawings, in which:

FIG. 3 is an illustrative view of a random access memory (RAM) of a computer which constitutes a major part of the control device;

FIG. 13 is a view for explaining the special data area of the RAM of the computer;

FIGS. 19 through 27 are views for explaining the routine of FIGS. 9A–9C;

FIGS. 28, 29A–29C, 30A–30C, 31A–31C, 32A–32C, 33A–33C, and 34A–34C are view for explaining the routine of FIGS. 10A–10D;

DETAILED DESCRIPTION OF THE PREFERRED EMBODIMENTS

Figure 1:
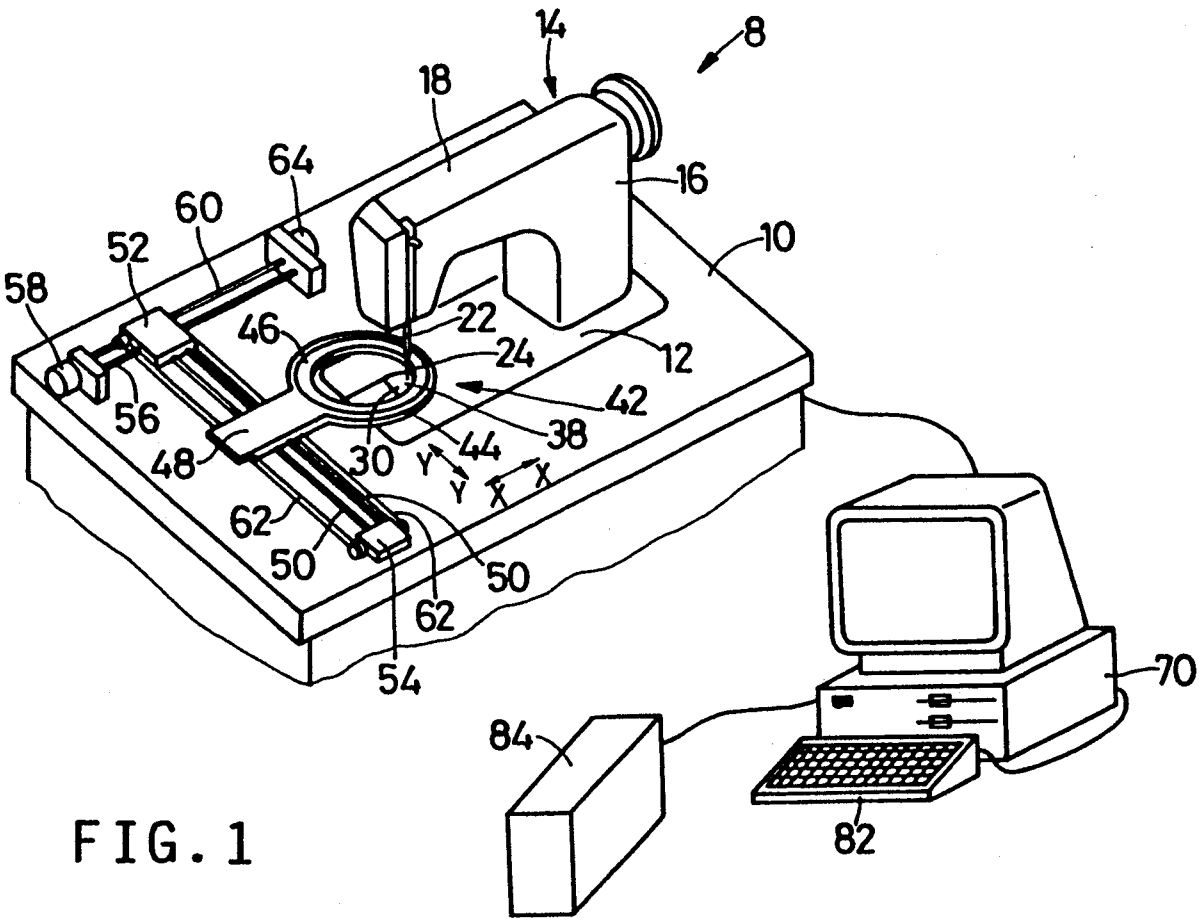
FIG. 1 is a perspective view of an embroidery sewing machine system which has a data producing apparatus embodying the present invention.

Referring first to FIG. 1, there is shown an embroidery sewing machine system embodying the present invention. The system includes an embroidery sewing machine 8.

In FIG. 1, reference numeral 10 designates a table of the sewing machine 8 on which a bed 12 and a main frame 14 are provided. The main frame 14 includes a column 16 extending vertically from the bed 12, and an arm 18 extending horizontally from the upper portion of the column 16 like a cantilever. A needle bar 22 is connected to the main frame 14 via a needle bar frame (not shown), such that the needle bar 22 is vertically displaceable. A needle 24 is secured to the lower end of the needle bar 22. The needle bar 22 is coupled to a main motor 26 (FIG. 2) via a needle bar connecting bracket and other members (not shown). The needle bar 22 or needle 24 is reciprocated vertically when the main motor 26 is operated. The bed 12 has an opening formed in the upper surface thereof. A throat plate 30 having a needle aperture 38, is adapted to close the opening of the bed 12.

An embroidery frame 42 is mounted on the table 10 so as to be movable in an X and a Y direction which are perpendicular to each other. The embroidery frame 42 includes an outer frame 44 having a ring portion, and an inner frame 46 adapted to be fitted in the ring portion of the outer frame 44. The outer and inner frames 44, 46 of the embroidery frame 42 cooperate with each other to support a work fabric (not shown) therebetween. The outer frame 44 has a slide portion 48 extending from the ring portion thereof in the X direction and away from the column 16. The slide portion 48 is slidably engaged with a pair of guide pipes 50, 50 extending in the Y direction. The two pairs of corresponding opposite ends of the guide pipes 50 are connected by a first and a second connecting member 52, 54, respectively. The first connecting member 52 is supported on a feed screw 56 and a rotation transmission bar 60 each extending in the X direction, and is displaced in the X direction when the feed screw 56 is rotated by an X drive motor 58. The second connecting member 54 is supported on the bed 10 via a ball member (not shown) which is rotatably secured to the second connecting member 54. The ball member is displaceable together with the second connecting member 54 as a unit. A pair of endless wires 62, 62 are engaged with the slide portion 48 and the first and second connecting members 52, 54. When the rotation transmission bar 60 is rotated by a Y drive motor 64, the wires 62 are displaced so that the slide portion 48 is displaced in the Y direction. By means of the combination of the X direction movement of the first connecting member 52 and the Y direction movement of the slide portion 48, the embroidery frame 42 is moved to any position in a horizontal plane, namely, in a X-Y orthogonal coordinate system defined by the X and Y directions or axes. This embroidery frame movement cooperates with the needle reciprocatory movement to enable a predetermined area on the work fabric to be embroidered.

Figure 2:
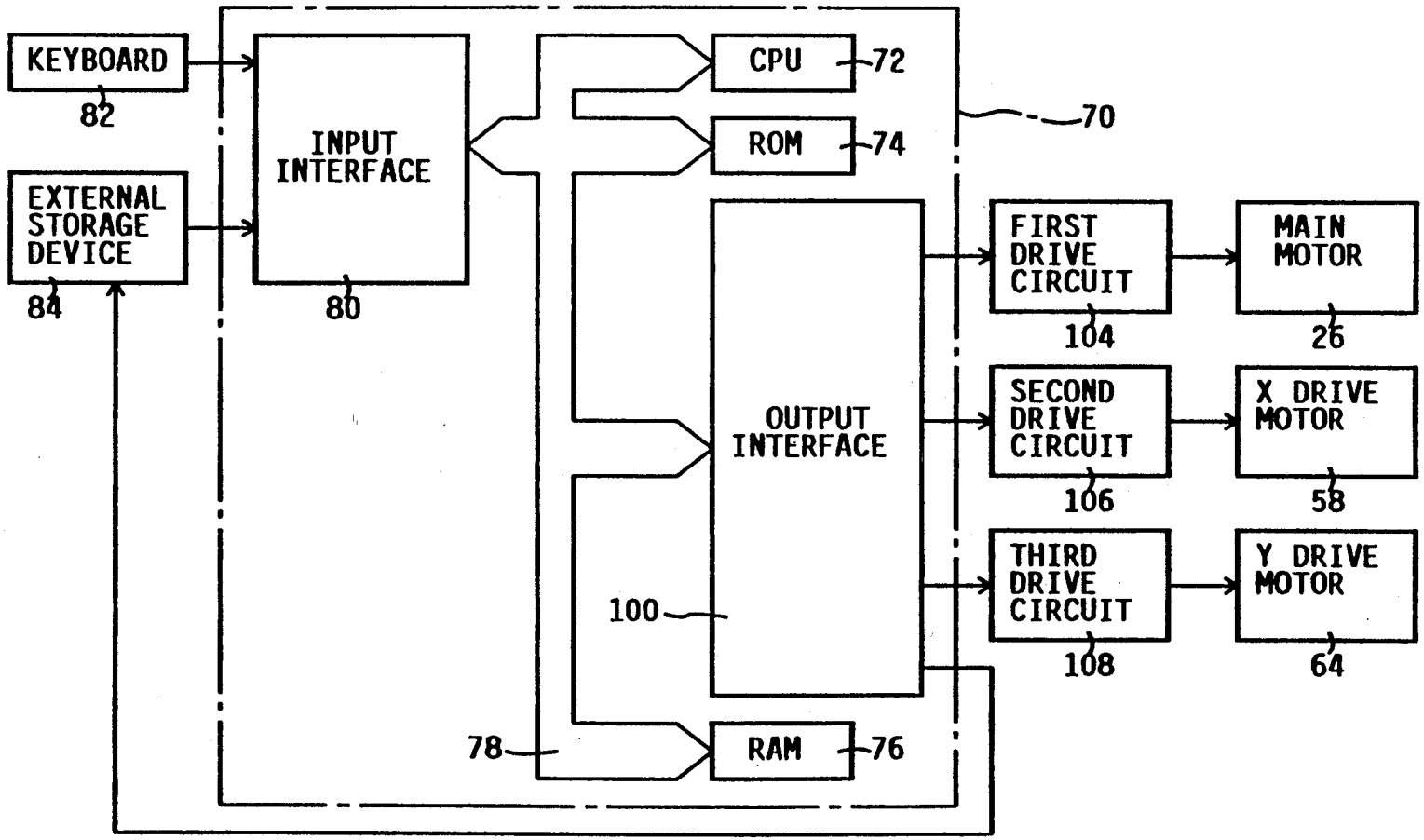
FIG. 2 is a diagrammatical view of a control device for controlling the operation of the system of FIG. 1.
Figure 4A:
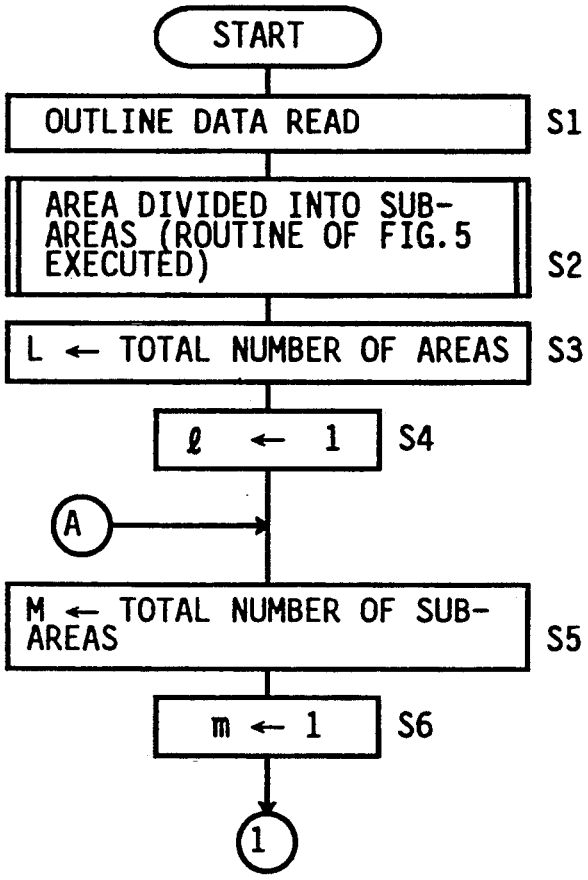
FIGS. 4A, 4B, 4C, 4D and 4E show a flow chart illustrating the stitch position data prepare routine stored in a read only memory (ROM) of the computer.
Figure 4B:
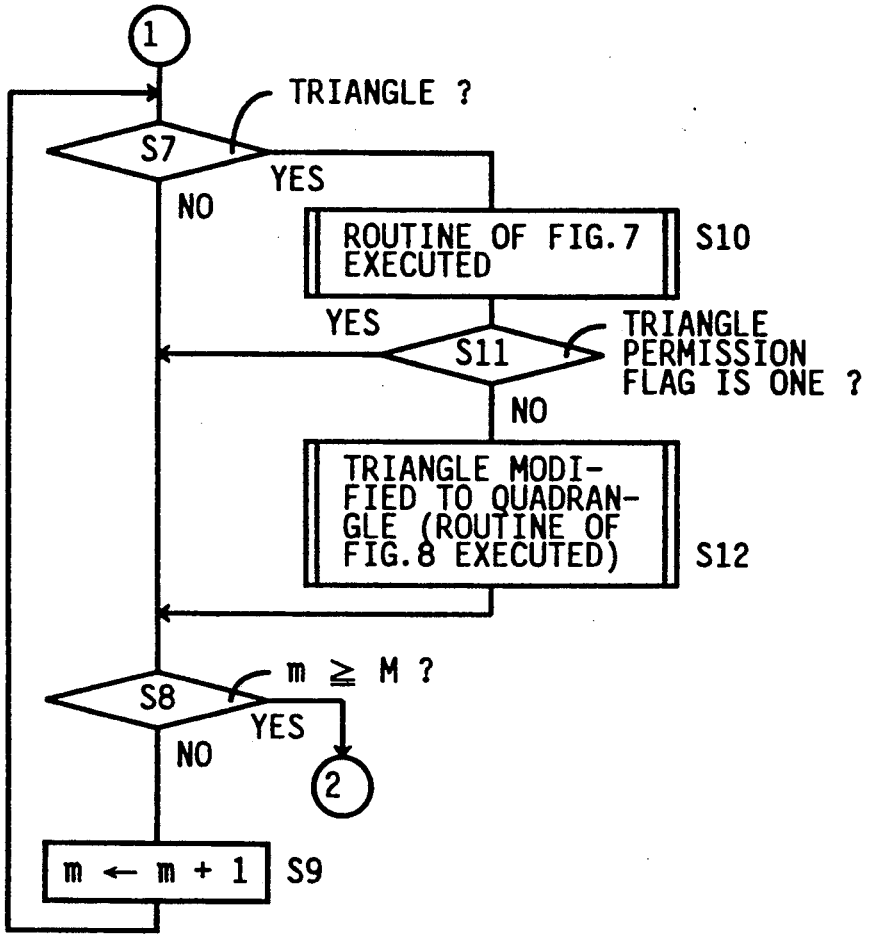
Figure 4C:
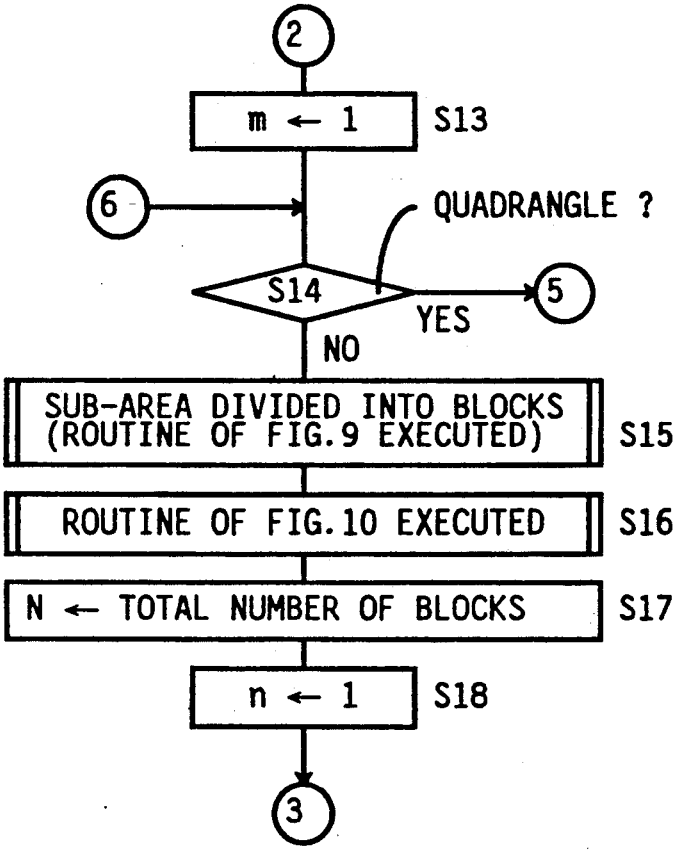
Figure 4D:
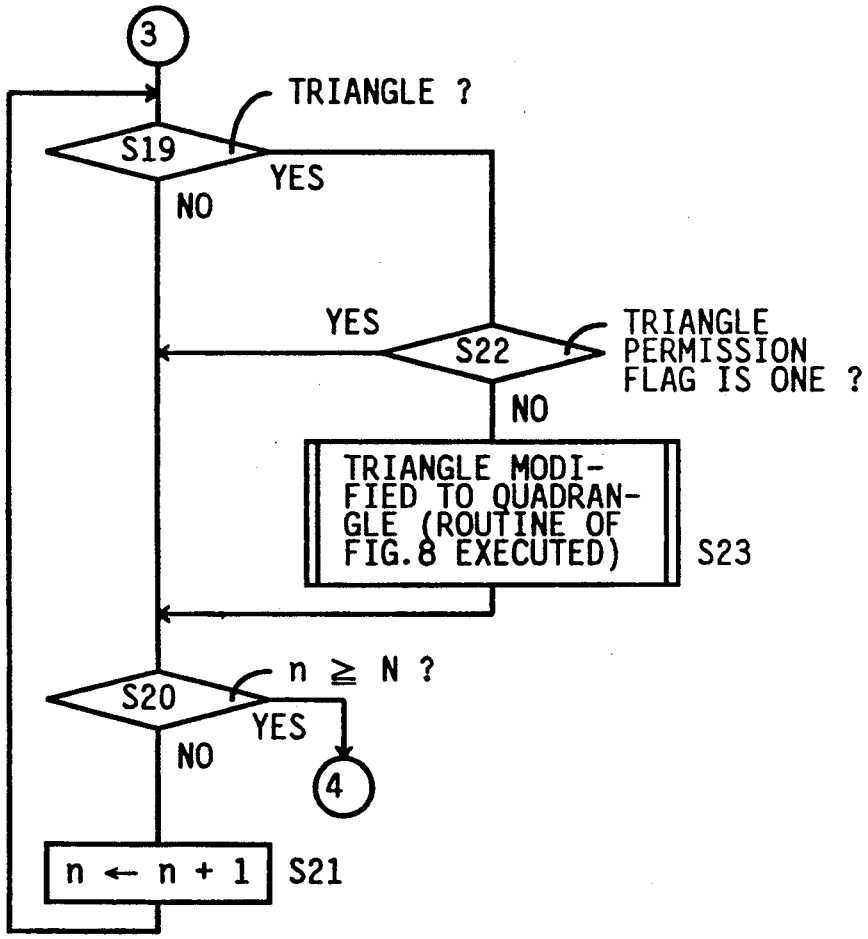
Figure 4E:
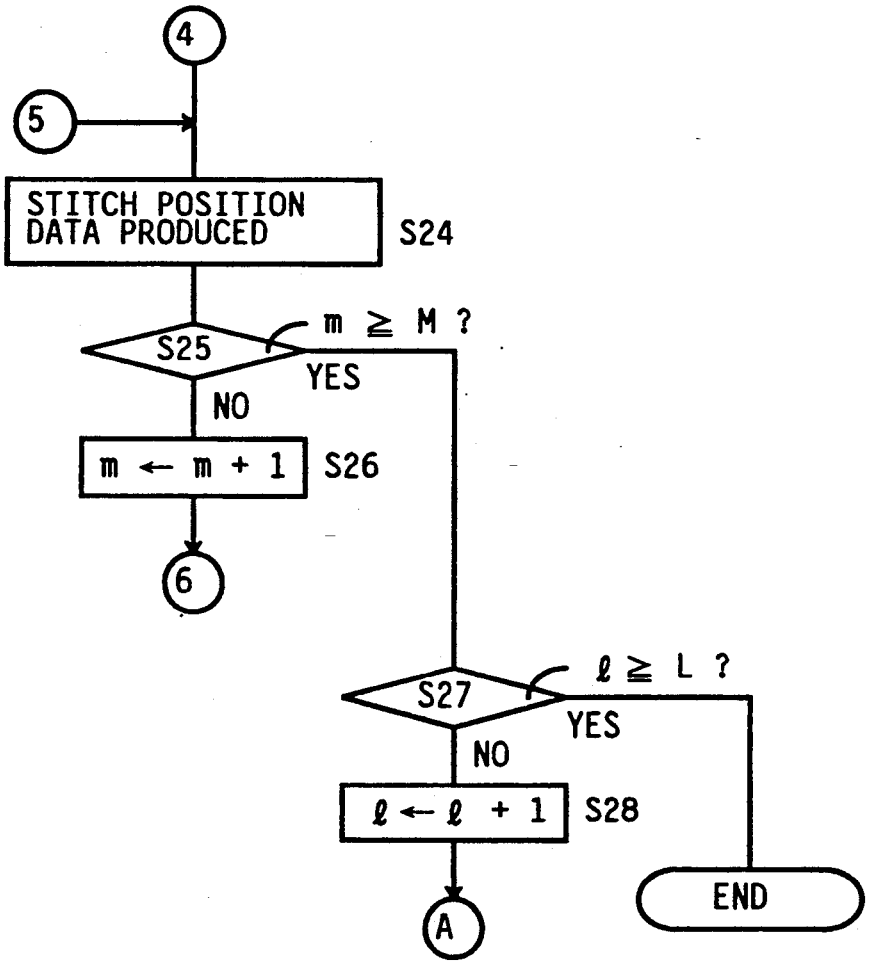

The operation of the present sewing machine system is controlled by a control device 70. As shown in FIG. 2, the control device 70 essentially is constituted by a computer including a central processing unit (CPU) 72, a read only memory (ROM) 74, a random access memory (RAM) 76 and a bus 78. The control device 70 includes an input interface 80 through which a keyboard 82 and an external storage device 84 are connected to the control device 70. The external storage device 82 has a plurality of sets of outline data stored therein each of which is representative of an outline of a predetermined area to be embroidered or filled with stitches. Each outline data includes a plurality of sets of position data each of which is representative of a corresponding one of a plurality of specific positions predetermined on the outline. Specifically, each position data consists of X and Y coordinate values of the corresponding specific position in the X-Y coordinate system provided for the sewing machine 8. The specific positions located on the outline cooperate with each other to define a polygon approximating the corresponding area, and serve as the vertices of the polygon. An area to be embroidered may consist of a polygon. The present sewing machine system embroiders a predetermined area by alternately connecting with thread between a pair of opposed portions (described in detail later) of the outline of the area.

The control device 70 further includes an output interface 100 through which a first, a second and a third drive circuit 104, 106, 108 are connected to the control device 70. The first, second and third drive circuits 104, 106, 108 serve for driving the main motor 26, X drive motor 58 and Y drive motor 64, respectively. The external storage device 84 is connected to the output interface 100.

As shown in FIG. 3, the RAM 76 includes various memory areas **76*a*–76*k* together with a working area. The outline data area 76*a* stores sets of outline data (previously described), and the divided outline data area 76*b* stores sets of divided outline data (described later). The stitch position data area 76*c* stores stitch position data (described later), and the block data area 76*d* stores sets of block data (described later). The before-division stack area 76*e* stores sets of index data designating sets of outline data before being divided (described later), while the after-division stack area 76*f* stores sets of index data designating sets of outline data after being divided (described later). The maximum and minimum positions data area 76*g* stores sets of maximum and minimum positions data (described later), and the division line data area 76*h* stores sets of division line data (described later). The aid line data area 76*i* stores sets of aid line data (described later), and the vertices stack area 76*j* stores sets of index data designating vertices (described later). The special data area 76*k* stores sets of first special data and sets of second special data (described later). The stacks 76*e*, 76*f*, 76*j*** are pushdown stacks.

The ROM 74 stores the stitch position data prepare program represented by the flow charts of FIGS. 4A, 4B, 4C, 4D, 4E, 5, 6A, 6B, 7A, 7B, 8A, 8B, 9A, 9B, 9C, 10A, 10B, 10C and 10D.

There will be described the operation of the present embroidery sewing machine system for preparing the stitch position data.

When the operator operates the keyboard 82 for keying in a stitch position data prepare command after applying electric power to the present system, the control of the CPU 72 begins with Step S1 of FIG. 4 (4A, 4B, 4C, 4D and 4E) to read in one or more sets of outline data from the external storage device 84, and store in the outline data area **76*a* of the RAM 76. Step S1 is followed by Step S2. Step S2 is the routine illustrated in detail in FIG. 5**, for dividing an outline represented by a currently designated set of outline data, namely, a polygon approximating the corresponding area. By the execution of this routine, a polygon is reduced to a plurality of sub-polygons and an area approximated by the polygon is reduced to a plurality of sub-areas.

Figure 11:
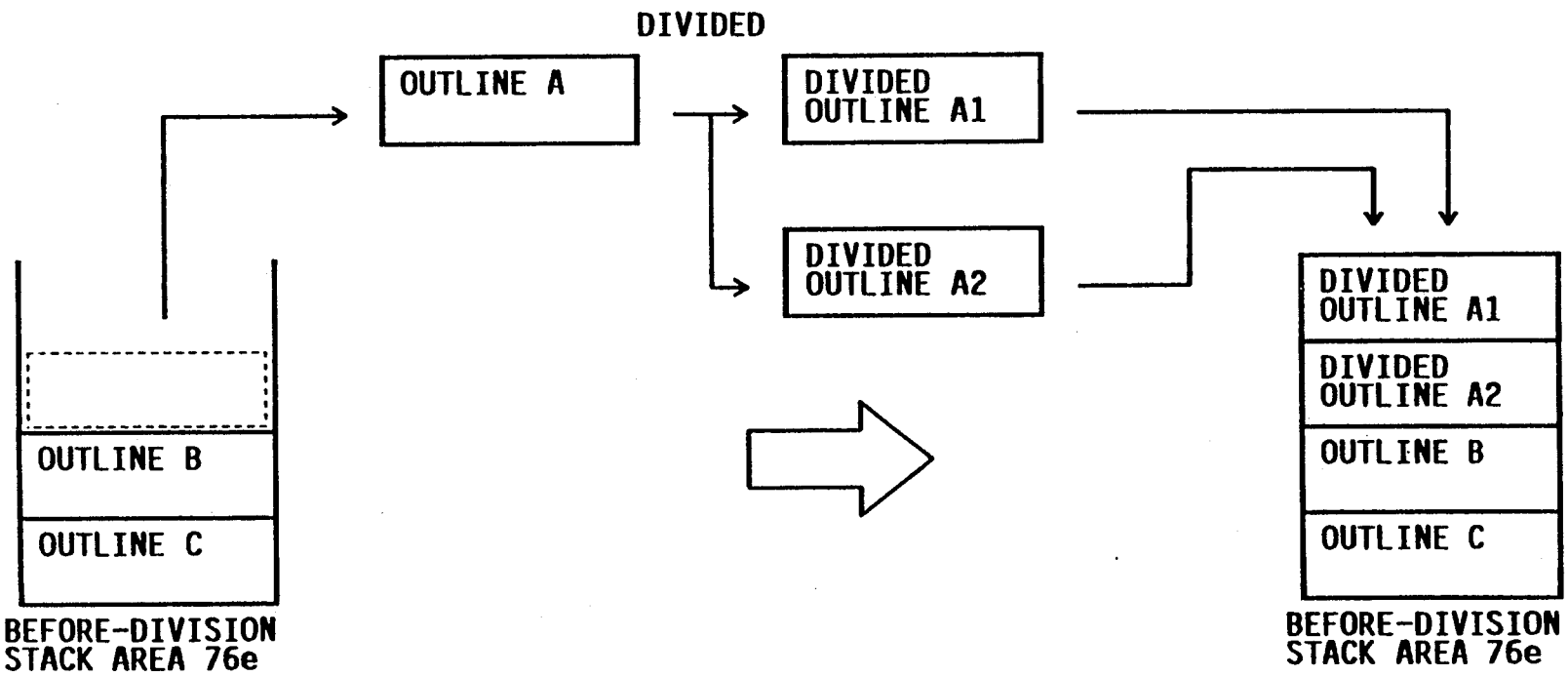
FIG. 11 is an illustrative view of a before-division stack area of the RAM of the computer.

Initially, in Step S111, one or more sets of index data each designating a corresponding one of the one or more sets of outline data stored in the outline data area **76*a*, are stored in the before-division stack area 76*e*. Step S111 is followed by Step S112 to judge whether or not the before-division stack area 76*e* is empty, namely, the before-division stack area 76*e* has no index data stored therein. In this situation, a negative judgment is made in Step S112. Therefore, the control proceeds with Step S113 to read in a last-in index data from the before-division stack area 76*e*, as shown in FIG. 11, and thereby specify an outline data designated by the index data, as a current outline data to be processed in the following steps of the present cycle. Step S113 is followed by Step S114. Step S15 is the routine illustrated in detail in FIG. 6 (6A and 6B**).

Figure 12:
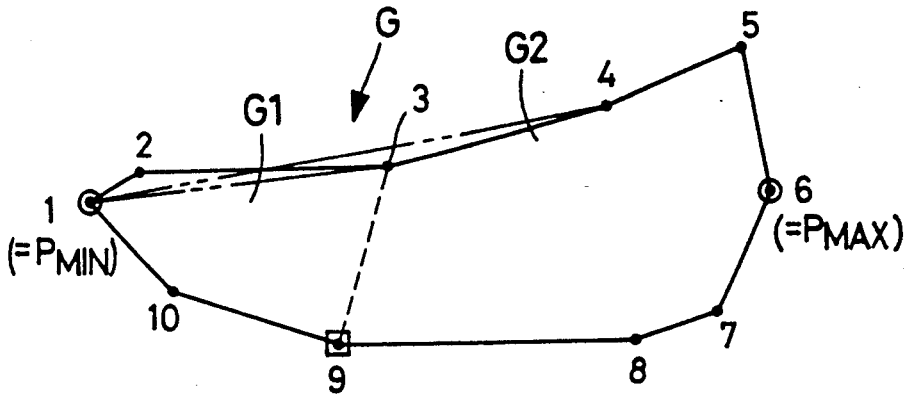
FIG. 12 is a view for explaining the routine of FIGS. 7A and 7B.
Figure 14:
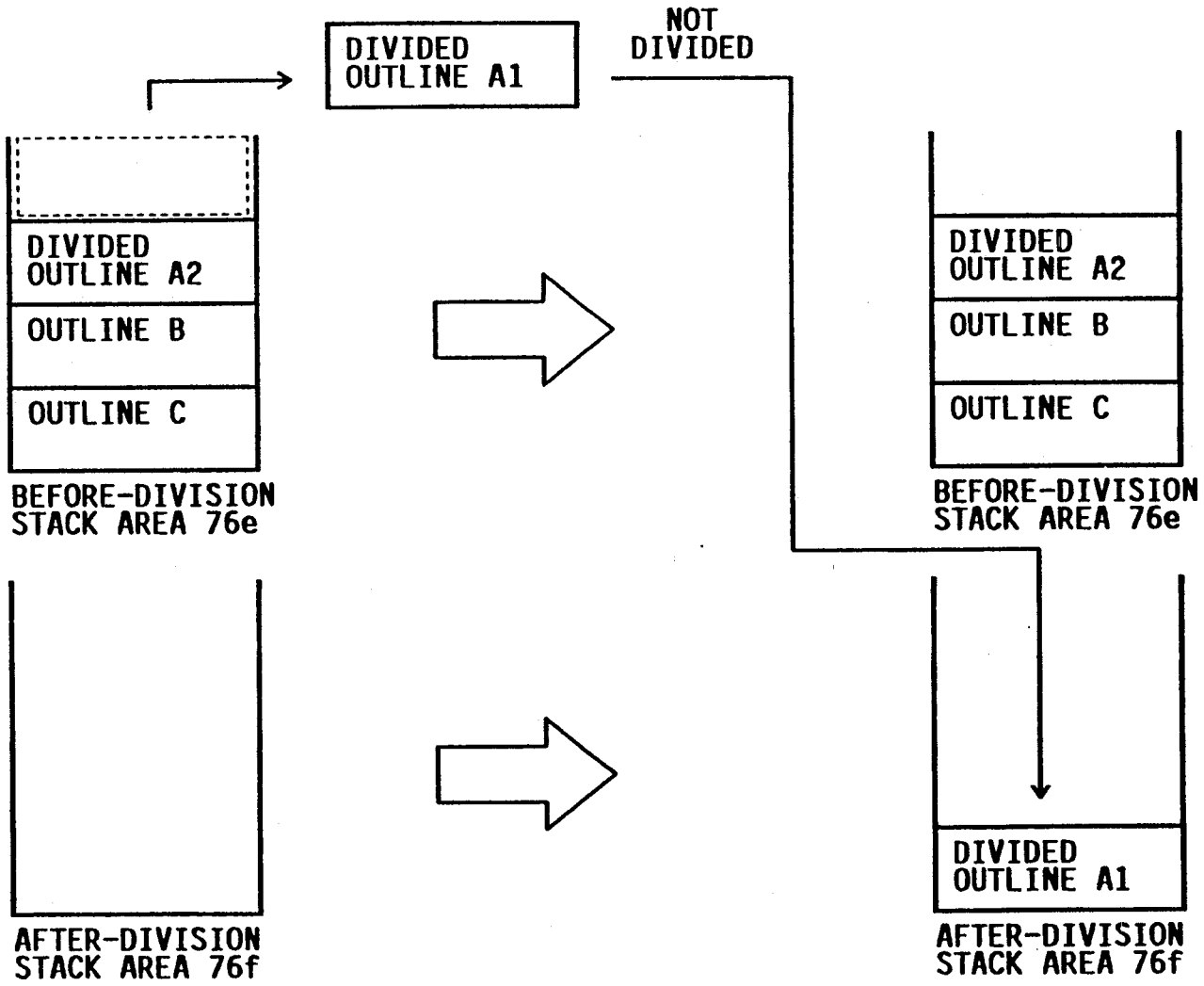
FIG. 14 is an illustrative view of an after-division stack area of the RAM of the computer.

Initially, in Step S251, the current outline data is read from the outline data area 76*a*. The most distant two vertices of a polygon approximating the corresponding area, are determined as a minimum and a maximum position of the current polygon. Specifically, one of the most distant two vertices which one has a smaller X coordinate value is determined as the minimum position, while the other vertex that has a greater X coordinate value is determined as the maximum position. A set of minimum and maximum positions data representative of the minimum and maximum positions determined, is stored in the maximum and minimum positions data area 76*g* in such a manner that the set of data is associated with the current outline data. Regarding an area or polygon G shown in FIG. 12, for example, the most distant two vertices of all vertices numbered one through ten are the vertices numbered one and six. Since the vertex numbered one has a smaller X coordinate value than that of the vertex numbered six, the former is determined as the minimum position and the latter is determined as the maximum position. Hereinafter, the vertex located at the minimum position is referred to as the minimum vertex (indicated at $P_{MIN}$ in the figures), while the vertex located at the maximum position is referred to as the maximum vertex (indicated at $P_{MAX}$ in the figures).

In addition, in Step S251, the direction of a straight line passing the maximum and minimum vertices of the current polygon or area is determined as a longitudinal direction thereof. Further, the current outline data is modified so as to rotate the current polygon or area so that the longitudinal direction thereof becomes parallel to the X axis of the X-Y coordinate system, and it is identified which one of a pair of opposed portions of the polygon or outline which are opposed to each other with respect to the maximum and minimum vertices, is the upper or lower portion thereof. Specifically, with respect to each of the two opposed portions, is determined a vertex having the smallest Y coordinate value of all the vertices on the each portion except for the minimum and maximum vertices, and one of the two opposed portions the minimum Y coordinate value of which is greater than that of the other portion, is determined as an upper portion of the polygon or outline, and the other portion is determined as a lower portion of the same. Regarding the polygon G of FIG. 12, the upper portion of the polygon G consists of five sides connecting between each pair of adjacent ones of the vertices numbered one, two, three, four, five and six, while the lower portion thereof consists of five sides connecting between each pair of adjacent ones of the vertices numbered one, ten, nine, eight, seven and six.

Subsequently, in Step S252, sets of index data designating the vertices of the current polygon or area are stored in the vertices stack 76*j* such that, when the stored sets of index data are retrieved one after another in the last-in first-out manner, first the sets of index data for the vertices of the upper portion of the polygon or outline are retrieved beginning with the index data for a vertex which is by two vertices away from the minimum vertex and ending with the index data for the maximum vertex, and then the sets of index data for the vertices of the lower portion of the same are retrieved beginning with the index data for a vertex which is by two vertices away from the minimum vertex and ending with the index data for the maximum vertex. Step S252 is followed by Step S253 to judge whether or not the vertices stack are 76*j* is empty, namely, has no index data. In this situation, a negative judgment is provided in Step S253, and the control goes to Step S254 to retrieve a last-in set of index data from the vertices stack area 76*j* and specify a vertex designated by the retrieved index data, as a current vertex to be checked in the following steps of the current cycle.

In Step S255, a straight segment connecting the minimum vertex and the currently checked vertex is determined. Subsequently in Step S256 it is judged whether or not the straight segment is contained inside the current polygon. More specifically, in the case where the currently checked vertex is a vertex on the upper portion of the polygon or outline, it is judged whether or not the preceding vertex of the current vertex, located on the minimum-vertex side thereof, is positioned above the straight segment. In the case where the current vertex is a vertex of the lower portion, it is judged whether or not the preceding vertex of the current vertex is positioned below the straight segment. If an affirmative judgment is made in Step S256, the control goes back to Step S253 to check the following vertex of the current vertex on the maximum-vertex side thereof.

On the other hand, if a negative judgment is made in Step S256, the control goes to Step S257 to determine the preceding vertex of the current vertex, as a base vertex, and further determine a cooperative vertex which cooperate with the base vertex to define a division line for dividing the current polygon or area into two sub-polygons or sub-areas. The cooperative vertex is defined as being the nearest vertex to the base vertex of the vertices of the current polygon which cooperate with the base vertex to define straight segments contained in the polygon, except for the base vertex and the two adjacent vertices thereof on the minimum-vertex and maximum-vertex sides thereof. Subsequently, in Step S258, the current polygon or area are divided by the division line into two sub-polygons or sub-areas, and are prepared two sets of divided outline data each representative of an outline of a corresponding one of the two sub-areas. The two sets of divided-outline data are modified so as to be free from the effect of the previous rotation of the before-division or parent polygon or area, and are stored in the divided outline data area 76*b*. In addition, a division flag is set to one. Regarding the polygon G of FIG. 12, a straight segment, 1–3, connecting the minimum vertex numbered one and the vertex numbered three is contained inside the polygon G, but a segment, 1–4, connecting between the vertices numbered one and four is not contained inside. Therefore, the vertex numbered three is determined as a base vertex, and a vertex numbered nine is determined as a cooperative vertex. Consequently, the polygon G is divided by a division line passing the vertices numbered three and nine, into sub-polygons $G_1$ and $G_2$. In addition, in Step S258, a set of first special data representative of a correspondence between the current outline data and the prepared two sets of divided outline data. FIG. 13 shows a table indicating an example of sets of first special data stored in the special data area 76*k*. In the table, the sets of outline data are numbered 1, 2, . . . , L, and the sets of divided outline data are numbered 1, 2, . . . , $M_1$, . . . , $M_L$. Furthermore, in Step S258, a set of division line data representative of the base and cooperative vertices defining the division line, is stored in the division data area 76*h*. Thus, one cycle of the routine of FIG. 6 (6A and 6B) is ended.

If an affirmative judgment is made in Step S253, namely, if it is judged that no segment is located outside the current polygon, the control goes to Step S259 to clear the content of the vertices stack area 76*j*, and prepare sets of index data designating the vertices of the current polygon and store in the vertices stack area 76*j*. In contrast to Step S252, however, the sets of index data are stored such that, when the stored sets of index data are retrieved in the last-in first-out manner, first the sets of index data for the vertices on the upper portion of the current polygon or outline are retrieved beginning with the index data for a vertex which is by two vertices away from the maximum vertex and ending with the index data for the minimum vertex, and then the sets of index data for the vertices of the lower portion of the same are retrieved beginning with the index data for a vertex which is by two vertices away from the maximum vertex and ending with the index data of the minimum vertex.

Step S259 is followed by Step S260 to judge whether or not the vertices stack area 76*j* is empty, namely, has no index data. In this situation, a negative judgment is provided in Step S260, and the control goes to Step S261 to retrieve a last-in set of index data from the vertices stack area 76*j* and specify a vertex designated by the retrieved index data, as a current vertex to be checked in the following steps of the current cycle.

Subsequently, in Step S262, a straight segment connecting the maximum vertex and the currently checked vertex is determined. Step S262 is followed by Step S256 to judge whether or not the straight segment is contained inside the current polygon. More specifically, in the case where the currently checked vertex belongs to the upper portion of the current polygon or outline, it is judged whether or not the preceding vertex of the current vertex, located on the maximum-vertex side thereof, is positioned above the straight segment. In the case where the current vertex is a vertex on the lower portion of the same, it is judged whether or not the preceding vertex of the current vertex is positioned below the straight segment. If an affirmative judgment is made in Step S263, the control goes back to Step S260 to check the following vertex.

On the other hand, if a negative judgment is made in Step S260, the control goes to Step S264 to determine the preceding vertex of the current vertex, as a base vertex, and further determine a cooperative vertex, as in Step S257. Subsequently, in Step S258, the current polygon or area is divided by a division line passing the base and cooperative vertices, into two sub-polygons or two sub-areas, and two sets of divided outline data are prepared each representative of an outline of a corresponding one of the two sub-areas. The two sets of divided outline data are modified so as to be free from the effect of the previous rotation of the current polygon or area, and are stored in the divided outline data area 76*b*.

Figure 5:
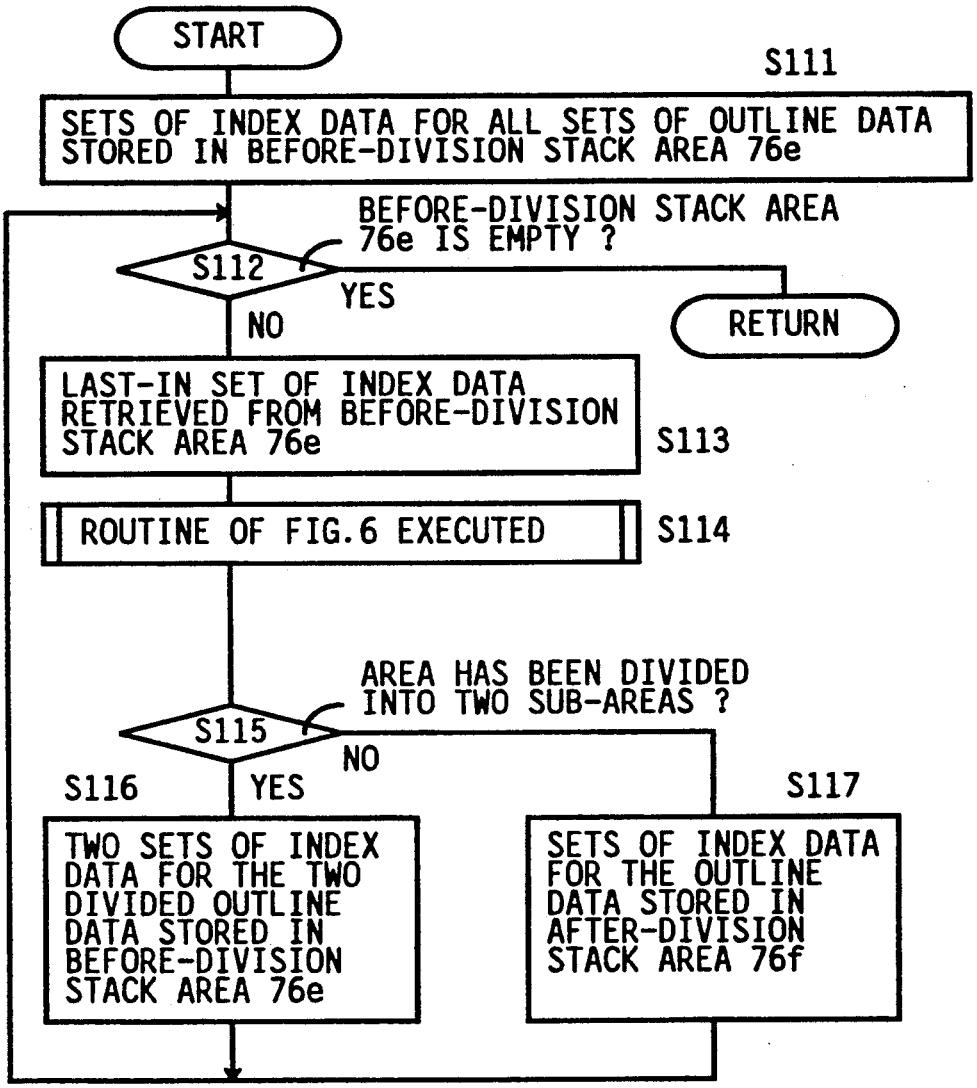
FIGS. 5, 6A, 6B, 7A, 7B, 8A, 8B, 9A, 9B, 9C, 10A, 10B, 10C and 10D show flow charts illustrating the routines stored in the ROM which routines are associated with the stitch position data prepare routine.
Figure 6A:
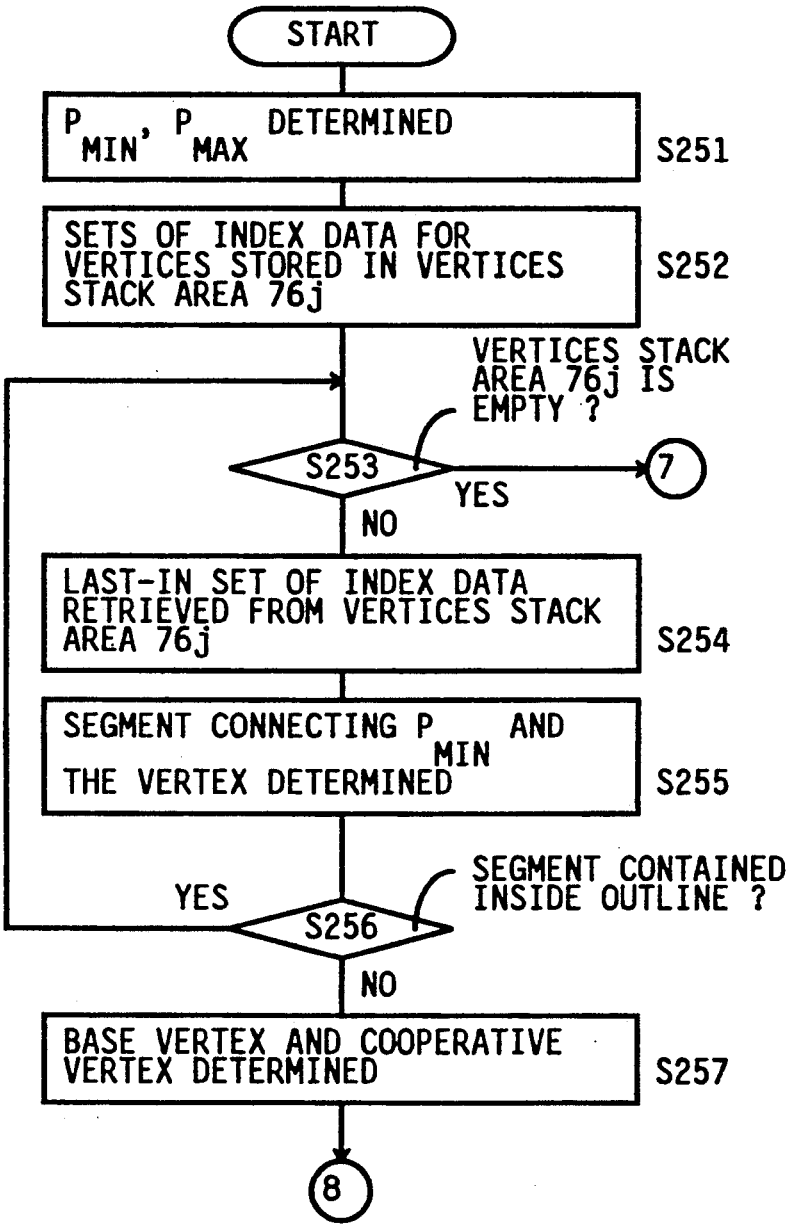
Figure 6B:
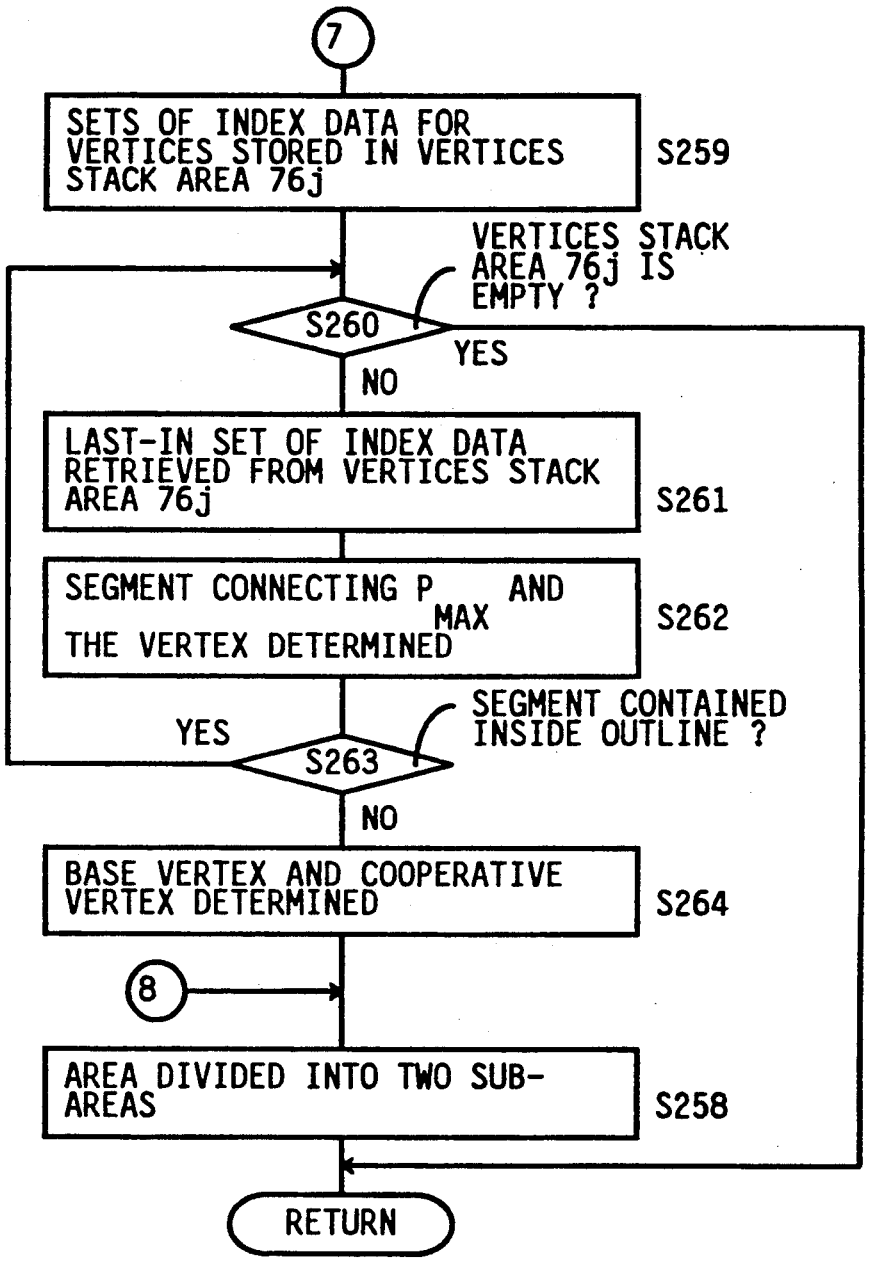
Figure 7A:
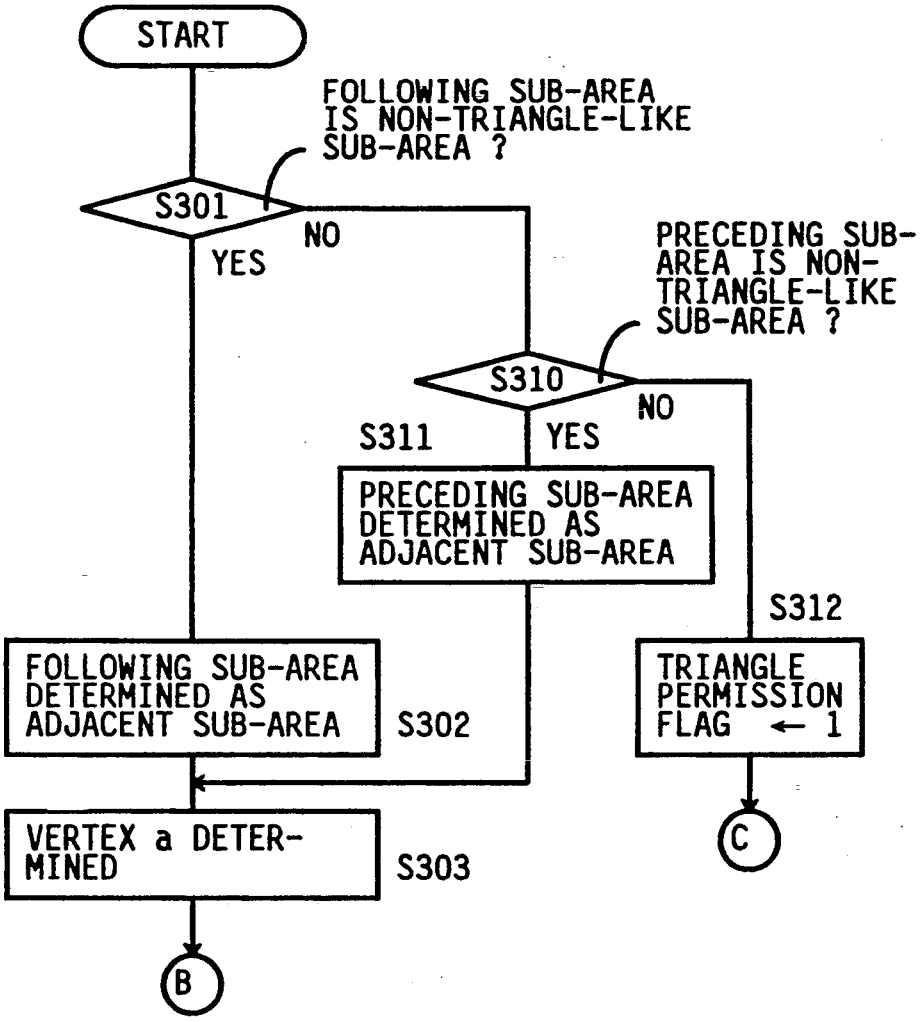
Figure 7B:
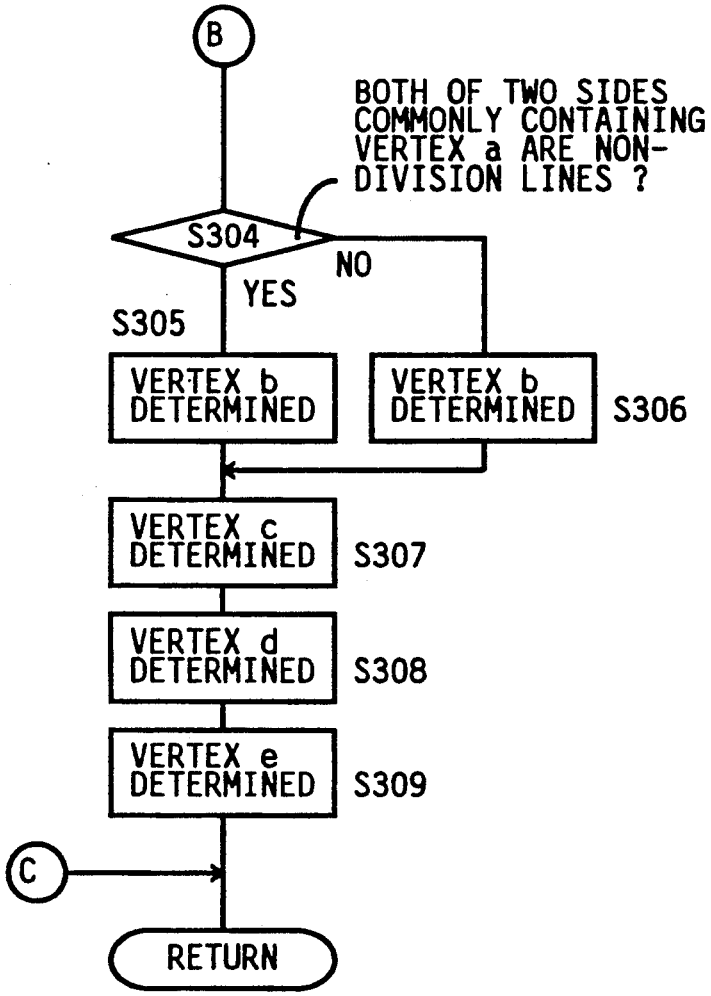
Figure 8A:
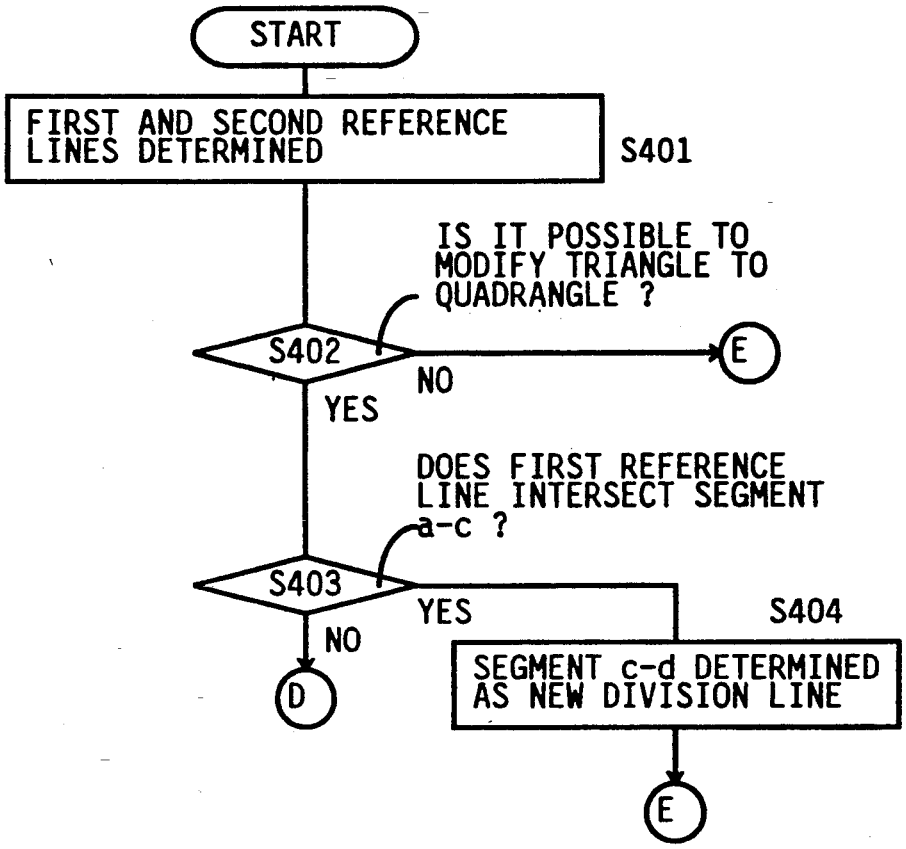
Figure 8B:
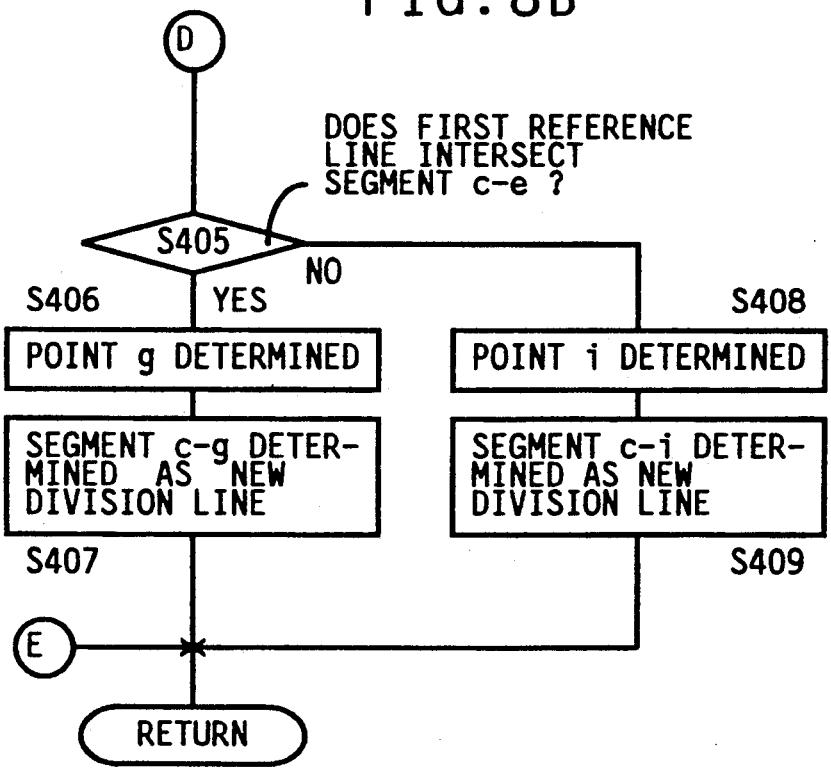
Figure 9A:
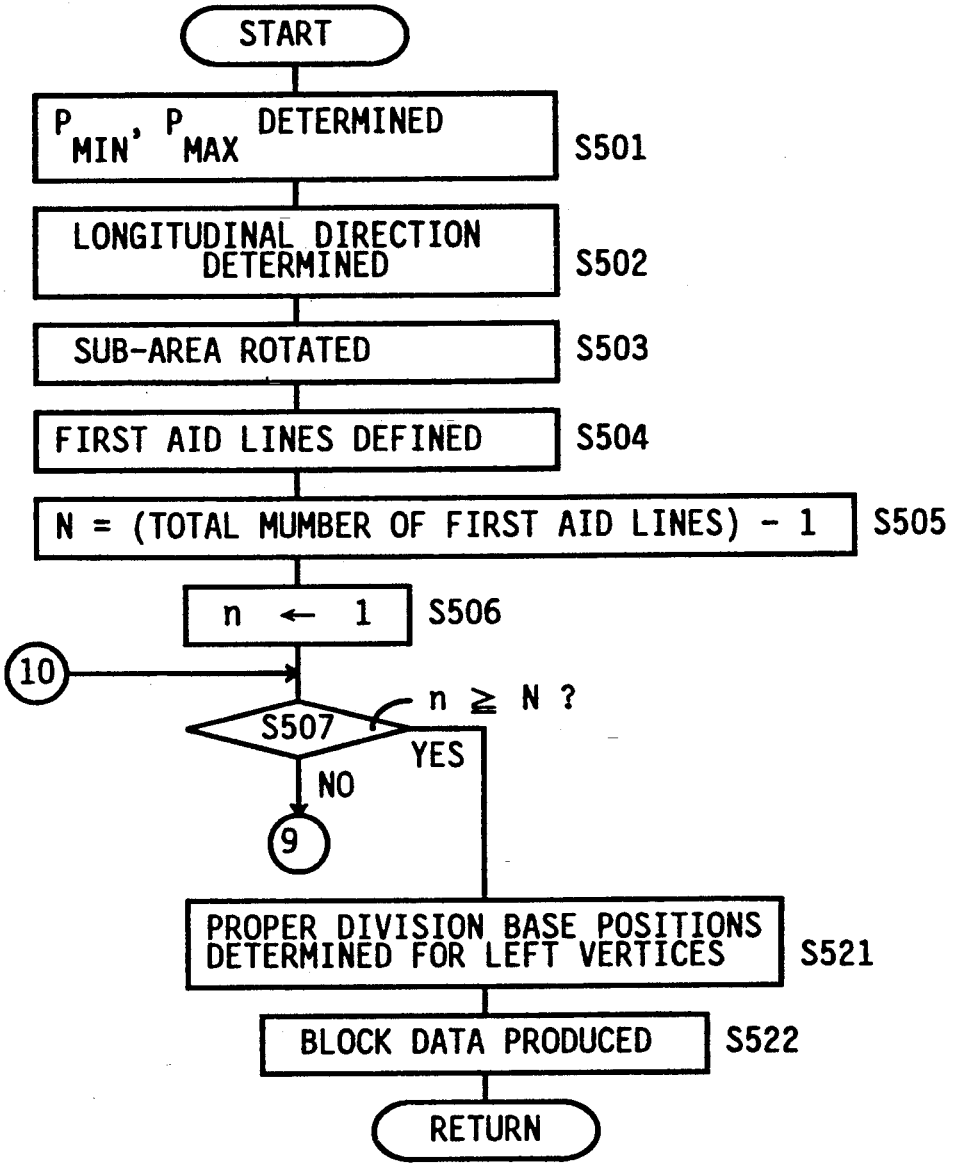
Figure 9B:
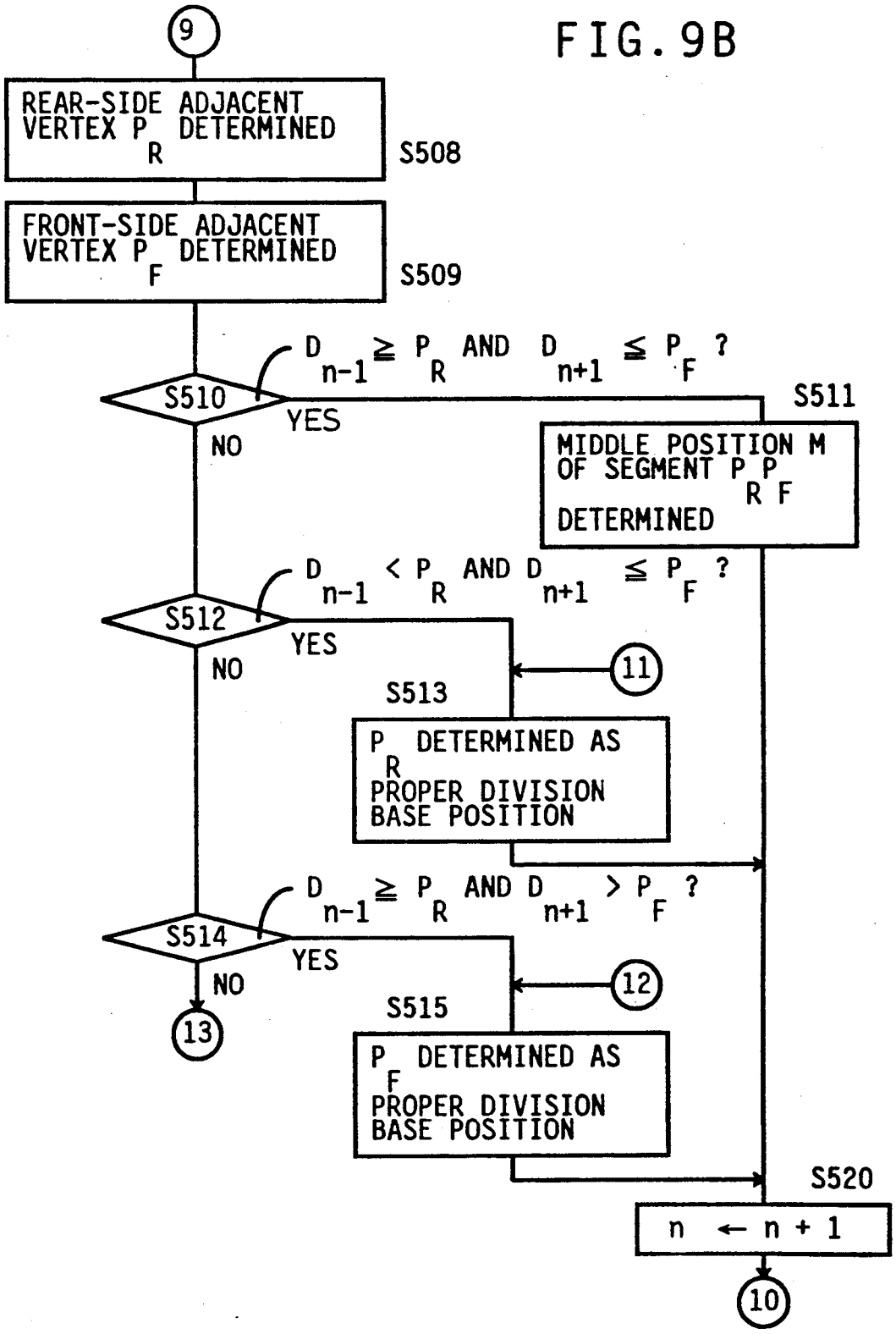
Figure 9C:
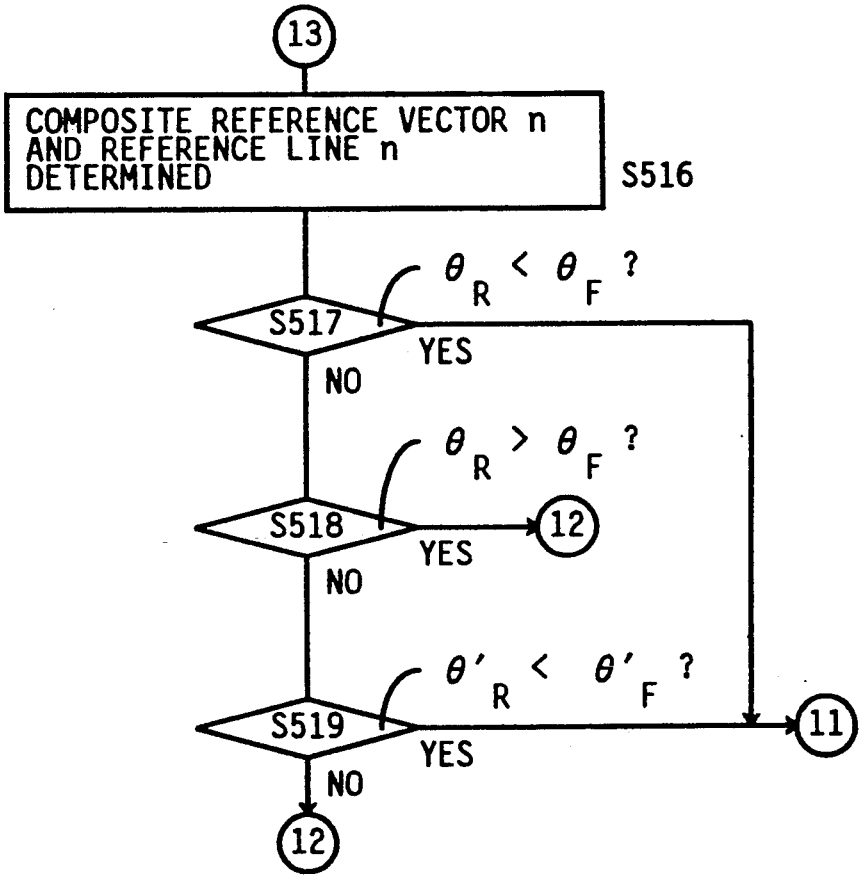
Figure 10A:
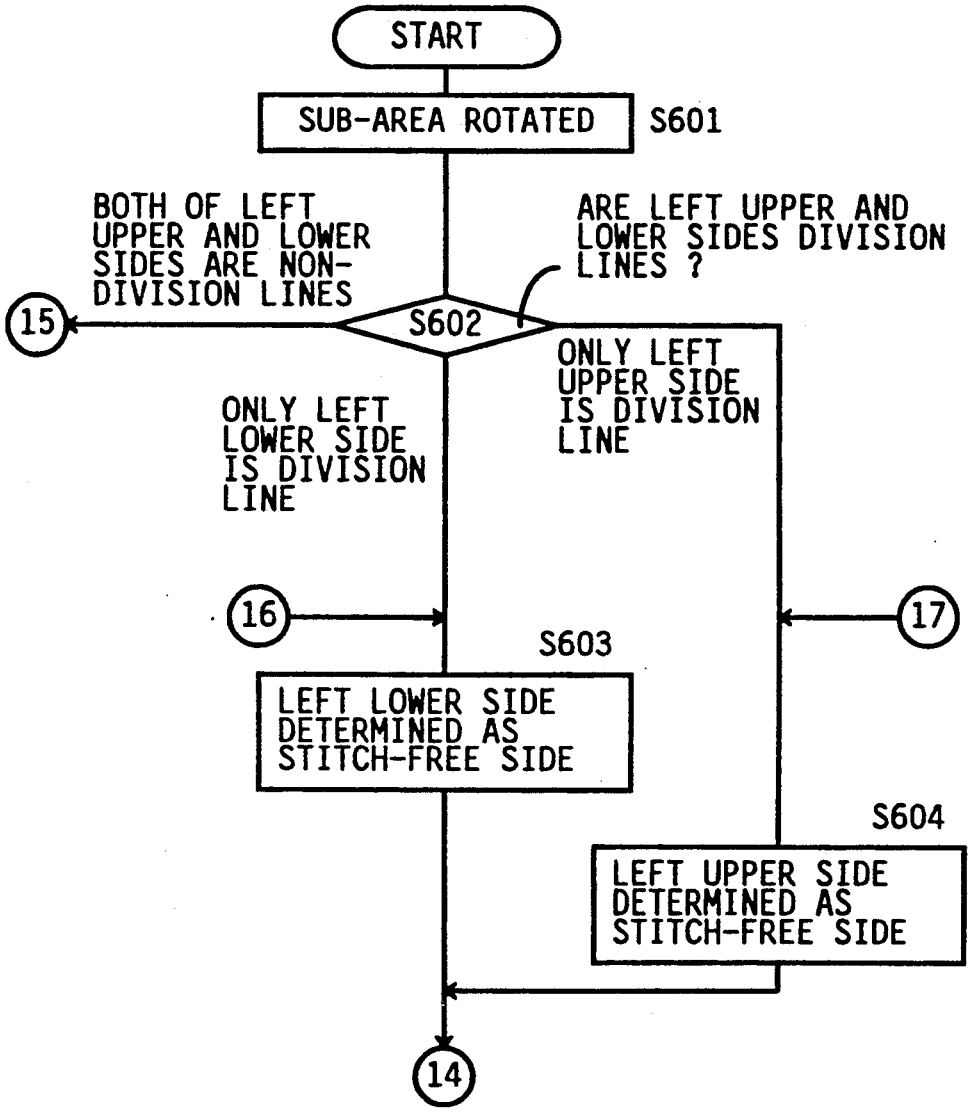
Figure 10B:
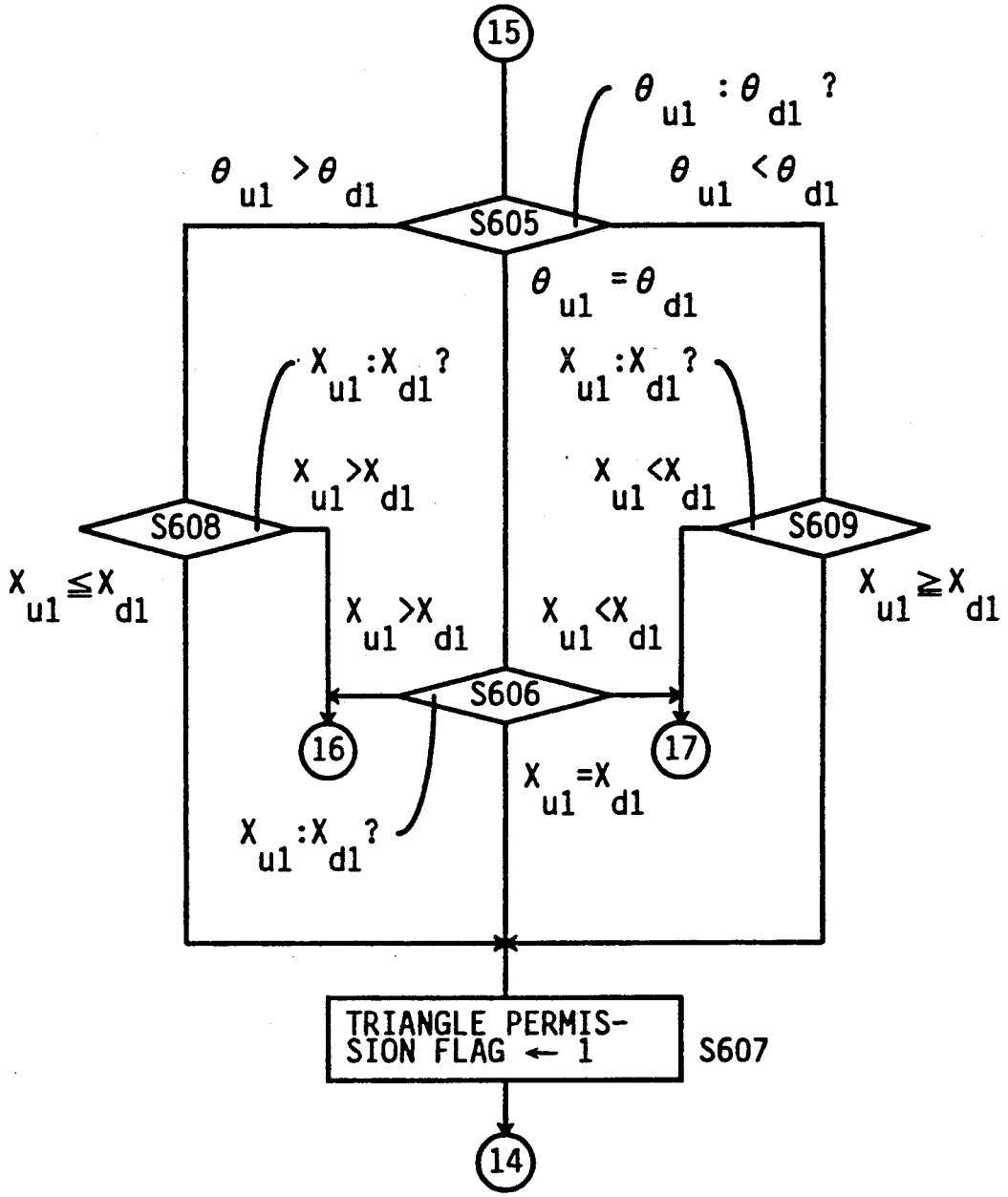
Figure 10C:
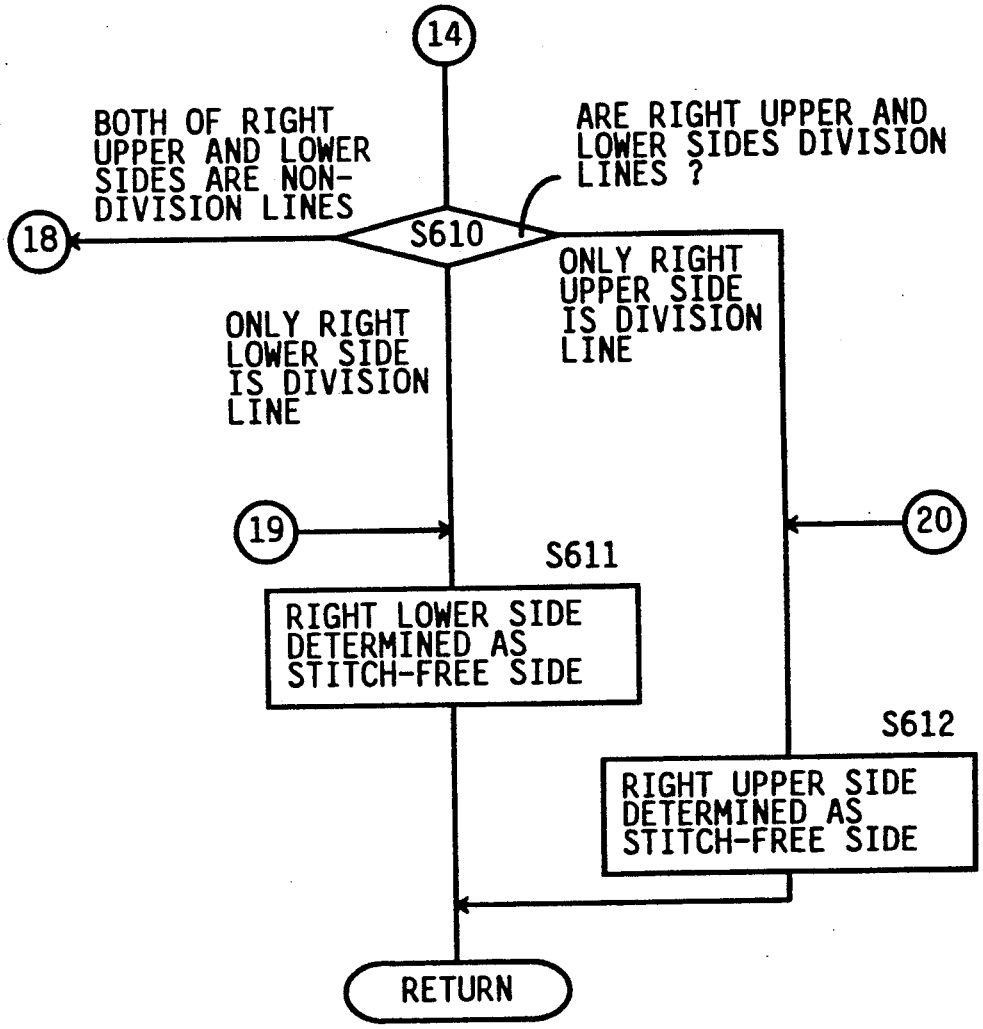
Figure 10D:
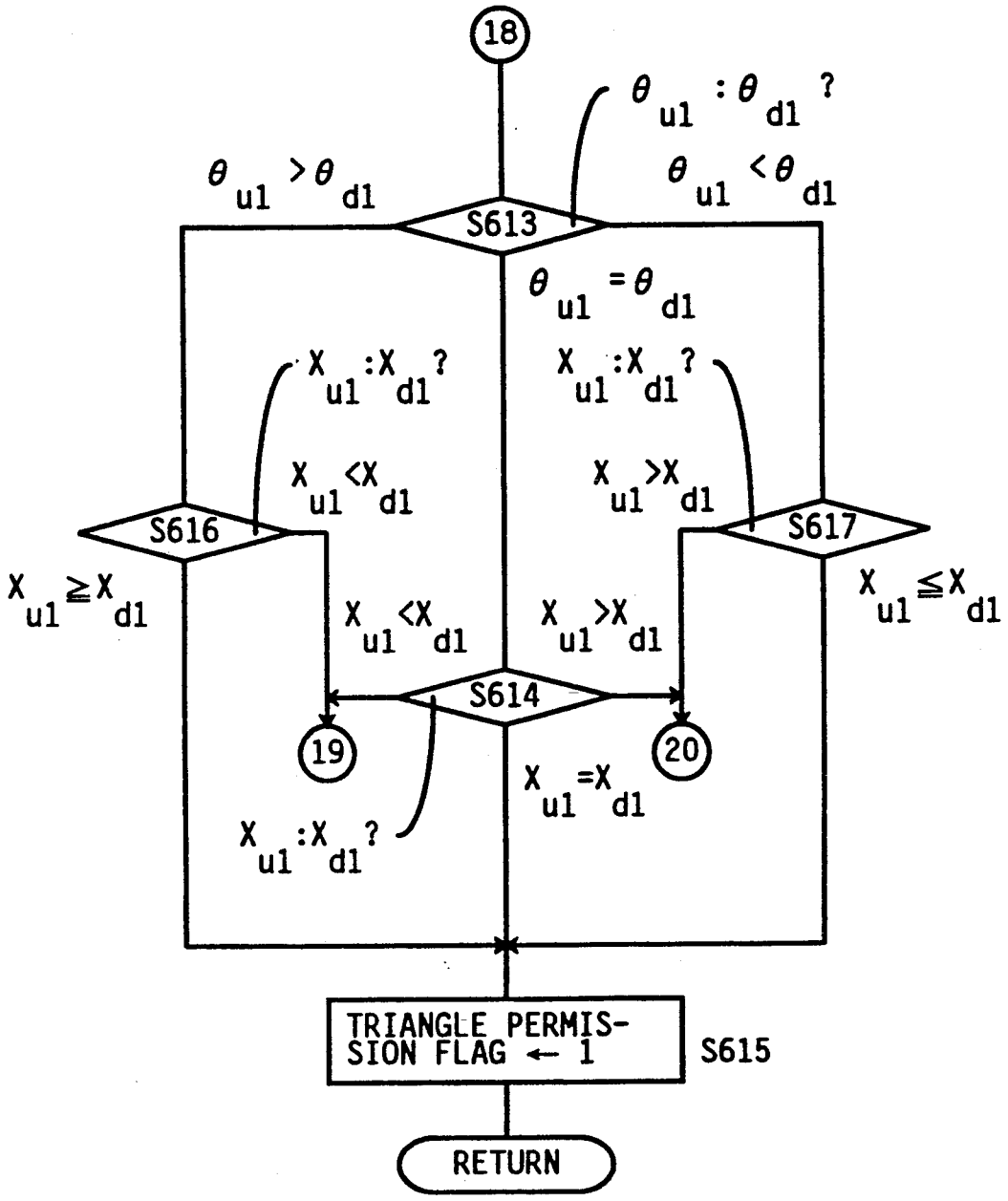

If an affirmative judgment is made in both Steps S253 and S260, namely, if no segment is located outside the current polygon, the current polygon or area is not divided, and the control returns to Step S115 of FIG. 5. Thus, one cycle of the routine of FIG. 6 is ended.

In Step S115 of FIG. 5 it is judged whether or not the current polygon or area has been divided in Step S114. If Step S258 of FIG. 6 in which the division of the polygon or area is executed, the division flag is set to one as previously described. Therefore, the judgment in Step S115 is carried out by judging whether or not the first flag is in the state of one. If an affirmative judgment is made in Step S115, the control goes to Step S116 to store two sets of index data each designating a corresponding one of the two sets of divided outline data stored in the divided outline data area 76*b*, in the before-division stack area 76*e*, as shown in FIG. 11. On the other hand, if a negative judgment is made in Step S115, namely, if it is judged that the current polygon or area has not been divided by the execution of the routine of FIG. 6, the control goes to Step S117 to store the index data designating the current outline data in the after-division stack area 76*f*. Steps S112 through S117 are repeated until the before-division stack area 76*e* becomes empty and an affirmative judgment is provided in Step S112.

A sub-polygon or sub-area resulting from the first-time execution of the routine of FIG. 6 may further be divided by the subsequent one or more executions of the same routine. Therefore, the polygon processed by the routine of FIG. 6 may be a sub-polygon resulting from the execution of the routine.

Subsequently, in Step S3 of FIG. 4, the number, L, of the sets of outline data stored in the outline data area 76*a*, is stored in an appropriate memory area of the RAM 76. Step S3 is followed by Step S4 to set the content or count, l, of a first counter to one. The count l is indicative of the number assigned to a set of outline data to be processed in the following steps of the current cycle. Therefore, the set of outline data numbered one is specified as the current outline data. Step S4 is followed by Step S5 to store the number, M, of the sets of divided outline data belonging to the current outline data numbered in an appropriate memory area of the RAM 76. Step S5 is followed by Step S6 to set the count, m, of a second counter to one. The count m is indicative of the number assigned to a set of divided outline data to be processed in the following steps of the current cycle. Therefore, the set of divided outline data numbered one is specified as the current divided outline data.

Subsequently, in Step S7, the current divided outline data numbered m of the current outline data numbered l is read from the divided outline data area 76*b*, and it is judged whether or not the sub-area represented by the current divided outline data numbered m is a triangle-like sub-area, namely, whether or not the sub-polygon corresponding to the sub-area which sub-polygon results from the division of the parent polygon effected in the routine of FIG. 6, is a triangle. If a negative judgment is provided in Step S7, the control goes to Step S8 to judge whether or not the count m is not less than the number M. If a negative judgment is made in Step S8, the control goes to Step S9 to add one to the count m and then returns to Step S7. On the other hand, if an affirmative judgment is made in Step S7, namely, if it is judged that the current sub-area is a triangle-like sub-area or that the current sub-polygon corresponding to the current sub-area is a triangle, the control goes to Step S10. Step S10 is the routine illustrated in detail in FIG. 7.

Initially, in Step S301, it is judged whether or not the following sub-area of the triangle-like sub-area, located on the maximum-vertex side thereof in the parent area represented by the current outline data l, corresponds to a sub-polygon resulting from the above indicated division which sub-polygon is a polygon different from a triangle, namely, a polygon having four or more sides. Provided that a triangle $A_1$ or $A_3$ of a polygon shown in FIG. 36, for example, is identified as the triangle-like sub-area in Step S7, the following sub-area of the triangle $A_1$ or $A_3$ is a polygon $A_2$ or $A_4$, which is not a triangle, but a quadrangle and a pentagon, respectively, and an affirmative judgment is made in Step S301. In this case, the control goes to Step S302 to determine the following sub-area of the current sub-area, as an adjacent sub-area utilized for modifying the triangle-like sub-area to a quadrangle-like sub-area.

Subsequently, in Step S303, one of the three vertices on the triangle-like sub-area, namely, three vertices of the triangle, which one vertex is different from the other two vertices defining a side common to the triangle and the sub-polygon corresponding to the adjacent sub-area, is determined as a vertex a. The common side is a portion of a division line separating the triangle and the adjacent sub-polygon from each other, namely, separating the current, triangle-like sub-area and the adjacent, non-triangle-like sub-area from each other. Step S303 is followed by Step S304 to judge whether or not both of the two of the three sides of the triangle which two sides commonly contain the vertex at the connecting point therebetween, are not a portion of a division lone for dividing the parent polygon or area. Regarding the triangle $A_1$ as a sub-polygon of the parent polygon of FIG. 36, both of the two sides, 1-2 and 16-1, which commonly contain the vertex numbered one as the vertex a, are not a portion of a division line, and therefore an affirmative judgment is made in Step S304. On the other hand, regarding the triangle $A_3$ of FIG. 36, one side, 15-3, of the two sides, 15-3 and 14-15, which commonly contain the vertex numbered fifteen as the vertex a, is a portion of a division line, and a negative judgment is made in Step S304.

In the case where an affirmative judgment is provided in Step S304, the control goes to Step S305 to select one of the two sides commonly containing the vertex a which one side cooperates with the longitudinal direction of the parent polygon or area to contain an angle more close to a right angle than the other side, and determine the selected one side as a side on which stitch positions must not be provided (hereinafter, referred to as the stitch-free side). Further, in Step S304, one of the two vertices other than the vertex a which one vertex cooperates with the vertex a to define the stitch-free side, is determined as a vertex b. Regarding the triangle $A_1$ as a sub-polygon of the parent polygon of FIG. 36, a side, 1-2, is determined as a stitch-free side. On the other hand, if a negative judgment is made in Step S304, the control goes to Step S306 to select one of the two sides commonly containing the vertex a which one side is a portion of a division line, and determine the selected one side as a stitch-free side. In addition, in Step S306, one of the two vertices other than the vertex a which one vertex cooperates with the vertex a to define the stitch-free side, is determined as a vertex b. Regarding the triangle $A_3$ of FIG. 36, a side, 15-3, is determined as a stitch-free side.

In either of the above indicated two cases, subsequently in Step S307, one of the three vertices of the triangle other than the vertices a and b, is determined as a vertex c. Step S307 is followed by Step S308 to select one of the vertices of the adjacent sub-polygon which one vertex is the following vertex of the vertex b located on the maximum-vertex side thereof, and determine the selected vertex as a vertex d. Step S308 is followed by Step S309 to select one of the vertices of the adjacent sub-polygon which one vertex is the following vertex of the vertex c located on the maximum-vertex side thereof, and determine the selected vertex as a vertex e. A set of reference data representative of the vertices a, b, c, d, e is stored in an appropriate memory area of the RAM 76 such that the set of reference data is associated with the triangle or current triangle-like sub-area. Thus, one cycle of the routine of FIG. 7 is ended.

Figure 36:
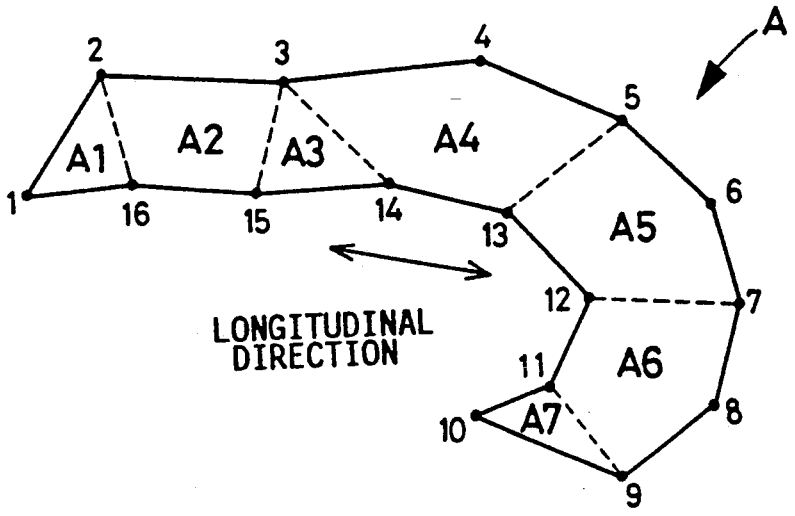
FIGS. 36–40 and 42 are views of areas provided as examples for explaining the background of the present invention.

Regarding the triangle $A_7$ as a sub-polygon of the polygon of FIG. 36, a negative judgment is provided in Step S301 because the current sub-polygon or triangle $A_7$ has no following sub-area or sub-polygon. Then, the control goes to Step S310 to judge whether or not the preceding sub-area of the current triangle-like sub-area, located on the minimum-vertex side thereof in the parent area, corresponds to a sub-polygon resulting from the previously indicated division which sub-polygon is a polygon other than a triangle. If an affirmative judgment is made in Step S310, the control goes to Step S311 to determine the preceding sub-area as an adjacent sub-area utilized for modifying the current, triangle-like sub-area to a quadrangle-like sub-area. Step S311 is followed by Step S303 and the following steps, for determining the vertices a, b, c, d, e for the triangle or triangle-like sub-area. Regarding the triangle $A_7$ of FIG. 36, a vertex numbered ten is determined as a vertex a, a vertex numbered nine as a vertex b, a vertex numbered eleven as a vertex c, a vertex numbered eight as a vertex d, and a vertex numbered twelve as a vertex e.

In the case where the current, triangle sub-area has no preceding non-triangle-like sub-area, a negative judgment is made in Step S310, and the control goes to Step S312 to set a triangle permission flag to one. When the triangle permission flag is in the state of one, it indicates that the current, triangle-like sub-area is permitted to be used as a profile block based on which stitch position data is prepared. Thus, one cycle of the routine of FIG. 7 is ended.

Subsequently, in Step S11 of FIG. 4, it is judged whether or not the current, triangle-like sub-area is permitted to be used as a block based on which a set of stitch position data is prepared (described later), namely, whether or not the triangle permission flag is in the state of one. If an affirmative judgment is made in Step S11, the control goes to Step S8. On the other hand, if a negative judgment is made in Step S11, the control goes to Step S12. Step S12 is the routine illustrated in detail in FIG. 8, in which the triangle-like sub-area is modified to a quadrangle-like sub-area.

Figure 15:
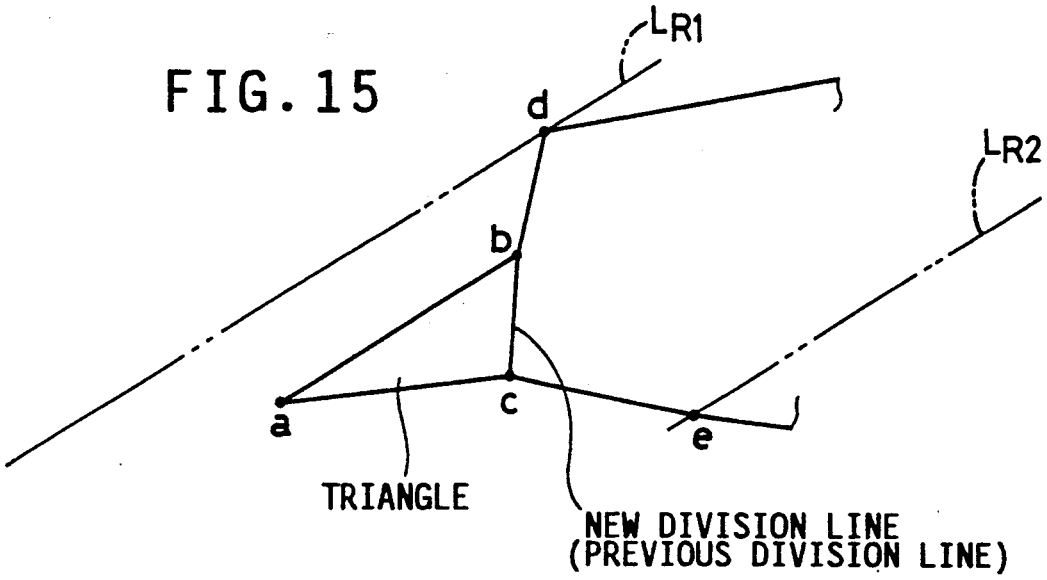
FIGS. 15 through 18 are views for explaining the routine of FIGS. 8A and 8C.

Initially, in Step S401, are determined a first reference line which passes the vertex d of the adjacent sub-area and extends parallel to the side, a-b, of the triangle corresponding to the current triangle-like sub-area, and a second reference line which passes the vertex e of the adjacent sub-area and extends parallel to the side a-b of the same triangle. Step S401 is followed by Step S402 to judge whether or it is possible to modify the triangle to a quadrangle. Specifically, an affirmative judgment is made, in either one of the following three cases; the first case where the first reference line intersects the side, a-c, the second case where the first reference line intersects the side, c-e, and the third case where the second reference line intersects the side, b-d. Regarding an example shown in FIG. 15, a first reference line indicated at $L_{R1}$ in the figure does not intersect neither a side, a-c, nor a side, c-e, and, a second reference line, $L_{R2}$, does not intersect a side, b-d. In this case, therefore, a negative judgment is made in Step S402, and the triangle is not modified to a quadrangle. Thus, one cycle of the routine of FIG. 8 is ended.

Figure 16:
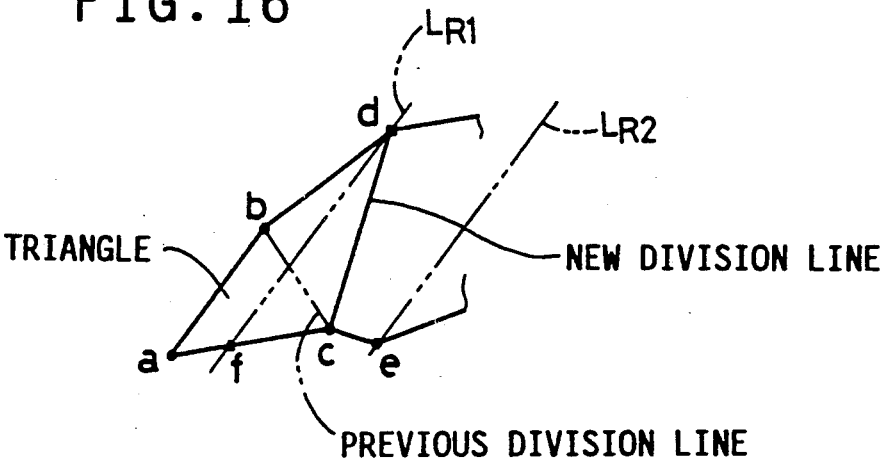
Figure 17:
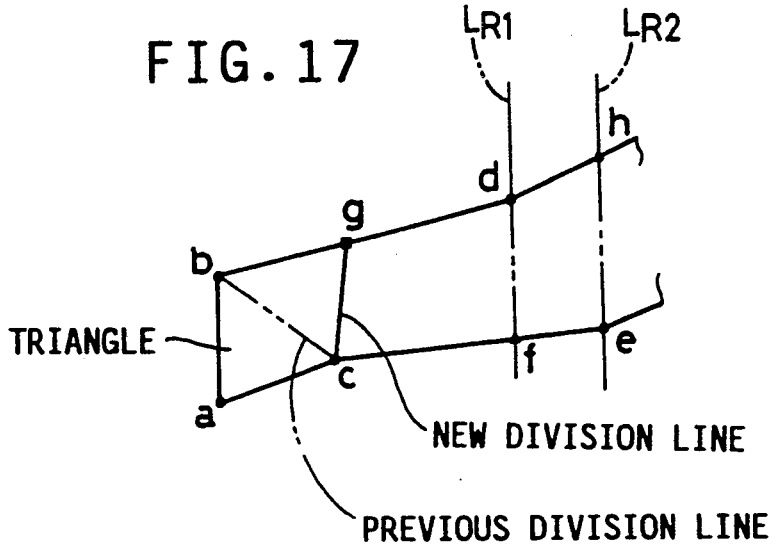
Figure 18:
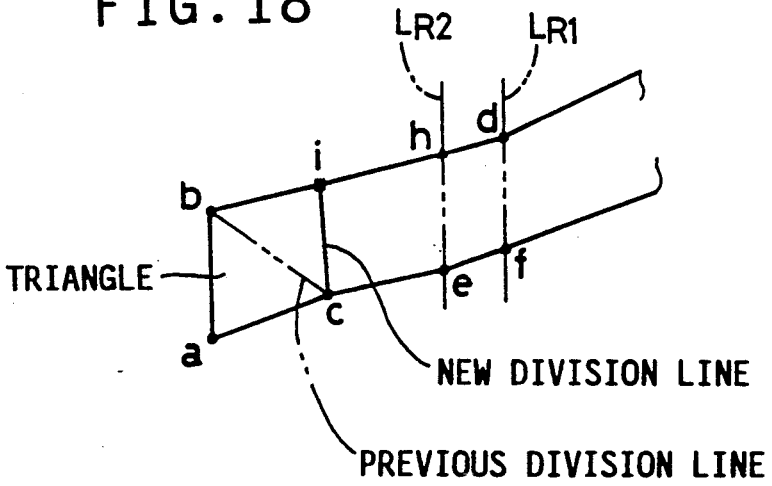
Figure 19:
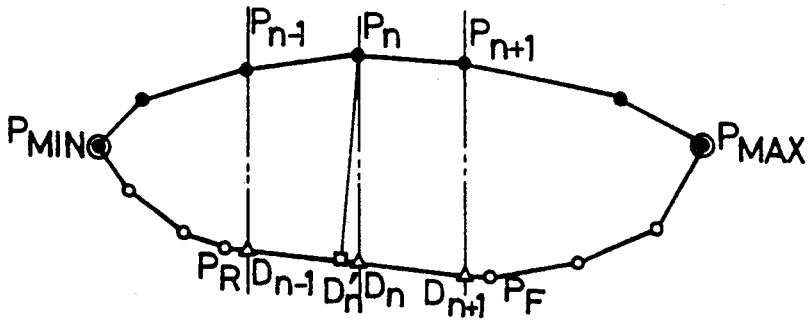
Figure 20:
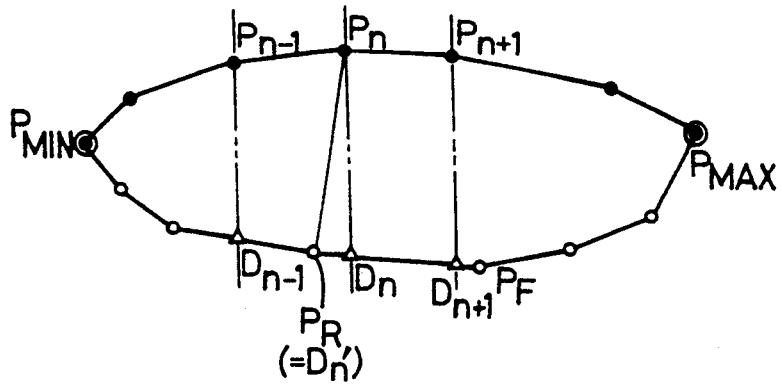
Figure 21:
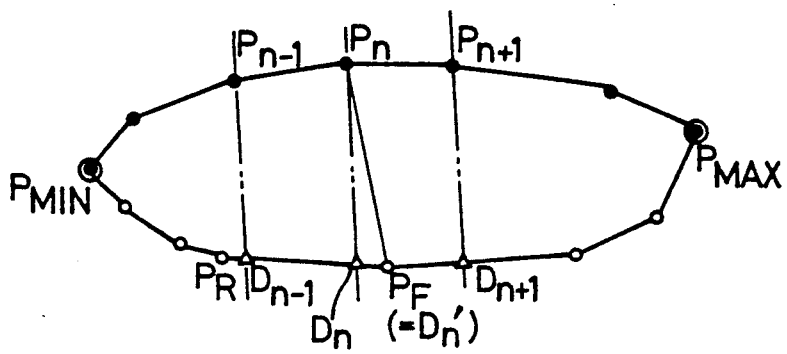

On the other hand, regarding an example of FIG. 16 a first reference line $L_{R1}$ intersects a side a-c, regarding an example of FIG. 17 a first reference line $L_{R1}$ intersects a side c-e, and regarding an example of FIG. 18 a second reference line $L_{R2}$ intersects a side b-d. In either case, therefore, an affirmative judgment is made in Step S402, and the control goes to Step S403 to judge whether or not the first reference line intersects the side a-c. Regarding the example of FIG. 16, an affirmative judgment is made in Step S403, and the control goes to Step S404 to change a division line passing the vertices, b and c, for separating the triangle and the adjacent sub-polygon from each other, to a new division line passing the vertices, c and d, and thereby modify the triangle to a quadrangle defined by the four vertices, a, b, d and c. Consequently, the triangle-like sub-area corresponding to the triangle is changed to a quadrangle-like sub-area which is approximated by the quadrangle. In addition, in Step S404, the current divided outline data representing the triangle-like sub-area is modified to represent the quadrangle-like sub-area, and the divided outline data representing the adjacent sub-area is modified so as to be consistent with the modification of the divided outline data representing the triangle-like sub-area. Thus, one cycle of the routine of FIG. 8 is ended.

If a negative judgment is made in Step S403 because the first reference line does not intersect the side a-c, the control goes to Step S405 to judge whether or not the first reference line intersects the side c-e. Regarding the example of FIG. 17, an affirmative judgment is made in Step S405, and the control goes to Step S406 to determine a point, g, on the side b-d which point internally divides the side b-d such that the ratio of the internal division is equal to a ratio of the length of the side a-c to that of a straight segment c-f (f; intersection of the first reference line and the side c-e). Alternatively, it is possible to determine the point g as being a point which internally divides the side b-d by a ratio of the length of the side a-c to that of the side c-e. Step S406 is followed by Step S407 to determine a straight line which passes the vertex c and the point g, as a new division line, and thereby modify the triangle to a quadrangle defined by the four vertices, a, b, g and c. Generally, an intersection between the new straight line and an outline of the adjacent sub-area is determined as a new vertex, and the triangle is modified to a quadrangle defined by the three vertices of the triangle and the new vertex. Simultaneously, the sub-polygon corresponding to the adjacent sub-area is modified to a new polygon defined by the vertices of the previous sub-polygon and the new vertex. In addition, in Step S407, the current divided outline data representing the triangle-like sub-area is modified to represent the quadrangle-like sub-area, and the divided outline data representing the adjacent sub-area is modified to be consistent with the modification of the divided outline data representing the triangle-like sub-area, like in Step S404. Thus, one cycle of the routine of FIG. 8 is ended.

Regarding the example of FIG. 18, a negative judgment is made in Step S405 because a first reference line $L_{R1}$ intersects neither a side a-c nor a side c-e but a second reference line $L_{R2}$ intersects a side b-d. In this case, the control goes to Step S408 to determine a point, i, on the side b-d which point internally divides a straight segment b-h (h; intersection of the second reference line and the side b-d) such that the ratio of the internal division is equal to a ratio of the length of the side a-c to that of the side c-e. Alternatively, it is possible to determine the point i as being a point which internally divides the side b-d by the same ratio as that indicated above. Step S408 is followed by Step S409 to determine a straight line which passes the vertex c and the point i, as a new division line, and thereby modify the triangle to a quadrangle defined by the four vertices, a, b, i and c. In addition, in Step S409, the current divided outline data representing the triangle-like sub-area is modified to represent the quadrangle-like sub-area, and the divided outline data representing the adjacent sub-area is modified to be consistent with the modification of the divided outline data representing the triangle-like sub-area, like in Steps S404 and S407. Thus, one cycle of the routine of FIG. 8 is ended.

If one cycle of the routine of FIG. 8 is ended, the control goes to Step S8 and the following steps of FIG. 4. Steps S7 through S12 are executed for each of the sets of divided outline data. If an affirmative judgment is made in Step S8, the control goes to Step S13.

In Step S13, the count m is set to one. Step S13 is followed by Step S14 to judge whether or not the sub-polygon or sub-area represented by the current divided outline data numbered m of the current outline data numbered l, is a quadrangle or a quadrangle-like sub-area. First, there will be described the case where the sub-polygon or sub-area is not a quadrangle or quadrangle-like sub-area. In this case, the control goes to Step S15. Step S15 is the routine illustrated in detail in FIG. 9.

Initially, in Step S501, are determined a minimum and a maximum position (vertex) of the current sub-polygon or sub-area, in the same manner as that described with respect to Step S251 of FIG. 6, and a set of minimum and maximum positions data representative of the minimum and maximum positions (vertices) is stored in the minimum and maximum positions data area 76g such that the set of data is associated with the current divided outline data. Step S501 is followed by Step S502 to determine a direction of a straight line passing the maximum and minimum vertices of the sub-polygon or sub-area, as a longitudinal direction thereof. Subsequently, in Step S503, the current divided outline data is modified so as to rotate the current sub-polygon or sub-area so that the longitudinal direction thereof becomes parallel to the X axis of the X-Y coordinate system.

Subsequently, in Step S504, it is judged whether or not the number of the vertices on the upper portion of the sub-polygon or outline of the sub-area is not greater than that of the lower portion thereof. If an affirmative judgment is made, the upper portion is selected, while if a negative judgment is made, the lower portion is selected. With respect to each of the vertices of the selected upper or lower portion, is defined a straight first aid line which passes the each vertex and is perpendicular to the longitudinal direction of the current sub-polygon or sub-area, namely, parallel to the Y axis of the X-Y coordinate system. An intersection of each of the first aid lines and one of the upper and lower portions which one portion is opposed to the other portion to which the vertex associated with the each first aid line belongs, is determined as a candidate for a division base position which cooperates with the associated vertex to define a straight division line. Sets of aid line data each representative of a corresponding one of the first aid lines and the associated vertex and division base position candidate (hereinafter, abbreviated to the "candidate" when appropriate), are stored in the aid line data area 76*i*. The minimum vertex serves as the vertex and candidate associated with a first aid line numbered zero which passes it, while the maximum vertex serves as the vertex and candidate associated with a first aid line numbered N which passes it.

FIGS. 19 through 25 show polygons each of which has the feature that the number of the vertices belonging to the upper portion thereof is smaller than that of the lower portion thereof. In the figures, symbol $P_n$ denotes a vertex numbered n, while symbol $D_n$ denotes a division base position candidate numbered n. FIG. 26 shows an example of sets of aid line data.

Step S504 is followed by Step S505 to store a number, N, obtained by subtracting one from the number of the first aid lines provided with respect to the selected upper or lower portion of the current sub-polygon or sub-area, in an appropriate memory area of the RAM 76. Subsequently, in Step S506, the content or count, n, of a third counter indicative of the number assigned to the currently designated first aid line, is set to one. That is, a first aid line numbered one is specified as the current first aid line processed in the following steps in the current cycle. In Step S507, it is judged whether or not the count n is not smaller than the number N. In this situation, a negative judgment is provided in Step S507, and the control goes to Step S508 to determined a rear-side adjacent vertex (indicated at $P_R$ in the figures) whose X coordinate value is the greatest of the X coordinate values of the vertices belonging to one of he upper and lower portions different from the other portion to which the vertex n associated with the first aid line n belongs, which X coordinate values are smaller than the X coordinate value of the candidate n. Step S508 is followed by Step S509 to determine a front-side adjacent vertex (indicated at $P_F$in the figures) whose X coordinate value is the smallest of the X coordinate values of the vertices belonging to the above indicated one of the upper and lower portions, which X coordinate values are greater than the X coordinate value of the candidate n.

Subsequently, in Step S510, it is judged whether or not the X coordinate value of he rear-side adjacent vertex is not greater than that of the candidate (n−1) and the X coordinate value of the front-side adjacent vertex is not smaller than that of the candidate (+1). That is, it is judged whether or not the rear-side adjacent vertex is not located between the candidates n and (n−1) and the front-side adjacent vertex is not located between the candidates n and (n+1). Regarding the example of FIG. 19, an affirmative judgment is made, and the control goes to Step S511 to determine as a proper division base position (indicated at $D'_n$ in the figures) a middle point of a straight segment connecting the rear- and front-side adjacent vertices. On the other hand, if a negative judgment is made in Step S510, the control goes to Step S512 to judge whether or not the X coordinate value of the rear-side adjacent vertex is greater than that of the candidate (n−1) and the X coordinate value of the front-side adjacent vertex is not smaller than that of the candidate (n+1). That is, it is judged whether or not the rear-side adjacent vertex is located between the candidates n and (n−1) and the front-side adjacent vertex is not located between the candidates n and (n+1). Regarding the example of FIG. 20, an affirmative judgment is made, and the control goes to Step S513 to determine the rear-side adjacent vertex as the proper division base position. If a negative judgment is made in Step S512, the control goes to Step S514 to judge whether or not the X coordinate value of the rear-side adjacent vertex is not greater than that of the candidate (n−1) and the X coordinate value of the front-side adjacent vertex is smaller than that of the candidate (n+1). That is, it is judged whether or not the rear-side adjacent vertex is not located between the candidates n and (n−1) and the front-side adjacent vertex is located between the candidates n and (n+1). Regarding the example of FIG. 21, an affirmative judgment is made, and the control goes to Step S515 to determine the front-side adjacent vertex as the proper division base position.

Figure 22:
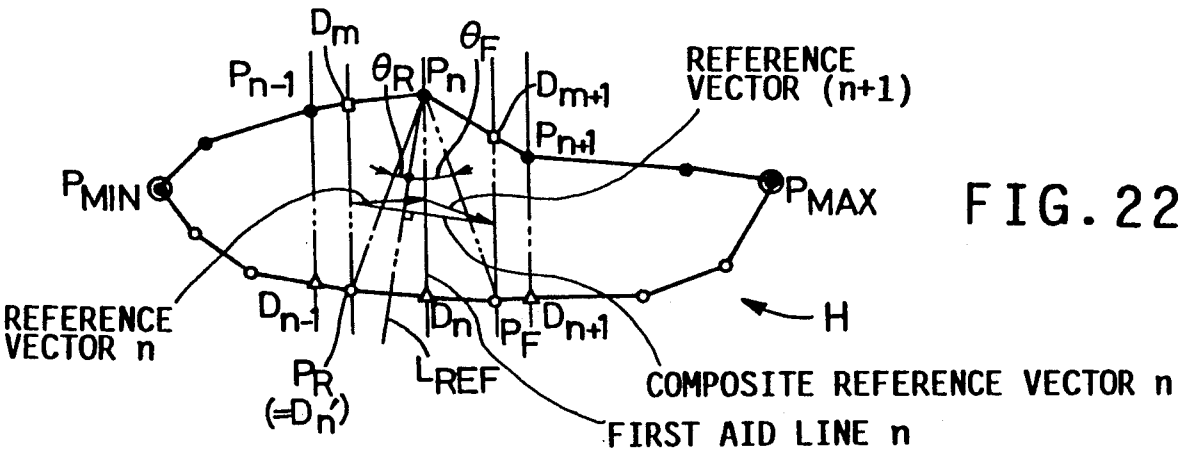
Figure 23:
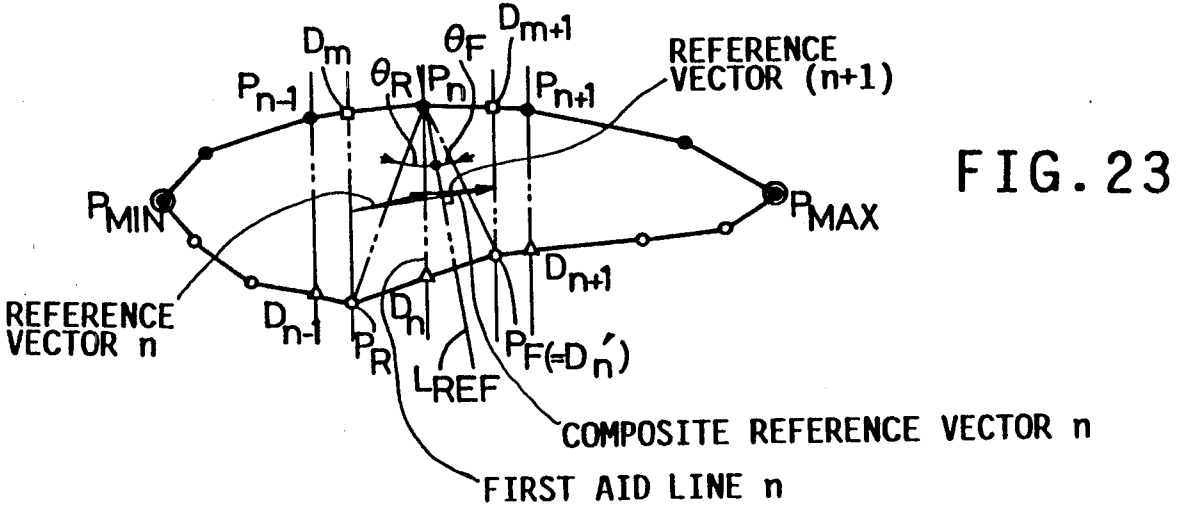
Figure 24:
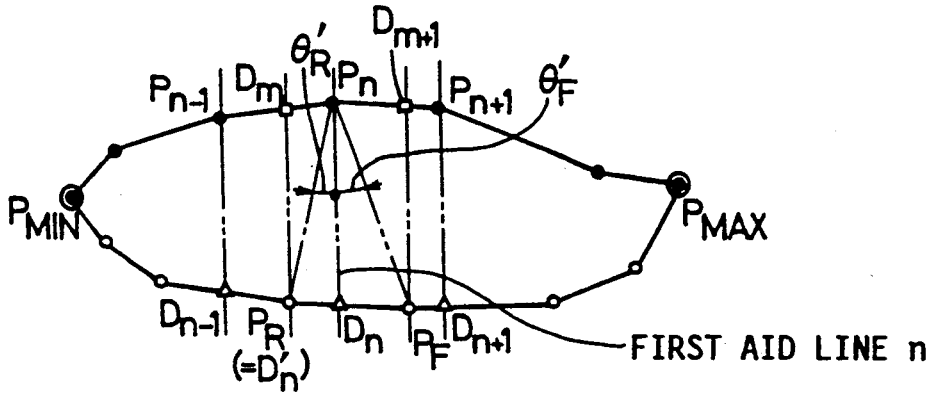
Figure 25:
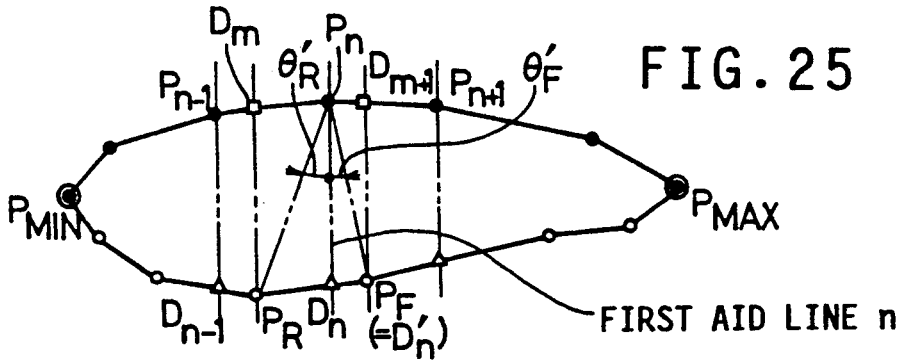

In the case where the rear-side adjacent vertex is located between the candidates n and (n−1) and the front-side adjacent vertex is located between the candidates n and (n+1), a negative judgment is made in Step S514, and the control goes to Step S516 in which, as shown in FIG. 22, are defined two straight second aid lines which are parallel to the Y axis of the X-Y coordinate system and pass the rear- and front-side adjacent vertices, respectively, and are determined two intersections (indicated at $D_m$ and $D_{m+1}$ in the figures) of the second aid lines and the upper or lower portion of the sub-polygon or sub-area to which the vertex n belongs. Consequently, two blocks are obtained on both sides of the first aid line n. These two blocks are equivalent to two blocks n, (n+1) which are provided on both sides of a straight third aid line n by defining, with respect to each of the vertices on the sub-polygon or sub-area, a straight third aid line which passes the each vertex and is parallel to the Y axis. Each of the blocks is enveloped by four segments two of which are defined by corresponding two of the third aid lines and the other two of which are defined by corresponding two of the segments which result from the division of the sides of the sub-polygon, or outline of the sub-area, by the third aid lines. The two third aid lines for each block are opposed to each other in a direction perpendicular to the Y axis of the X-Y coordinate system, while the two segments for the each block are opposed to each other in a direction perpendicular to the X axis. In addition, in Step S516, with respect to the block n, a reference vector n is determined as follows: First, a first vector is determined which starts at one of opposite ends of one of the opposed two segments and ends at the other end of the one segment, a second vector is determined which starts at one of opposite ends of the other of the opposed two segments which one end is opposed to the one end of the one segment and ends at the other end of the other segment which end is opposed to the other end of the one segment, and the reference vector n is determined which starts at a position on a third aid line numbered (n−1), extends in the direction of a vector obtained by addition of the first and second vectors, and ends at a position on a third aid line numbered n. The end position of the reference vector n on the third aid line n serves simultaneously as the start position of a reference vector (n+1). In the present embodiment, the minimum vertex serves as the start position of a reference vector numbered one, while the maximum vertex serves as the end position of a reference vector N, because the minimum vertex serves as the start ends of the first and second vectors for the block to which the minimum block belongs, while the maximum vertex serves as the end ends of the first and second vectors for the block to which the maximum block belongs. The start and end position on the third aid line n will be referred to as a reference position n. The reference position n falls at a middle point of an inside segment of the third straight line n which segment is located inside the current sub-polygon or sub-area. Further, a composite reference vector n is obtained by addition of the reference vectors n and (n+1). Finally, a reference line n (indicated at $L_{REF}$ in the figures) is determined which is perpendicular to the composite reference vector n and passes the vertex n.

Step S516 is followed by Step S517 to determine an angle $\theta_R$ contained by the reference line n and a straight rear-side adjacent line passing the vertex n and the rear-side adjacent vertex, and an angle $\theta_F$ contained by the reference line n and a straight front-side adjacent line passing the vertex n and the front-side adjacent vertex. In addition, in Step S517, it is judged whether or not the angle $\theta_R$ is smaller than the angle $\theta_F$. That is, it is judged whether or not the rear-side adjacent line is nearer to the reference line n than the front-side adjacent line. Regarding the example, H, of FIG. 22, an affirmative judgment is made in Step S517, and the control goes to Step S513 to determine the rear-side adjacent vertex as the proper division base vertex n (D'n). On the other hand, if a negative judgment is made in Step S517, the control goes to Step S518 to judge whether or not the angle $\theta_R$ is greater than the angle $\theta_F$. That is, it is judged whether or not the front-side adjacent line is nearer to the reference line n than the rear-side adjacent line. Regarding the example of FIG. 23, an affirmative judgment is made in Step S518, and the control goes to Step S515 to determine the front-side adjacent vertex as the proper division base vertex n. On the other hand, if a negative judgment is made in Step S518, namely, if the angle $\theta_R$ is equal to the angle $\theta_F$, the control goes to Step S519 to determine an angle $\theta^-_R$ contained by the first aid line n and the rear-side adjacent line, and an angle $\theta^-_F$ contained by the first aid line n and the front-side adjacent line. In addition, in Step S519, it is judged whether or not the angle $\theta^-_R$ is smaller than the angle $\theta^-_F$. That is, it is judged whether or not the rear-side adjacent line is nearer to the straight line n than the front-side adjacent line. Regarding the example of FIG. 24, an affirmative judgment is made in Step S519, and the control goes to Step S513 to determine the rear-side adjacent vertex as the proper division base vertex n. On the other hand, if the angle $\theta^-_R$ is greater than the angle $\theta^-_F$ as is the case with an example of FIG. 25, or if the angle $\theta^-_R$ is equal to the angle $\theta^-_F$, a negative judgment is made in Step S519, and the control goes to Step S515 to determine the front-side adjacent vertex as the proper division base vertex n.

After the proper division base vertex n is determined, the control goes to Step S520 to increment the count n by one, and subsequently the control returns to Step S507. Steps S507 through 520 are repeated for the first aid lines, beginning with the line numbered one and ending with the line numbered (N−1). If the count n coincides with the number N, an affirmative judgment is made in Step S507, and the control goes to Step S521 to determine vertices for which proper division base positions have not been determined, and determine the proper division base positions for those vertices left.

In the case where the number of the vertices of the upper portion of the current sub-polygon or sub-area is not equal to that of the lower portion thereof, for example, where the former is smaller than the latter, there may be left on the lower portion some vertices for which proper division base positions are not determined by the execution of Steps 507 through S520. Step S521 is provided for determining proper division base positions for those vertices left. Specifically, first, on one of the upper and lower portions different from the other portion to which one or more left vertices belong, are determined a pair of vertices which have, as the division base positions (vertices) therefor, the preceding and following vertices of the one left vertex or group of the more left vertices, respectively, on the other portion. Second, a segment connecting the thus determined pair of vertices is divided internally by the same ratios as the internal division ratios of the X axis by the feet on the X axis of the preceding vertex, one or more left vertices and following vertex. The thus provided, internally dividing point or points are determined as the proper division base position or positions for the left one or more vertices. Regarding a polygon shown in FIG. 27, the number of the vertices belonging to the lower portion of the polygon is greater than that of the upper portion thereof, the lower portion has four left vertices, $P_{m+1}$, $P_{m+2}$, $P_{m+3}$ and $P_{m+4}$, between the preceding vertex $P_m$ and the following vertex $P_{m+5}$. In this case, a side connecting vertices $D_m$ and $D_{m+5}$ which correspond to the preceding and following vertices $P_m$, $P_{m+5}$ (i.e., division base positions for the vertices $D_m$ and $D_{m+5}$), respectively, is divided internally by the same ratios as the internal division ratios of the X axis by the feet on the X axis of the preceding vertex $P_m$, left vertices $P_{m+1}$, $P_{m+2}$, $P_{m+3}$, $P_{m+4}$ and following vertex $P_{m+5}$. The thus obtained, four internally dividing points on the side $D_m-D_{m+5}$ are determined as the proper base division positions for the vertices $P_{m+1}$, $P_{m+2}$, $P_{m+3}$, $P_{m+4}$, respectively.

Step S521 is followed by Step S522 in which the current sub-polygon is divided into polygonal (triangular or quadrangular) blocks by straight lines passing the vertices and the corresponding division base positions, and simultaneously the current sub-area is divided into profile blocks corresponding to the polygonal blocks. Sets of block data each representative of a corresponding one of the profile (and polygonal) blocks are prepared. The sets of block data are modified for eliminating the effect of the previous rotation of the current sub-polygon or sub-area, and then is stored in the block data area **76*d*. In addition, in Step S522, is prepared a set of second special data representative of a correspondence between the current sub-polygon or sub-area, and the polygonal or profile blocks belonging thereto. The set of second special data is stored in the special data area 76*k*. Thus, one cycle of the routine of FIG. 4** is ended.

Subsequently, the control goes to Step S16 of FIG. 4. Step S16 is the routine illustrated in detail in FIG. 10.

First, in Step S601, the sub-polygon or sub-area represented by the current divided outline data numbered m, is modified so as to rotate the sub-polygon or sub-area so that the longitudinal direction thereof becomes parallel to the X axis of the X-Y coordinate system. Regarding an example shown in FIG. 28, a straight line passing a minimum and a maximum vertex $P_{MIN}$ and $P_{MAX}$ becomes parallel to the X axis. Hereinafter, symbols, $u_1$–$u_m$, are used for denoting the respective vertices on the upper portion of the current sub-polygon or outline of the sub-area, except for the minimum and maximum vertices, in the order of position of the vertices from the minimum vertex to the maximum vertex. Similarly, symbols, $d_1$–$d_m$, are used for denoting the respective vertices on the lower portion of the current sub-polygon or sub-area, except for the minimum and maximum vertices, in the order of position of the vertices from the minimum vertex to the maximum vertex. In addition, one of the sides of the upper portion of the current sub-polygon which one side contains the minimum vertex, is referred to as a left upper side of the sub-polygon, one of the sides of the upper portion of the current sub-polygon which one side contains the maximum vertex, is referred to as a right upper side, one of the sides of the lower portion of the current sub-polygon which one side contains the minimum vertex, is referred to as a left lower side, and one of the sides of the lower portion of the current sub-polygon which one side contains the maximum vertex, is referred to as a right lower side.

The current sub-polygon has been divided into polygonal blocks according to the dividing (blocking-out) rule employed in the routine of FIG. 9. If a polygon is divided into polygonal blocks according to the routine of FIG. 9, the obtained polygonal blocks always include two triangles, to which the minimum and maximum vertices of the polygon belong, respectively. Since, when the current sub-polygon is divided into polygonal blocks, the current sub-area corresponding to the current sub-polygon is divided into profile blocks, the profile blocks always include two triangle-like blocks approximated by the above indicated two triangles, respectively. The triangle to which the minimum vertex belongs, will be referred to as a left end triangle, while the triangle to which the maximum vertex belongs, will be referred to as a right end triangle. In the present embodiment, first, it is judged whether or not it is appropriate to modify the left end triangle to a quadrangle, and then it is judged whether or not it is appropriate to modify the right end triangle to a quadrangle. The first case will be described in detail below.

Step S602 is a judgment step having the three alternatives; the first alternative judgment is that only the left lower side out of the left upper and lower sides is a portion of a division line for separating the current sub-polygon or sub-area from another sub-polygon or sub-area adjacent thereto, the second alternative judgment is that only the left upper side of the two sides is a portion of a division line, and the third alternative judgment is that neither the left upper nor lower side is a portion of a division line. In the case of the first alternative judgment, the control goes to Step S603 to determine the left lower side as a stitch-free side and determine vertices a, b, c, d, and e. A set of reference data representative of the vertices a through e is stored in an appropriate memory area of the RAM 76 such that the stored set of reference data is associated with the left end triangle. The determination of the vertices a through e is effected in a manner similar to that of the routine of FIG. 7, and therefore explanation thereof is abbreviated. First, the following quadrangle or quadrangle-like block of the present triangle or triangle-like block, located on the maximum-vertex side thereof, is determined as an adjacent block utilized for modifying the triangle or triangle-like block to a quadrangle or quadrangle-like block. Out of the three vertices of the present triangle, one vertex different from the other two vertices defining the side common to the triangle and the adjacent quadrangle, is determined as a vertex a. The common side is a portion of a division line separating the triangle and the adjacent quadrangle from each other. Next, one of the other two vertices which one vertex cooperates with the vertex a to define the stitch-free side, is determined as a vertex b. Further, the remainder vertex different from the vertices a and b, is determined as a vertex c. One of the four vertices of the adjacent quadrangle which one vertex is the following vertex of the vertex b located on the maximum-vertex side thereof, is determined as a vertex d. Finally, one of the four vertices of the adjacent quadrangle which one vertex is different from the vertices b, c, d, is determined as a vertex e.

In the case of the second alternative judgment in Step S602, namely, only the left upper side is a portion of a division line for separating the current sub-polygon or sub-area from another sub-polygon or sub-area adjacent thereto, the control goes to Step S604 in which the left upper side is determined as a stitch-free side and vertices a through e are determined in a manner similar to that described above.

Figure 41:
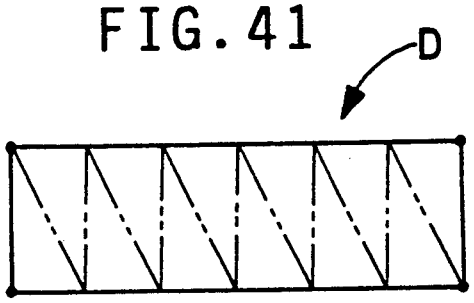
FIGS. 41 and 43 are views of areas provided as examples for explaining the division of the areas of FIGS. 39 and 42 effected by an embodiment of the present invention.
Figure 43:
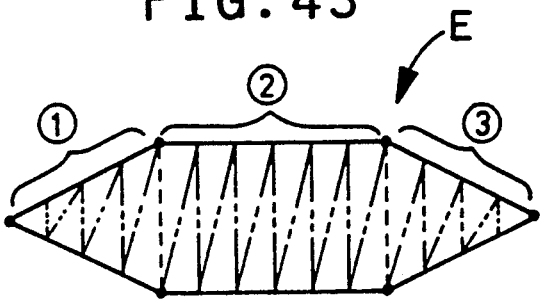
Figure 44:
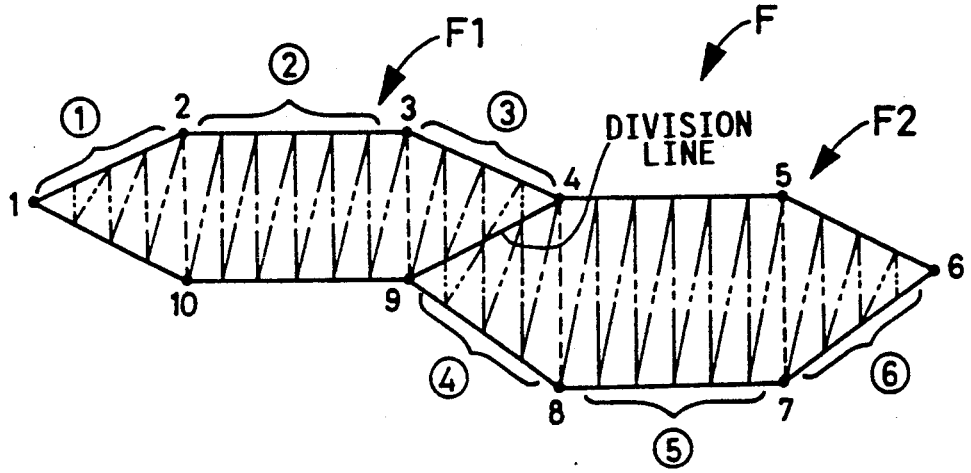
FIGS. 44 and 45 are views of areas provided as examples for explaining the division effected by the apparatus of the present invention.
Figure 45:
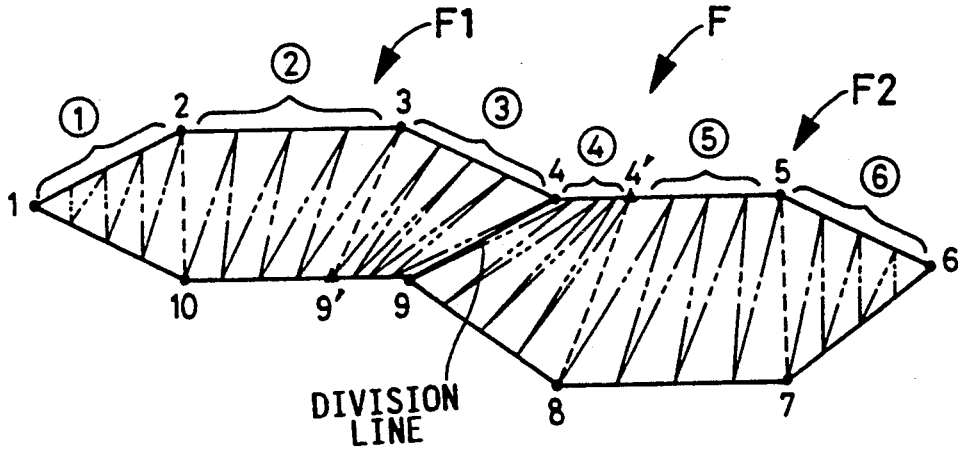

Further, in the case of the third alternative judgment in Step S602, namely, if neither the left lower nor upper side is a portion of a division line, the control goes to Step S605 to compare an angle, $\theta_{ui}$, contained between the left upper side and the following side of the left upper side located on the maximum-vertex side thereof, with an angle, $\theta_{di}$, contained between the left lower side and the following side of the left lower side located on the maximum-vertex side thereof. Regarding each of examples shown in FIGS. 29A, 29B and 29C, an angle $\theta_{ui}$ is equal to an angle $\theta_{di}$, and therefore the control goes to Step S606 to compare an X coordinate value, $X_{u1}$, of a vertex, $u_1$, at which the left upper side and the following side thereof are connected to each other, with an X coordinate value, $X_{d1}$, of a vertex, $d_1$, at which the left lower side and the following side thereof are connected to each other. Regarding the example of FIG. 29A, a value $X_{u1}$ is greater than a value $X_{d1}$, and therefore the control goes to Step S603 to determine the left lower side as a stitch-free side and determine vertices a through e. On the other hand, regarding the example of FIG. 29B, a value $X_{u1}$ is equal to a value $X_{d1}$, and therefore the control goes to Step S607 to set a triangle permission flag for the left end triangle, to one. When the flag is in the state of one, it indicates that it is appropriate to permit the triangle-like block approximated by the left end triangle to be used as a block based on which a set of stitch position data is prepared. In addition, regarding the example of FIG. 29C, a value $X_{u1}$ is smaller than a value $X_{d1}$, and therefore the control goes to Step S604 to determine the left upper side as a stitch-free side, and determine vertices a through e. Hereinafter, polygons analogous to the example of FIG. 29B will be referred to as the rhombus-type polygons, while polygons analogous to the examples of FIGS. 29A and 29C will be referred to as the rectangle-type polygons. The polygon D of FIG. 41 is a rectangle-type polygon, while the polygon E of FIG. 43 is a rhombus-type polygon.

Figure 30A:
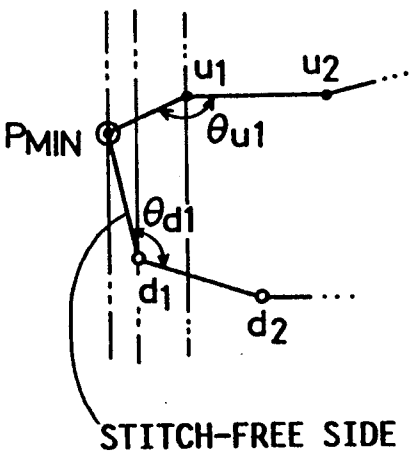
Figure 30B:
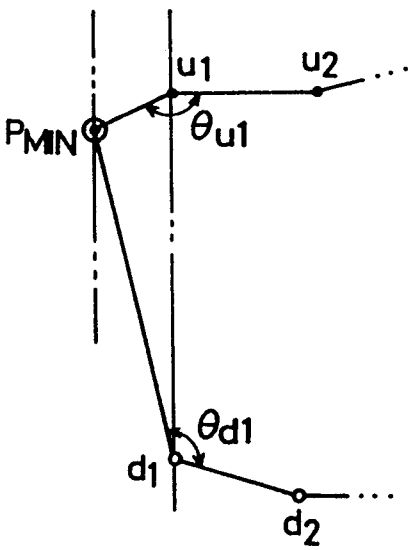
Figure 30C:
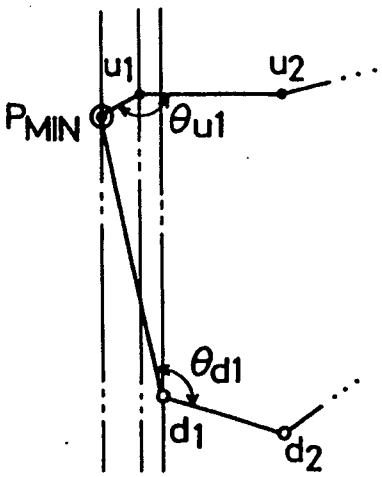

Regarding each of examples shown in FIGS. 30A, 30B and 30C, the angle $\theta_{ui}$ is greater than the angle $\theta_{di}$, and therefore the control goes to Step S608 to compare the value $X_{u1}$ with the value $X_{d1}$. Regarding the example of FIG. 30A, a value $X_{u1}$ is greater than a value $X_{d1}$, and therefore the control goes to Step S603 to determine the left lower side as a stitch-free side, and determine vertices a through e. On the other hand, regarding the examples of FIGS. 30B and 30C, a value $X_{u1}$ is equal to, or smaller than, a value $X_{d1}$, and therefore the control goes to Step S607 to set the triangle permission flag for the left end triangle, to one.

Figure 29A:
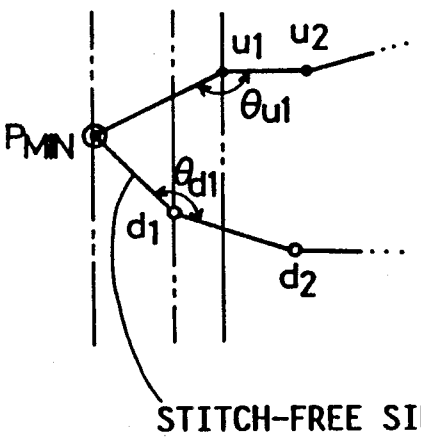
Figure 29B:
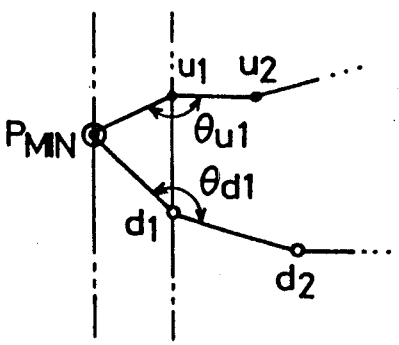
Figure 29C:
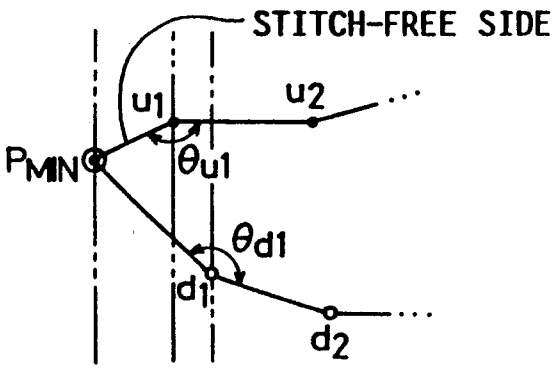

By increasing the angle $\theta_{ui}$ of the polygon of FIG. 29C so as to be greater than the angle $\theta_{di}$, the polygon of FIG. 29C is changed to a polygon analogous to the polygon of FIG. 30C. The polygon of FIG. 30C is regarded as being nearer to a rhombus-type polygon than the polygon of FIG. 29C. Therefore, the triangle permission flag for the left end triangle is set to one for the polygon of FIG. 30C, as described above.

Figure 31A:
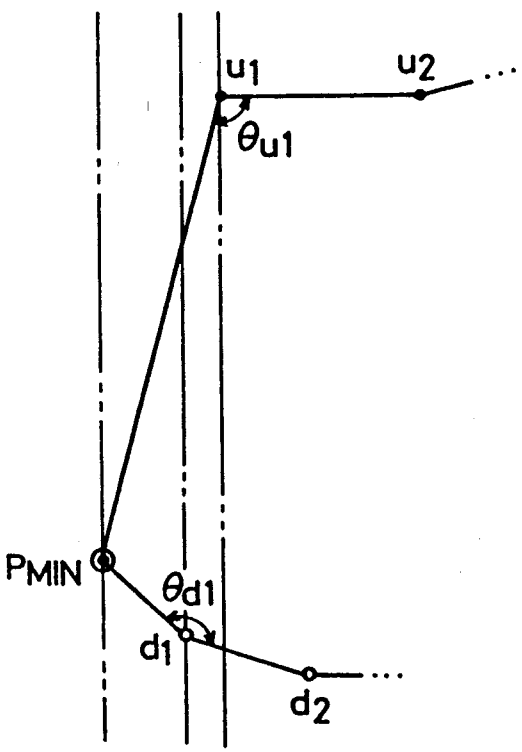
Figure 31B:
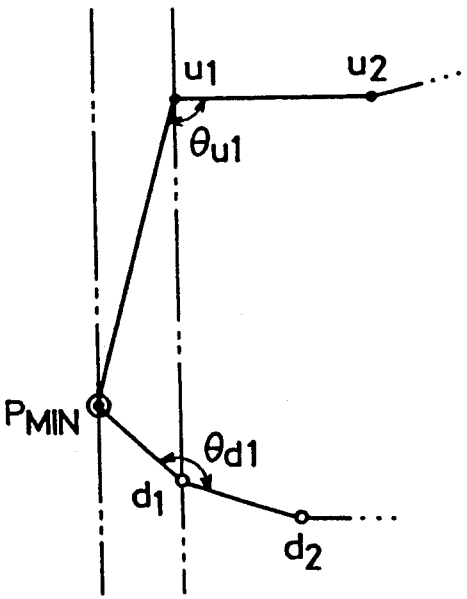
Figure 31C:
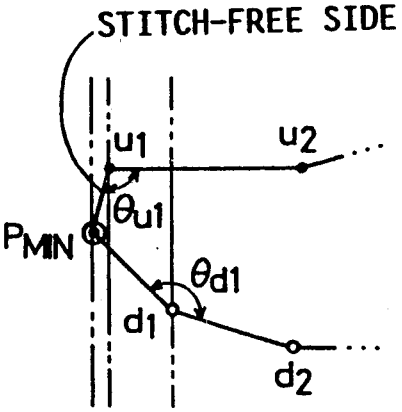

In addition, regarding each of examples shown in FIGS. 31A, 31B and 31C, the angle $\theta_{ui}$ is smaller than the angle $\theta_{di}$, and therefore the control goes to Step S609 to compare the value $X_{u1}$ with the value $X_{d1}$. Regarding the examples of FIGS. 31A and 31B, a value $X_{u1}$ is greater than, or equal to, a value $X_{d1}$, and therefore the control goes to Step S607 to set the triangle permission flag for the left end triangle, to one. On the other hand, regarding the example of FIG. 31C, a value $X_{u1}$ is smaller than a value $X_{d1}$, and therefore the control goes to Step S604 to determine the left upper side as a stitch-free side and determine vertices a through e.

By decreasing the angle $\theta_{ui}$ of the polygon of FIG. 29A so as to be smaller than the angle $\theta_{di}$, the polygon of FIG. 29A is changed to a polygon analogous to the polygon of FIG. 31A. The polygon of FIG. 31A is regarded as being nearer to a rhombus-type polygon than the polygon of FIG. 29A. Therefore, the triangle permission flag for the left end triangle is set to one for the polygon of FIG. 31A, as described above.

Figure 32A:
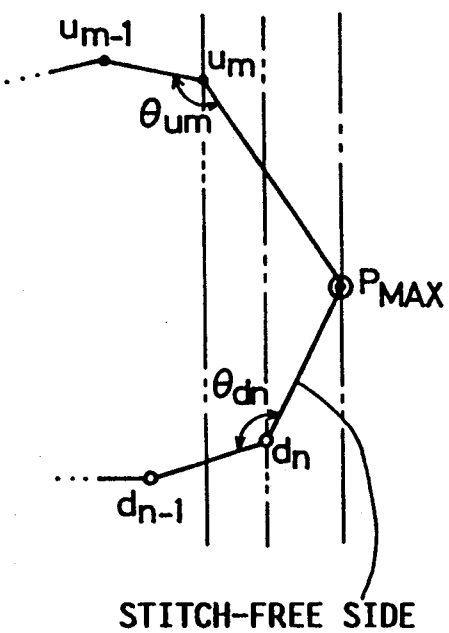
Figure 32B:
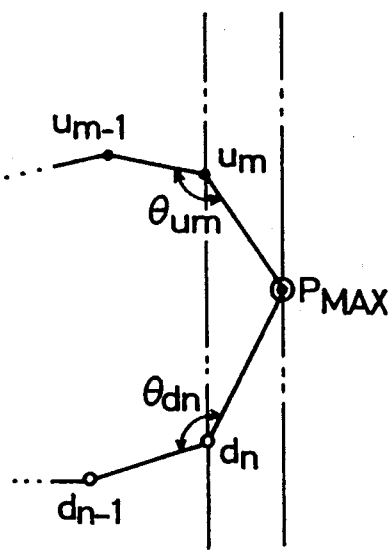
Figure 32C:
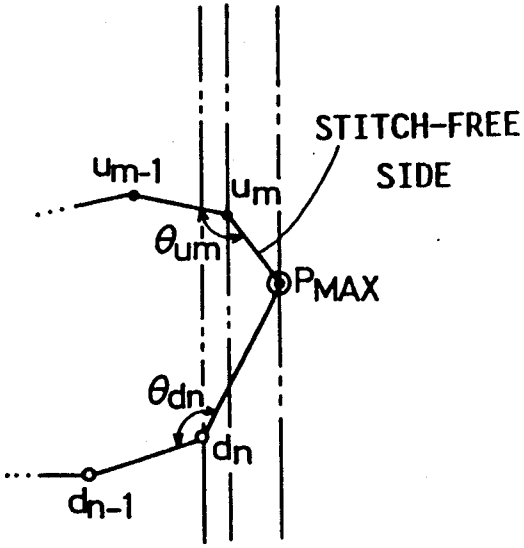
Figure 33A:
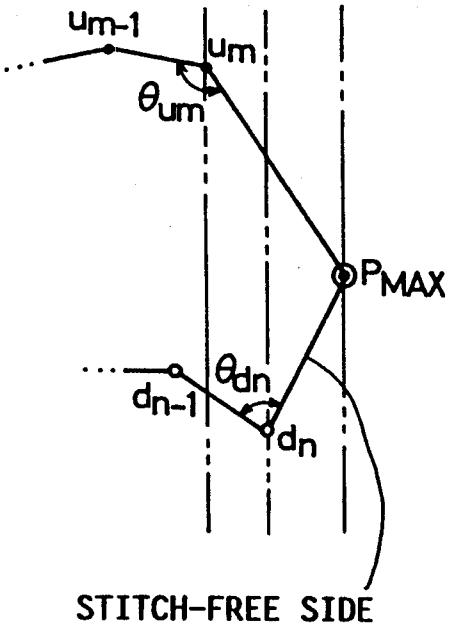
Figure 33B:
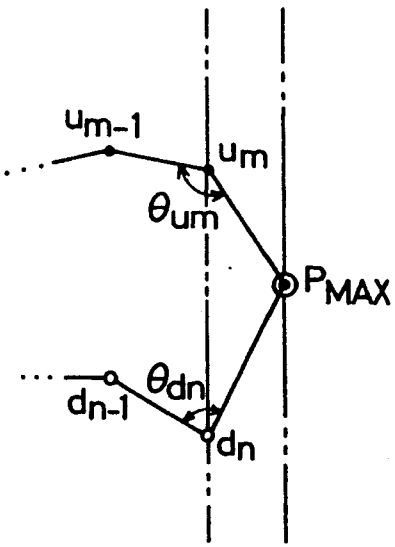
Figure 33C:
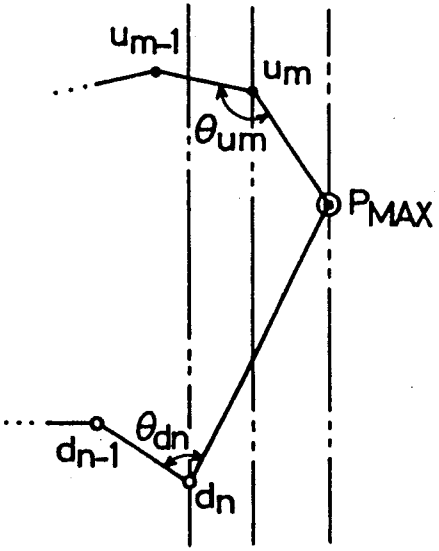
Figure 34A:
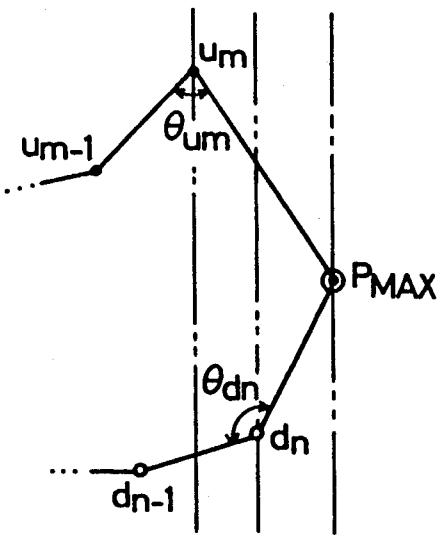
Figure 34B:
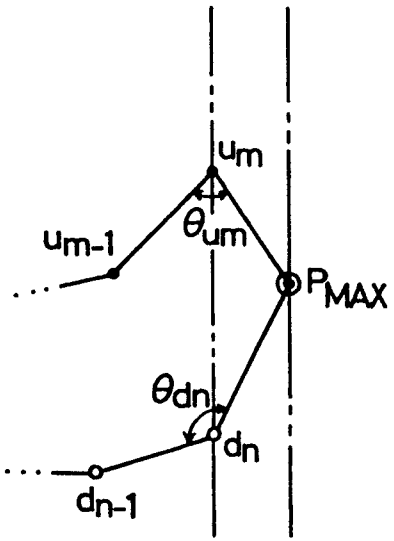
Figure 34C:
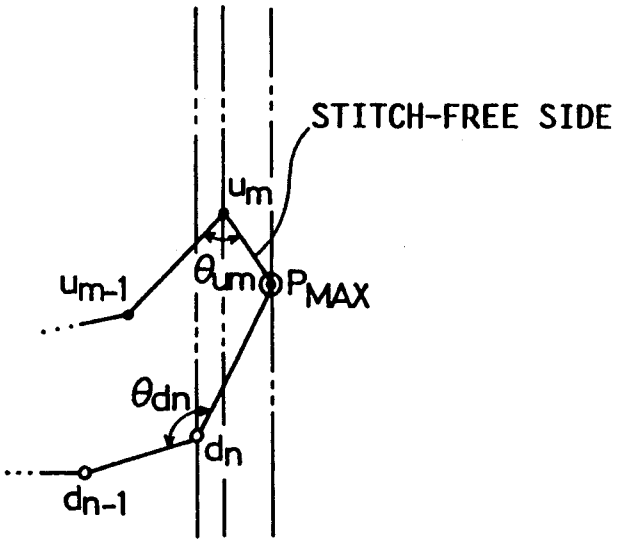

Subsequently, Steps S610 through S617 are executed with respect to the right end triangle, for determining vertices a through e, or setting a triangle permission flag therefor to one. These steps are almost similar to Steps S602 through S609 provided for the left end triangle, but are different from the latter in that in each of Steps S611 and S612 the preceding quadrangle or quadrangle-like block of the present triangle located on the minimum-vertex side thereof is determined as an adjacent block utilized for modifying the triangle or triangle-like block to a quadrangle or a quadrangle-like block and in that in each of Steps S616 and S617 a converse judgment is made as a result of the comparison between the values $X_{u1}$ and $X_{u2}$, as compared with the judgment made in a corresponding one of Steps S608 and S609. FIGS. 32A, 32B and 32C show three examples corresponding to the three alternative judgments made in Step S614, where in Step S613 it is judged that the angle $\theta_{um}$ is equal to the angle $\theta_{dm}$. FIGS. 33A, 33B and 33C show three examples corresponding to the three alternative judgments made in Step S616, where in Step S613 it is judged that the angle $\theta_{um}$ is greater than the angle $\theta_{dm}$. FIGS. 34A, 34B and 34C show three examples corresponding to the three alternative judgments made in Step S617, where in Step S613 it is judged that the angle $\theta_{um}$ is smaller than the angle $\theta_{dm}$. Further description of Steps S610 through S617 is omitted. Thus, one cycle of the routine of FIG. 10 is ended.

Subsequently, the control goes to Step S17 of FIG. 4 to store the number, N, of the polygonal or profile blocks of the current sub-polygon or sub-area, in an appropriate memory area of the RAM 76. Step S17 is followed by Step S18 to set the content or count, n, of a fourth counter to one. Thus, the polygonal block numbered n is specified as the current block. Step S18 is followed by Step S19 to judge whether or not the current block is a triangle, based on the set of block data representative of the profile block corresponding to the current polygonal block. If a negative judgment is made in Step S19, the control goes to Step S20 to judge whether or not the count n is not less than the number N. If a negative judgment is made in Step S20, the control goes to Step S21 to increment the count n by one and then returns to Step S19.

Figure 35:
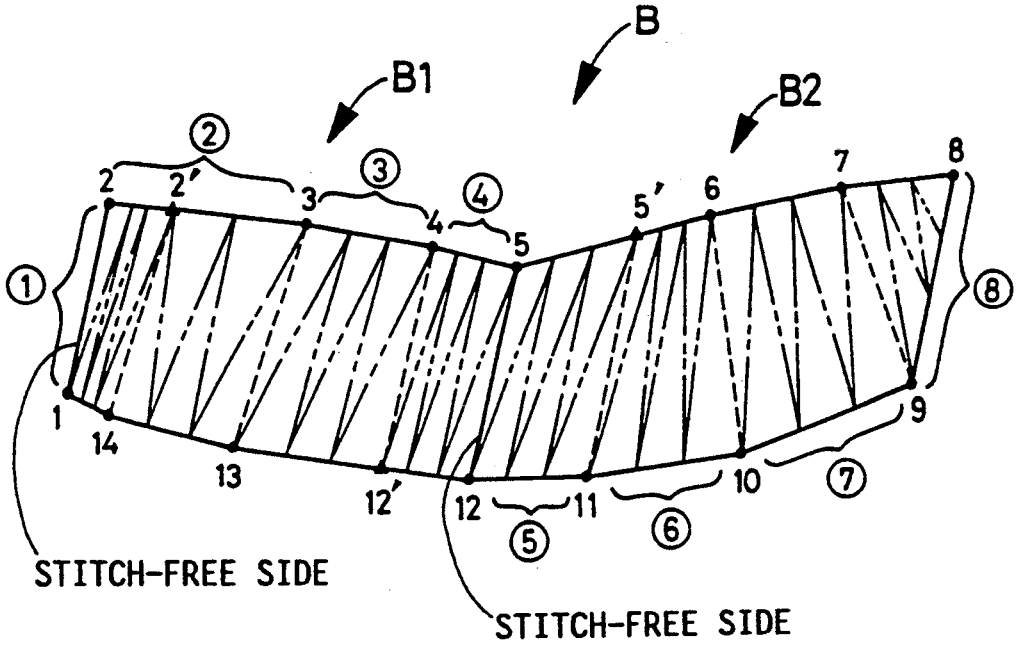
FIG. 35 is a view for explaining the stitch position data preparation effected by an embodiment of the present invention with respect to an area shown in FIG. 37.
Figure 37:
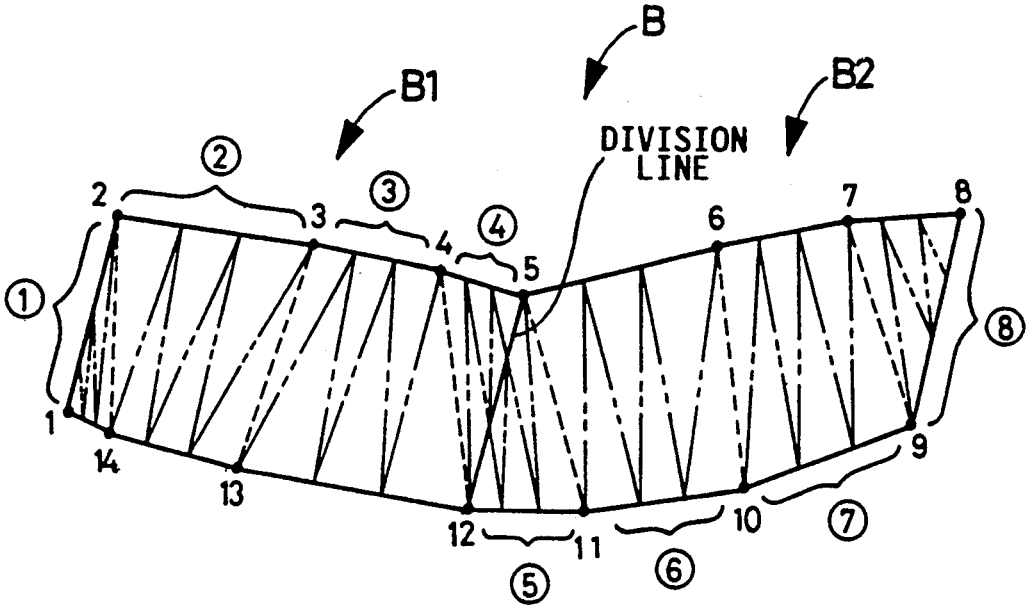
Figure 38:
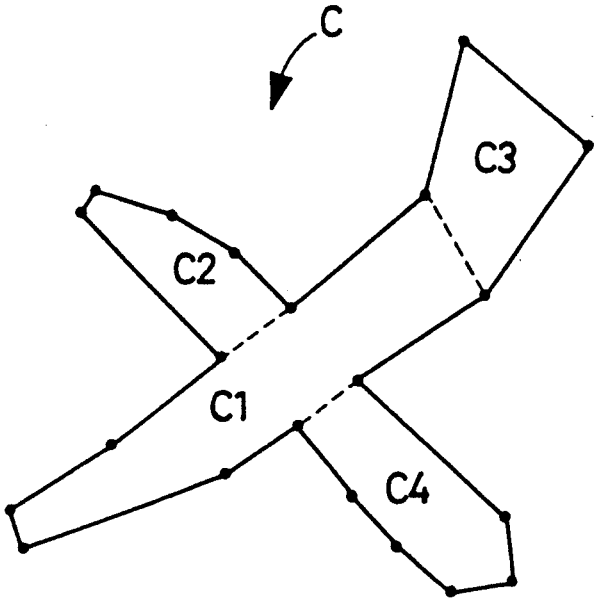
Figure 39:
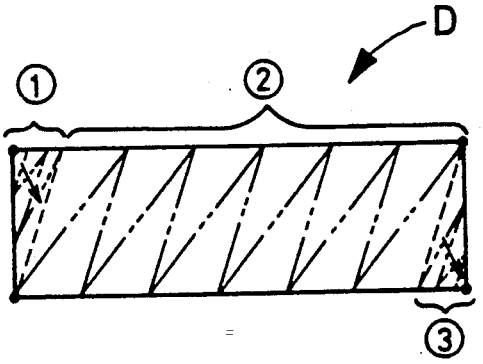
Figure 40:
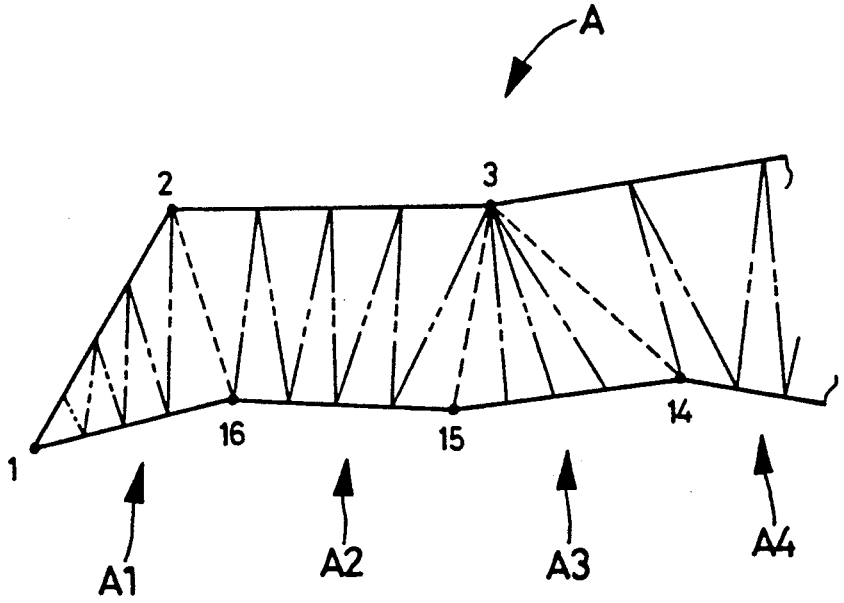

On the other hand, if an affirmative judgment is made in Step S19, namely, if the current polygonal block is a triangle, the control goes to Step S22 to judge whether or not the triangle permission flag for the triangle is in the state of one. If an affirmative judgment is made in Step S22, the control goes to Step S20. On the other hand, if a negative judgment is made in Step S22, the control goes to Step S23 to modify the triangle or triangle-like block approximated by the triangle, to a quadrangle or quadrangle-like block approximated by the quadrangle. Step S23 is the routine of FIG. 8 previously described with respect to Step S12. Regarding a polygon, B, shown in FIG. 37, the polygon B includes two sub-polygons $B_1$ and $B_2$ and the first and fourth blocks of the sub-polygon $B_1$ are triangles each of which is to be judged in the routine of FIG. 10 as being an inappropriate triangle, or triangle to be modified. In the event that the routine of FIG. 8 is executed for the first block of the sub-polygon $B_1$ of FIG. 37, a side, 1-2, is determined as a stitch-free side and vertices, 1, 2, 14, 3, and 13 are determined as vertices a, b, c, d, and e, respectively, as shown in FIG. 35. Since the first block of the sub-polygon $B_1$ is analogous to the example of FIG. 18, the first block or triangle is modified to a quadrangle defined by the vertices 1, 2, 2' (vertex i), and 14. Further, with respect to the fourth block of the sub-polygon $B_1$, a side, 5-12, is determined as a stitch-free side because the side 5-12 is a portion of a division line, and vertices, 5, 12, 4, 13, and 3 are determined as vertices a, b, c, d, and e, respectively, as shown in FIG. 35. Since the fourth block of the sub-polygon $B_1$ is analogous to the example of FIG. 17, the fourth block or triangle is modified to a quadrangle defined by the vertices 12' (vertex g), 4, 5, and 12. In order to be consistent with this modification, the block data representative of the profile block corresponding to the triangle, is modified to a new block data representative of a new profile block corresponding to the new quadrangle.

Steps S19 through S23 are repeated for the polygonal or profile blocks of the current sub-polygon or sub-area. In the meantime, if an affirmative judgment is provided in Step S20, the control goes to Step S24 to prepare a set of stitch position data based on each of the profile blocks of the current sub-area which blocks may, or may not, one or more new profile blocks. With respect to each of the non-modified profile blocks, stitch positions are determined on two segments of the four segments defining the each block which two segments are opposed to each other generally in the direction perpendicular to the longitudinal direction of the current parent polygon or area. Similarly, with respect to each of the modified profile blocks, stitch positions are determined on a segment connecting the vertex b and either one of the vertices d, g and i, and a segment connecting the vertices a and c, which segments are the two segments of the each block which opposed to each other generally in the direction perpendicular to the longitudinal direction of the current parent polygon or area. According to each of the thus prepared sets of stitch position data, a plurality of stitches are formed in the corresponding profile block by alternately connecting between the stitch positions provided on one of the two segments thereof and the stitch positions provided on the other segment thereof.

As is apparent from the foregoing, according to the stitch position data prepared in Step S24, stitches are formed in the central-line direction or embroidering direction for the current parent polygon or area in each of the profile blocks of the current sub-area, even in the zones of the left-hand and right-hand end portions thereof such as the first block of the sub-polygon $B_1$ of FIG. 35. In addition, since a straight segment of a sub-area which segment is a portion of a division line for separating the sub-area from another sub-area adjacent thereto, is determined as a stitch-free side, stitches are formed continuously over the parent area, without being bordered by that segment.

While the case where the current sub-polygon is a polygon having more than four sides, has been described above, there will be described the case where the current sub-polygon is a polygon having four sides, namely, quadrangle. In this case, an affirmative judgment is made in Step S14, and the control goes to Step S24 to prepare a set of stitch position data for a quadrangle-like sub-area corresponding to a quadrangle, in the manner described above with respect to the profile blocks belonging to a sub-area corresponding to a sub-polygon different from a triangle or a quadrangle. Specifically, with respect to each of the non-modified quadrangle-like sub-areas, stitch positions are determined on two segments of the four segments defining the each sub-area which two segments are opposed to each other generally in the direction perpendicular to the longitudinal direction of the current parent polygon or area. Similarly, with respect to each of the modified quadrangle-like sub-areas, stitch positions are determined on a segment connecting the vertex b and either one of the vertices d, g and i, and a segment connecting the vertices a and c, which segments are the two segments of the each sub-area which are opposed to each other generally in the direction perpendicular to the longitudinal direction of the current parent polygon or area. According to each of the thus prepared sets of stitch position data, a plurality of stitches are formed in the corresponding sub-area by alternately connecting between the stitch positions provided on one of the two segments thereof and the stitch positions provided on the other segment thereof. The sets of stitch position data are stored in the stitch position data area 76c.

Step S24 is followed by Step S25 to judge whether or not the count m is not less than the number M. If a negative judgment is made in Step S25, the control goes to Step S26 to increment the count m by one and then returns to Step S14. On the other hand, if an affirmative judgment is made in Step S25, the control goes to Step S27 to judge whether or not the count l indicative of the number assigned to the current set of outline data is not less than the number L indicative of the total number of the sets of outline data. If a negative judgment is made in Step S27, the control goes to Step S28 to increment the count l by one, and returns to Step S5. On the other hand, if an affirmative judgment is made in Step S27, one cycle of the stitch position data prepare routine of FIG. 4 is ended.

If the operator keys in an embroidery start command through the keyboard 82 to embroider a desired area on the work fabric, the area is embroidered with the stitches which are formed at respective stitch positions according to the corresponding stitch position data stored in the stitch position data area 76c of the RAM 76.

Figure 42:
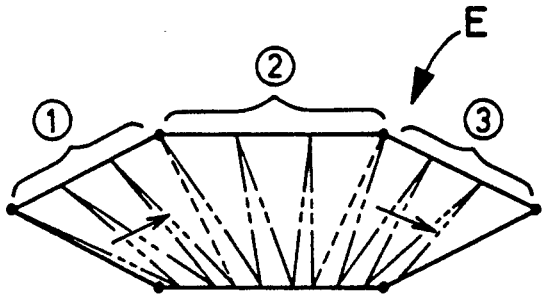

FIG. 43 shows the embroidery or stitches produced by operating the present system for the area E of FIG. 42. As is apparent from FIGS. 42 and 43, the embroidering direction of the stitches shown in FIG. 43 coincides with the central-line direction of the area E, in contrast to the embroidering direction of the stitches shown in FIG. 42.

As is apparent from the foregoing description, in the present embroidery sewing machine system, Steps S2 and S15 serve as dividing means, Steps S24 and S522 serves as data producing means, Steps S7, S10, S11 and S16–S22 serve as checking means, and Steps S12 and S13 serve as modifying means.

While in Steps S251 and S501 of the present embodiment the most distant two vertices on the outline of an area or a divided area are determined as the minimum and maximum positions thereof, it is possible to determine approximately the most distant vertices, or sufficiently distant two vertices as the minimum and maximum positions.

Although in the present embodiment the routine of Step S15 is executed before the routine of Step S16, it is possible to execute Step S16 before Step S15 because the routine of Step S16 can be executed independent of the blocks obtained by executing the routine of Step S15.

Hence, a second embodiment of the present invention is provided, in which a step corresponding to Step S16 of the first embodiment is executed and thereafter is executed a step in which a divided area is divided into blocks by utilizing the results from the step corresponding to Step S16. If in the first step it is judged that an end portion of the divided area to which the minimum or maximum vertex belongs, is not suitable or appropriate for being divided into a triangle-like block in the second step, the end portion is divided into a quadrangle-like block by determining an intersection of a first aid line passing one of the two vertices, $u_1$ and $d_1$ or $u_m$ and $d_n$, adjacent to the minimum or maximum position which one has the greater X coordinate than the other vertex, and one of the upper and lower portions of the outline of the divided area to which one the other vertex belongs, as a special position as the forth position which cooperate with the minimum or maximum vertex and its two adjacent vertices to define a quadrangle approximating the quadrangle-like block in question.

Furthermore, in a third embodiment of the present invention, if an affirmative judgment is provided in a step of the third embodiment corresponding to Step S7 of the first embodiment, the step is followed by a step corresponding to Step S16 of the first embodiment to be executed with respect to a triangle-like divided area produced at an end portion of an area to which the minimum or maximum position thereof belongs, before a step corresponding to Step S10 of the first embodiment. In the third embodiment, if a triangle permission flag is set to one for a triangle-like divided area, the step corresponding to Step S10 is skipped for the triangle-like divided area.

While the present invention has been described in its preferred embodiment with its particularities, it is to be understood that the present invention is by no means limited to the details of the illustrated embodiment but may be embodied with various changes improvements and modifications that may occur to those skilled in the art without departing from the spirit and scope of the invention defined in the pending claims.

What is claimed is:

1. An apparatus for preparing stitch position-related data and utilizing the data for controlling an embroidery sewing machine to embroider a predetermined area by forming stitches at respective stitch positions and thereby filling the area with the formed stitches, comprising:

dividing means for specifying a plurality of base positions on an outline of said area based on outline data representative of said outline, said outline data including a plurality of sets of position data each of which is representative of a corresponding one of a plurality of specific positions predetermined on said outline, said base positions defining a polygon approximating said area, said dividing means defining a plurality of straight division lines each of which passes a corresponding pair of base positions of said plurality of base positions and which do not intersect each other inside said outline, said division lines dividing said area and said polygon into a plurality of sub-areas and a plurality of sub-polygons, respectively, each of said sub-areas being approximated by a corresponding one of said sub-polygons;

data producing means for producing said stitch position-related data based on said sub-areas;

checking means for, if said dividing means produces as one of said sub-areas a triangle-like sub-area which is approximated by a triangle as said corresponding one sub-polygon therefor, judging whether or not said triangle-like sub-area is an appropriate sub-area to be utilized by said data producing means for producing said stitch position-related data;

modifying means for, if a negative judgment is made by said checking means, modifying said triangle-like sub-area to a quadrangle-like sub-area which is approximated by a quadrangle, by determining a special position on said outline of said area, said quadrangle being defined by said special position and three said base positions defining said triangle approximating said triangle-like sub-area, said data producing means utilizing said quadrangle-like sub-area in place of said triangle-like sub-area for producing said stitch position-related data; and data utilization means for using said stitch position-related data to form said stitches.

2. The apparatus as set forth in claim 1, wherein said dividing means divides a polygon as said are into a plurality of sub-polygons as said sub-areas, said specific positions consisting of vertices of said polygon, said base positions including said vertices.

3. The apparatus as set forth in claim 1, wherein said data producing means produces, as said stitch position-related data, a plurality of sets of block data each representative of a corresponding one of said sub-areas, said each set of block data comprising sets of position data representative of the base positions defining the sub-polygon approximating said corresponding one sub-area.

4. The apparatus as set forth in claim 1, wherein said data producing means produces, based on each of said sub-areas, stitch position data representative of stitch positions which said embroidery sewing machine alternately connects with thread for forming said stitches and filling said each sub-area with the formed stitches, said stitch position data serving as said stitch position-related data.

5. The apparatus as set forth in claim 1, wherein said dividing means comprises:

determining means for determining substantially the most distant two positions of the specific positions on said outline of said area, as a minimum and a maximum position of said area; and judging means for judging whether or not all straight segments obtained by connecting each of said distant two positions on said outline and each of the other specific positions on said outline are contained inside said outline, said dividing means dividing said area into divided areas as said sub-areas by said division lines so that said judging means provides an affirmative judgment with respect to each of said divided areas.

6. The apparatus as set forth in claim 1, wherein said checking means comprises first judging means for judging whether or not said dividing means provides a triangle-like sub-area as one of said sub-areas such that said triangle-like sub-area has a sub-area adjacent thereto, said triangle-like sub-area and the adjacent sub-area having a common segment belonging to one of said division lines, said checking means providing said negative judgment and said modifying means modifying said triangle-like sub-area to said quadrangle-like sub-area by determining said special position on an outline of said adjacent sub-area if said first judging means provides an affirmative judgment, said checking means providing an affirmative judgment and said data producing means utilizing said triangle-like sub-area for producing said stitch position-related data if said first judging means provides a negative judgment.

7. The apparatus as set forth in claim 6, wherein said first judging means of said checking means judges whether or not said dividing means provides said triangle-like sub-area such that said adjacent sub-area is a sub-area other than a triangle-like sub-area.

8. The apparatus as set forth in claim 6, wherein said modifying means comprises second judging means for, if said affirmative judgment is provided by said first judging means, judging whether or not each of the two segments of an outline of said triangle-like sub-area other than said common segment belongs to one of said division lines, said modifying means determining, if only one of said two segments belongs to one of said division lines, said one segment as a special segment, and specifying said special position on a segment of the outline of said adjacent sub-area which segment is adjacent to said special segment of said triangle-like sub-area, said data producing means handling said special segment as a stitch-free segment on which said data producing means provides no stitch position.

9. The apparatus as set forth in claim 1, wherein, if said dividing means produces as one of said sub-areas a quadrangle-like sub-area which is approximated by a quadrangle as said corresponding one sub-polygon therefor, said data producing means utilizes said quadrangle-like sub-area for producing said stitch position-related data.

10. The apparatus as set forth in claim 1, wherein said dividing means comprises:

means for determining substantially the most distant two positions of said specific positions on said outline of said area, as a maximum and a minimum position of said area;

means for determining a direction of a straight line passing said maximum and minimum positions as a longitudinal direction of said area, said outline consisting of a pair of portions which are opposed to each other with respect to said maximum and minimum positions;

means for comparing a number of the specific positions on one of the opposed portions of said outline, with a number of the specific positions on the other portion thereof, determining as a first portion of said outline one of said opposed portions which includes the smaller number of specific positions, and defining a plurality of straight first aid lines which are perpendicular to said longitudinal direction and each of which passes a corresponding one of the specific positions on said first portion of said outline and intersects the other portion of said outline as a second portion thereof, said first aid lines dividing said area and said outline into a plurality of first blocks and a plurality of first segments, respectively, each of said first blocks being enveloped by corresponding two of said first aid lines which are opposed to each other and corresponding two of said first segments which are opposed to each other; and means for modifying said first blocks by selecting, as a division base position, one of the specific positions located on said second portion of said outline which one specific position cooperates with each of the specific positions located on said first portion of said outline and associated with said first aid lines to define, in place of the first aid line passing said each associated specific position, a corresponding one of said division lines which passes said each associated specific position on said first portion of said outline and said division base position on said second portion of said outline, said sub-areas consisting of the modified first blocks, said sub-areas including two triangle-like sub-areas to which said minimum and maximum positions belong, respectively.

11. The apparatus as set forth in claim 10, wherein said dividing means comprises:

means for defining a plurality of straight second aid lines which are perpendicular to said longitudinal direction and each of which passes a corresponding one of the specific positions on said second portion of said outline and intersects said first portion of said outline, said second aid lines cooperating with said first aid lines to divide said area and said outline into a plurality of second blocks and a plurality of second segments, respectively, each of said second blocks being enveloped by corresponding two of sad first and second aid lines which are opposed to each other and corresponding two of said second segments which are opposed to each other;

means for determining a first vector starting at one of opposite ends of one of the opposed two segments of each of said second blocks and ending at the other end of said one segment, a second vector starting at one of opposite sends of the other segment which end is opposed to said one end of said one segment and ending at the other end of said other segment which end is opposed to said other end of said one segment, and a third vector which starts at a position on one of the opposed two aid lines of said each second block, extends in a direction of a vector obtained by addition of said first and second vectors, and ends at a position on the other aid line, the end position on each of said first and second aid lines at which the third vector determined for one of the two second blocks adjacent to said each aid line ends serving simultaneously as the start position on said each aid line at which the third vector determined for the other block starts, said minimum position serving as one of the start ends and the end ends for both the first and second vectors for the second block to which said minimum position belongs and simultaneously as one of the start position and the end position for the second block to which said minimum position belongs, while said maximum position serving as one of the end ends and the start ends for both the first and second vectors for the second block to which said maximum position belongs and simultaneously as one of the end position and the start position for the second block to which said maximum position belongs;

means for determining with respect to each of said first aid lines a fourth vector by addition of the third vectors determined for the two blocks adjacent to said each first aid line; and means for defining a straight reference line which passes the specific position associated with said each first aid line and is perpendicular to said fourth vector.

12. The apparatus as set forth in claim 11, wherein said dividing means comprises:

means for determining an intersection of said each first aid line and said second portion of said outline, and determining two of the specific positions on said second portion which positions are adjacent to said intersection and located on both sides of said intersection, respectively, as a preceding and a following specific position for said associated specific position; and means for comparing a first angle contained by said reference line and a first straight line defined by said preceding specific position and said associated specific position, with a second angle contained by said reference line and a second straight line defined by said following specific position and said associated specific position, said dividing means determining as said division base position one of said preceding and following specific positions which provides the smaller one of said first and second angles, said modified first blocks being defined by said outline and the division lines determined with respect to said first aid lines.

13. The apparatus as set forth in claim 10, wherein said checking means comprises third judging means for judging whether or not each of said two triangle-like sub-areas is said appropriate sub-area, based on at least one parameter with respect to said polygon approximating said area.

14. The apparatus as set forth in claim 13, wherein said at least one parameter comprise a first angle contained by one of the two segments of an outline of each of said two triangle-like sub-areas to which said minimum and maximum positions respectively belong, which two segments commonly have a corresponding one of said minimum and maximum positions, and a segment adjacent to said one segment on one of said first and second portions of said outline, a second dangle contained by the other of said two segments and a segment adjacent to said other segment on the other of said first and second portions of said outline, a first distance between said corresponding one of said minimum and maximum positions and a base position adjacent thereto which cooperates with one of said minimum and maximum positions to define said one segment on said one portion of said outline as measured in said longitudinal direction, and a second distance between one of said minimum and maximum positions and a base position adjacent hereto which cooperates with one of said minimum and maximum positions to define said other segment on said other portion of said outline as measured in said longitudinal direction, said checking means providing an affirmative judgment if said first angle is equal to said second angle and said first distance is equal to said second distance, said checking means providing said negative judgment if said first angle is equal to said second angle and said first distance is greater than said second distance, so that said modifying means determines said other segment as said special segment and specifies said special position on said other segment, said checking means providing said negative judgment if said first angle is equal to said second angle and said first distance is smaller than said second distance, so that said modifying means determines said one segment as said special segment and specifies said special position on said one segment, said checking means providing said negative judgment if said first angle is greater than said second angle and said first distance is greater than said second distance, so that said modifying means determines said other segment as said special segment and specifies said special position on said other segment, said checking means providing said affirmative judgment if said first angle is greater than said second angle and said first distance is not greater than said second distance, said checking means providing said negative judgment if said first angle is smaller than said second angle and said first distance is smaller than said second distance, so that said modifying means determines said one segment as said special segment and specifies said special position on said one segment, said checking means providing said affirmative judgment if said first angle is smaller than said second angle and said first distance is not smaller than said second distance.

15. The apparatus as set forth in claim 13, wherein said dividing means comprises fourth judging means for judging whether or not all straight segments obtained by connecting each of said distant two positions on said outline and each of the other specific positions on said outline are contained inside said outline, said dividing means dividing said area into divided areas as said sub-areas by a plurality of first division lines as said division lines so that said third judging means provides an affirmative judgment with respect to each of said divided areas, said dividing means providing said modified first from said divided areas by using a plurality of second division lines as said division lines such that said divided areas include two triangle-like modified first blocks to which the minimum and maximum positions thereof belong, respectively, said checking means comprising fifth judging means for, with respect to each of the two triangle-like modified first blocks to which said minimum and maximum positions belong, judging whether or not each of the two segments of an outline of said each triangle-like modified first block which segments commonly have a corresponding one of said minimum and maximum positions, belongs to one of said first division lines, said checking means providing said negative judgment if only one of said two segments belongs to one of said first division lines, so that said modifying means modifies the triangle-like modified block to a quadrangle-like block by determining said one segment as a special segment and specifying said special position on a segment of the outline of a modified first block adjacent to the triangle-like modified first block which segment is adjacent to said special segment, said data producing means handling said special segment as a stitch-free segment on which said data producing means provides no stitch position, said third judging means judging whether or not said each triangle-like modified first block is said appropriate sub-area, if both of said two segments of said each triangle-like modified first block do not belong to said first division lines.

16. An apparatus for preparing stitch position-related data and utilizing the data for controlling an embroidery sewing machine to embroider a predetermined area by forming stitches at respective stitch positions and thereby filling the area with the formed stitches, comprising:

dividing means for specifying a plurality of base positions on an outline of said area based on outline data representative of said outline, said outline data including a plurality of sets of position data each of which is representative of a corresponding one of a plurality of specific positions predetermined on said outline, said base positions defining a polygon approximating said area, said dividing means defining a plurality of straight division lines each of which passes a corresponding pair of base positions of said plurality of base positions and which do not intersect each the inside said outline, said division lines dividing said area and said polygon into a plurality of first sub-areas and a plurality of first sub-polygons, respectively, each of said first sub-areas being approximated by a corresponding one of said first sub-polygons, said dividing means dividing said area such that said first sub-areas include at least one triangle-like sub-area each of which is approximated by a triangle as said corresponding one sub-polygon therefor;

data producing means for producing said stitch position-related data based on said sub-areas;

checking means for, before said dividing means divides said area into said first sub-areas, judging whether or not each of said at least one triangle-like sub-area is an appropriate sub-area to be utilized by said data producing mans for producing said stitch position-related data;

said dividing means dividing said are into a plurality of second sub-areas by, with respect to the each of at least one triangle-like sub-area of which a negative judgment is made by said checking means, replacing the each triangle-like sub-area with a quadrangle, by determining a special position on said outline of said area, said quadrangle being defined by said special position and the three base positions defining the triangle approximating the each triangle-like sub-area, said data producing means producing said stitch position-related data based on said second sub-areas including said quadrangle-like sub-area; and data utilization means for using said stitch position-related data to form said stitches.

17. An apparatus for preparing stitch position-related data and utilizing the data for controlling an embroidery sewing machine to embroider a predetermined area by forming stitches at respective stitch positions and thereby filling the area with the formed stitches, comprising:

dividing means for specifying a plurality of base positions on an outline of said area based on outline data representative of said outline, said outline data including a plurality of sets of position data each of which is representative of a corresponding one of a plurality of specific positions predetermined on said outline, said base positions defining a polygon approximating said area, said dividing means defining a plurality of straight division lines each of which passes a corresponding pair of base positions of said plurality of base positions and which do not intersect each of the inside said outline, said division lines dividing said area and said polygon into a plurality of sub-areas and a plurality of sub-polygons, respectively, each of said first sub-areas being approximated by a corresponding one of said sub-polygons, said dividing means dividing said area such that said sub-areas include at least one triangle-like sub-area each of which is approximated by a triangle as said corresponding one sub-polygon therefor;

data producing means for producing said stitch position-related data based on said sub-areas;

checking means for judging whether or not each of said at least one triangle-like sub-area is an appropriate sub-area to be utilized by said data producing mans for producing said stitch position-related data;

modifying means for, with respect to the each of at least one triangle-like sub-area for which a negative judgment is made by said checking means, modifying the each triangle-like sub-area of a quadrangle-like sub-area which is approximated by a quadrangle, by determining a special position on said outline of said area, said quadrangle being defined by said special position and the three base positions defining the triangle approximating the each triangle-like sub-area, said data producing means utilizing said quadrangle-like sub-area for producing said stitch position-related data; and data utilization means for using said stitch position-related data to form said stitches.

18. The apparatus as set forth in claim 17, wherein said checking means judges whether or not said each of at least one triangle-like sub-area is said appropriate sub-area, before said dividing means divides said area into said sub-areas.

19. The apparatus as set forth in claim 17, wherein said checking means judges whether or not said each of at least one triangle-like sub-area is said appropriate sub-area, after said dividing means divides said area into said sub-areas.

20. The apparatus as set forth in claim 17, wherein said dividing means comprises:

means for determining substantially the most distant two positions of said specific positions on said outline of said area, as a maximum and a minimum position of said area, said polygon approximating said area being defined by not less than five of said base positions;

means for determining a direction of a straight line passing said maximum and minimum positions as a longitudinal direction of said area, said outline consisting of a pair of portions which are opposed to each other with respect to said maximum and minimum positions;

means for comparing a number of the specific positions on one of said opposed portions of said outline, with a number of the specific positions on the other portion thereof, determining as a first portion of said outline one of said opposed portions which includes the smaller number of specific positions, and defining a plurality of straight first aid lines which are perpendicular to said longitudinal direction and each of which passes a corresponding one of the specific positions on said first portion of said outline and intersects the other portion of said outline as a second portion thereof, said first aid lines dividing said area and said outline into a plurality of first blocks and a plurality of first segments, respectively, each of said first blocks being enveloped by corresponding two of said first aid lines which are opposed to each other and corresponding two of said firs segments which are opposed to each other; and means for modifying said first blocks by selecting, as a division base position, one of the specific positions located on said second portion of said outline which on specific position cooperates with each of the specific positions located on said first portion of said outline and associated with said first aid lines to define, in place of the first aid line passing said each associated specific position, a corresponding one of said division lines which passes said each associated specific position on said first portion of said outline and said division base position on said second portion of said outline, said base positions consisting of said specific positions, said sub-areas consisting of the modified first blocks, said sub-areas including two triangle-like sub-areas to which said minimum and maximum positions belong, respectively.

* * * * *